US011161645B2

(12) United States Patent
Wiley

(10) Patent No.: US 11,161,645 B2
(45) Date of Patent: Nov. 2, 2021

(54) PALLET CONTAINER

(71) Applicant: Ted E. Wiley, Dover, AR (US)

(72) Inventor: Ted E. Wiley, Dover, AR (US)

( * ) Notice: Subject to any disclaimer, the term of this patent is extended or adjusted under 35 U.S.C. 154(b) by 0 days.

(21) Appl. No.: 16/230,479

(22) Filed: Dec. 21, 2018

(65) Prior Publication Data

US 2019/0118996 A1 Apr. 25, 2019

Related U.S. Application Data

(63) Continuation of application No. 14/888,286, filed as application No. PCT/US2014/036014 on Apr. 30, 2014, now Pat. No. 10,160,568.

(60) Provisional application No. 61/817,419, filed on Apr. 30, 2013.

(51) Int. Cl.

| | |
|---|---|
| ***B65D 5/42*** | (2006.01) |
| ***B65D 5/36*** | (2006.01) |
| ***B65D 5/32*** | (2006.01) |

(52) U.S. Cl.

CPC ..... *B65D 5/3628* (2013.01); *B65D 5/32* (2013.01); *B65D 5/36* (2013.01); *B65D 5/3685* (2013.01); *B65D 5/4266* (2013.01)

(58) Field of Classification Search

CPC ..... B65D 5/3628; B65D 5/36; B65D 5/3685; B65D 5/4266; B65D 5/32; B65D 5/3657; B65D 5/3664; B65D 5/42

USPC ..... 206/386, 597, 600; 229/109, 194

See application file for complete search history.

(56) References Cited

U.S. PATENT DOCUMENTS

| | | | | |
|---|---|---|---|---|
| 1,796,035 A | | 3/1931 | Maier | |
| 2,019,787 A | | 11/1935 | Leopold | |
| 2,072,753 A | * | 3/1937 | Ikeda | B65D 5/2047 206/45.29 |
| 2,147,676 A | | 2/1939 | Shoemaker | |
| 2,169,065 A | * | 8/1939 | Cole | B65D 5/26 229/147 |
| 2,459,939 A | | 1/1949 | Hill | |
| 2,660,363 A | | 11/1953 | Trickett, Jr. | |
| 2,660,364 A | | 11/1953 | Ferguson | |

(Continued)

FOREIGN PATENT DOCUMENTS

| | | |
|---|---|---|
| CH | 2861027 Y | 1/2007 |
| CH | 103448979 | 12/2013 |

(Continued)

OTHER PUBLICATIONS

"Notice of Allowance received for U.S. Appl. No. 14/888,286, dated Aug. 16, 2018, 7 pages".

(Continued)

*Primary Examiner* — Rafael A Ortiz
(74) *Attorney, Agent, or Firm* — Kutak Rock LLP

(57) ABSTRACT

A pallet container having eight side walls, a bottom piece, two leg flaps that are used to automatically deploy the container from a flat, collapsed position, and a series of inside folds and outside folds. The pallet container is constructed from one or more blanks made of cardboard. The blanks used to make the pallet container may have different configurations. The pallet container has an open and a closed position and can be converted from one position to the other by a single person without the need of special tools or equipment. A cardboard blank for making the pallet container is also disclosed.

7 Claims, 63 Drawing Sheets

(56) References Cited

U.S. PATENT DOCUMENTS

| | | | | | |
|---|---|---|---|---|---|
| 3,027,064 | A * | 3/1962 | Thomas | B65D 5/22 229/117.12 |
| 3,039,600 | A | 6/1962 | Bellows | |
| 3,093,291 | A | 6/1963 | Brandle | |
| 3,285,399 | A * | 11/1966 | Snow | A47F 5/112 229/108 |
| 3,381,880 | A | 5/1968 | Carle et al. | |
| 3,682,369 | A | 8/1972 | Isakson | |
| 3,933,300 | A | 1/1976 | Dempster | |
| 4,139,146 | A | 2/1979 | Bamburg et al. | |
| 4,171,763 | A | 10/1979 | Card | |
| 4,238,069 | A | 12/1980 | Morris, Jr. | |
| 4,313,556 | A * | 2/1982 | Boyle | B65D 5/3628 229/108 |
| 4,360,146 | A * | 11/1982 | Koltz | B65D 5/3685 229/104 |
| 4,365,738 | A | 12/1982 | Densen | |
| 4,392,607 | A | 7/1983 | Perkins, Jr. | |
| 4,676,429 | A | 6/1987 | Crowe | |
| 4,702,408 | A | 10/1987 | Powlenko | |
| 4,844,331 | A | 7/1989 | Oldfather | |
| 4,856,705 | A | 8/1989 | Carr et al. | |
| 5,016,814 | A | 5/1991 | Fullerton | |
| 5,139,196 | A | 8/1992 | Fry et al. | |
| 5,398,868 | A | 3/1995 | Densen | |
| D361,892 | S | 9/1995 | Quaintance | |
| 5,531,374 | A | 7/1996 | Gasper | |
| 5,630,543 | A * | 5/1997 | Dugan | B65D 5/3628 229/109 |
| 5,853,121 | A | 12/1998 | Francisco | |
| 5,915,617 | A | 6/1999 | Gasper | |
| 7,328,833 | B1 | 2/2008 | Wiley | |
| 7,654,440 | B2 * | 2/2010 | Quaintance | B65D 5/029 229/109 |
| 9,045,250 | B2 * | 6/2015 | Henderson | B65D 5/56 |
| 9,827,732 | B2 | 11/2017 | Wiley | |
| 10,160,568 | B2 | 12/2018 | Wiley | |
| 10,364,058 | B2 | 7/2019 | Wiley | |
| 2004/0211825 | A1 | 10/2004 | Champion et al. | |
| 2008/0078819 | A1 | 4/2008 | Strong et al. | |
| 2009/0057382 | A1 | 3/2009 | Churvis | |
| 2009/0121001 | A1 | 5/2009 | Perez et al. | |
| 2016/0075465 | A1 | 3/2016 | Wiley | |
| 2016/0075466 | A1 | 3/2016 | Wiley | |
| 2016/0244201 | A1 | 8/2016 | Wiley | |
| 2017/0096251 | A1 | 4/2017 | Wiley | |
| 2018/0072012 | A1 | 3/2018 | Wiley | |
| 2019/0344923 | A1 | 11/2019 | Wiley | |

FOREIGN PATENT DOCUMENTS

| | | |
|---|---|---|
| FR | 2995286 | 3/2014 |
| WO | 9807629 | 2/1998 |

OTHER PUBLICATIONS

"Final Office Action received for U.S. Appl. No. 14/888,286, dated May 15, 2018".
"Final Office Action Received for U.S. Appl. No. 15/284,243, dated Sep. 11, 2018, 7 Pages."
"Final Office Action Received for U.S. Appl. No. 14/947,469 dated Nov. 3, 2017, 11 pages".
"International Search Report and Written Opinion received for PCT Application No. PCT/US2014/036014, dated Sep. 24, 2014.", 17 pages.
"Non Final office Action Received for U.S. Appl. No. 14/947,469 dated Jun. 7, 2017, 9 pages".
"Non-Final Office Action Received for U.S. Appl. No. 14/888,286, dated Oct. 20, 2017, 12 pages".
"Non-Final Office Action Received for U.S. Appl. No. 15/046,261 dated Feb. 8, 2017, 6 pages".
"Non-Final office Action Received for U.S. Appl. No. 15/284,243, dated Dec. 27, 2017, 7 pages".
"Non-Final Office Action received for U.S. Appl. No. 15/818,059, dated Feb. 6, 2018, 8 pages".
"Notice of Allowance received for U.S. Appl. No. 14/888,286, dated Aug. 21, 2018, 7 pages".
"Notice of Allowance Received for U.S. Appl. No. 15/046,261 dated Jul. 25, 2017, 5 pages".
"Notice of Allowance Received for U.S. Appl. No. 15/818,059, dated Aug. 23, 2018, 14 pages".
"Notice of Allowance Received for U.S. Appl. No. 15/284,243, dated Mar. 14, 2019, 8 pages".
"Unknown, 5lb. Mushroom Container".
"Non Final Office Action Received for U.S. Appl. No. 16/525,246, dated Jul. 15, 2020."

* cited by examiner

FIG. 28
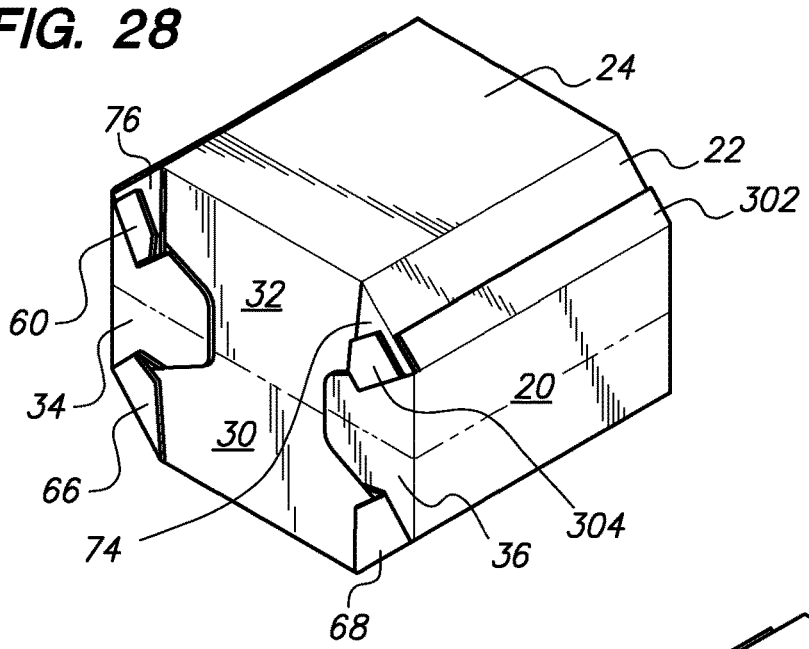
FIG. 29
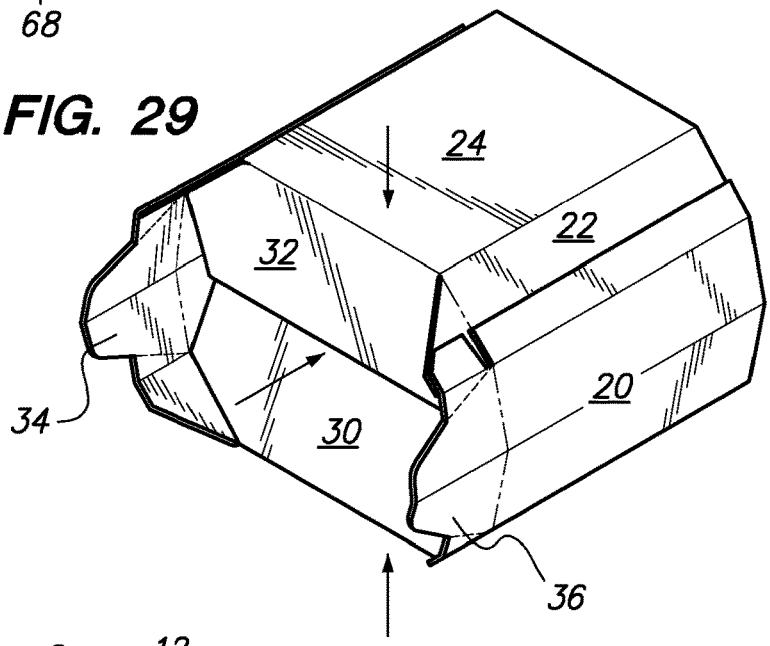
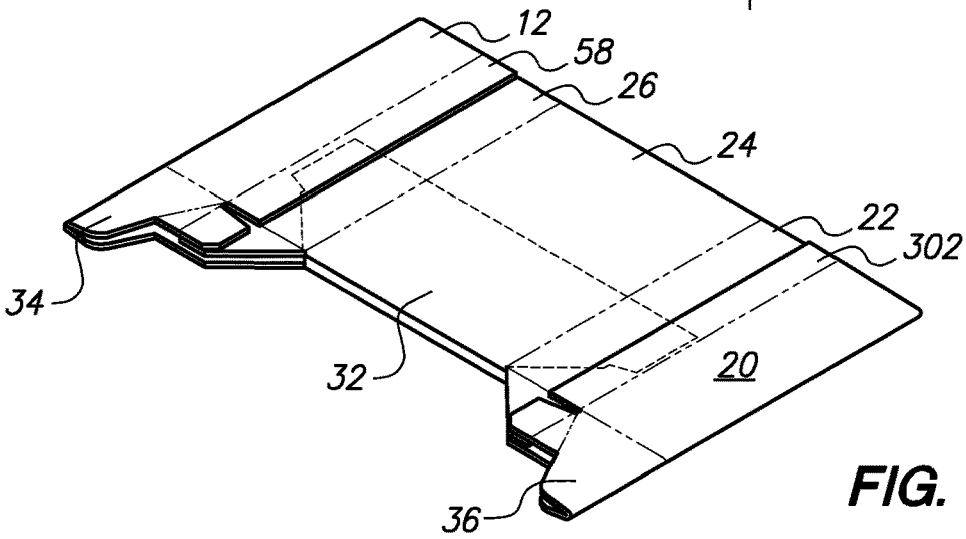
FIG. 30

52
20
18
16
14
12
904
808
802
906
58
902
60

52
20
18
16
44
14
12
904
808
802
906
902
58
60

PALLET CONTAINER

This application is a continuation application of U.S. patent application Ser. No. 14/888,286, filed Oct. 30, 2015 and now U.S. Pat. No. 10,160,568, which is a United States National Stage Application of Patent Cooperation Treaty Application No. PCT/US14/36014, filed Apr. 30, 2014, which claims priority to U.S. Provisional Patent Application No. 61/817,419, filed Apr. 30, 2013, the disclosures of which are incorporated herein by reference in their entireties.

TECHNICAL FIELD

The present invention relates to cardboard containers and, more particularly, to cardboard containers utilized on conventional pallets.

BACKGROUND ART

Numerous corrugated containers have been proposed over the years for confining and protecting heavy or bulky palletized loads. Wooden pallets are in widespread use in industrial or warehouse environments where they are stacked upon one another until use, and thereafter forcibly manipulated and moved about by powerful fork-lift trucks. During transit, these heavily laden pallets are routinely subjected to mechanical stresses and shocks as they are aggressively and sometimes carelessly moved about during typical loading and unloading operations. A variety of heavy duty, corrugated boxes have been designed strictly for pallet use. Many of these fold together and have a plurality of locking straps or flaps that interconnect with portions of the pallet. Most have a base that engages the pallet with an upright, generally tubular body that is polygonal in shape (octagonal and hexagonal configurations are the most common).

Many of the prior art large-capacity pallet boxes must be inverted before unfolding. Either the box must be handled by two workers, or one worker must push it against a wall or similar stationary object to force it to deploy. Typically, six to eight flaps must be manually aligned and interfitted with two or more major flaps on the bottom locking the device together. Once the main bottom flaps are locked, the box is turned over for use. Some boxes of this description are so flimsy that the mere act of flipping them over forces the box apart, necessitating re-assembly prior to loading. Pallet boxes are used in various food industries and may be filled with a thousand or more pounds of meat product such as chicken, beef, or pork.

Because of these heavy loads, the prior art pallet containers are also susceptible to bulging on all sides. The bulging often prevents the most economical packing of pallets and transport of the containers, which results in higher shipping costs. In some cases, the bulging can cause collapse of the container and result in spillage of the contents of the containers.

It would therefore be desirable to develop a pallet container that is durable, not susceptible to bulging, and can be easily deployed from a flat state by a single person without the need of special tools or equipment.

DISCLOSURE OF INVENTION

The pallet container of the present invention has eight side walls, a bottom piece, two leg flaps that are used to automatically deploy the container from a flat, collapsed position, and a series of inside folds and outside folds. The pallet container is constructed from one or more blanks made of cardboard. The blanks used to make the pallet container may have different configurations. The pallet container has an open and a closed position and can be converted from one position to the other by a single person without the need of special tools or equipment.

These and other features, objects and advantages of the present invention will become better understood from a consideration of the following detailed description of the preferred embodiments and appended claims in conjunction with the drawings as described following:

BRIEF DESCRIPTION OF THE DRAWINGS

FIG. 28 is a perspective view of the pallet container of FIG. 26 in the deployed position.

FIG. 29 is a perspective view of the bottom of the pallet container of FIG. 26 transitioning from the deployed position to the collapsed position.

FIG. 30 is a perspective view of the pallet container of FIG. 26 in the collapsed position.

BEST MODE FOR CARRYING OUT THE INVENTION

Figure 1:
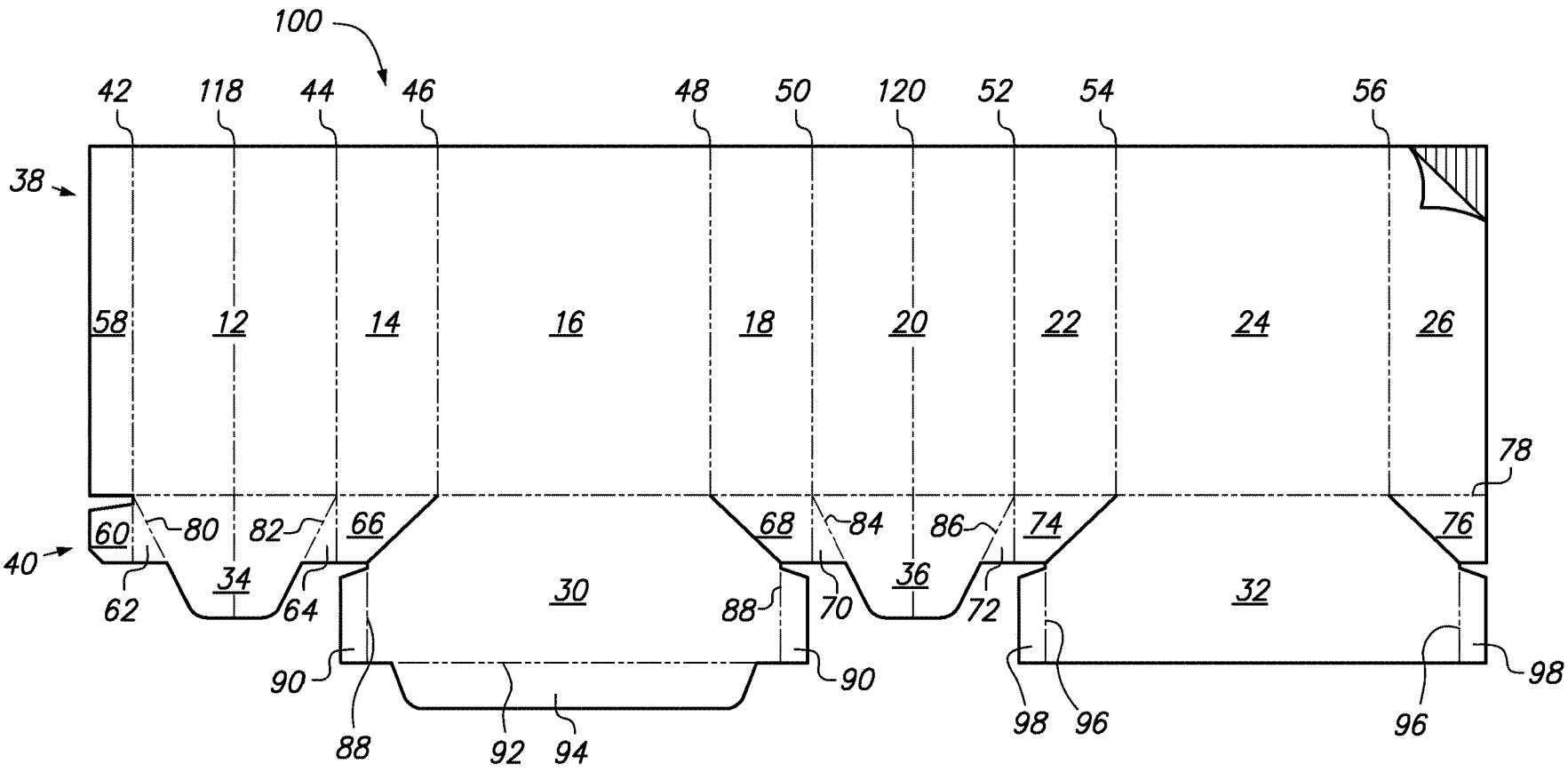
FIG. 1 is a flat plan view of the blank of the first embodiment of the present invention.
Figure 2:
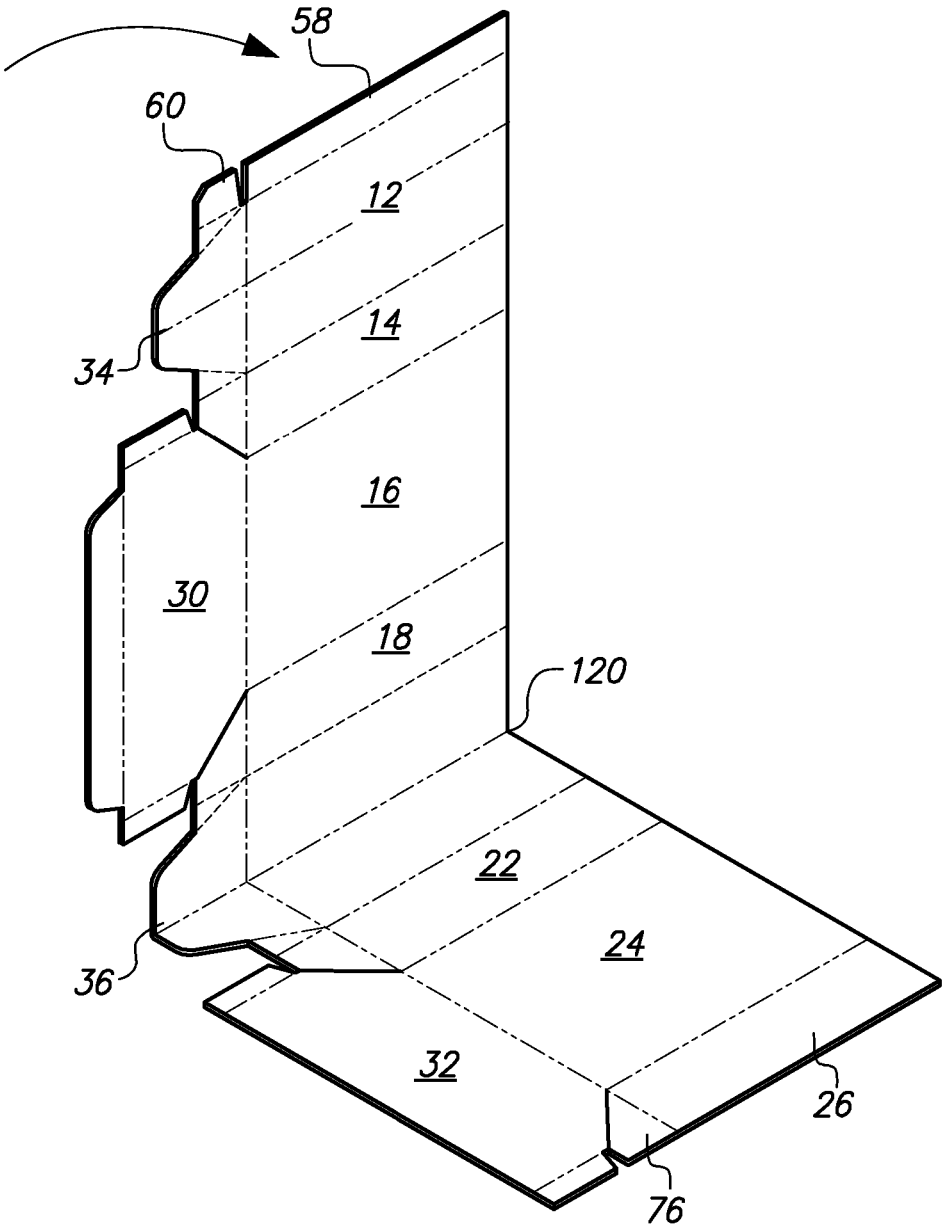
FIG. 2 is a perspective view of the blank of FIG. 1 partially folded along score line 120.
Figure 3:
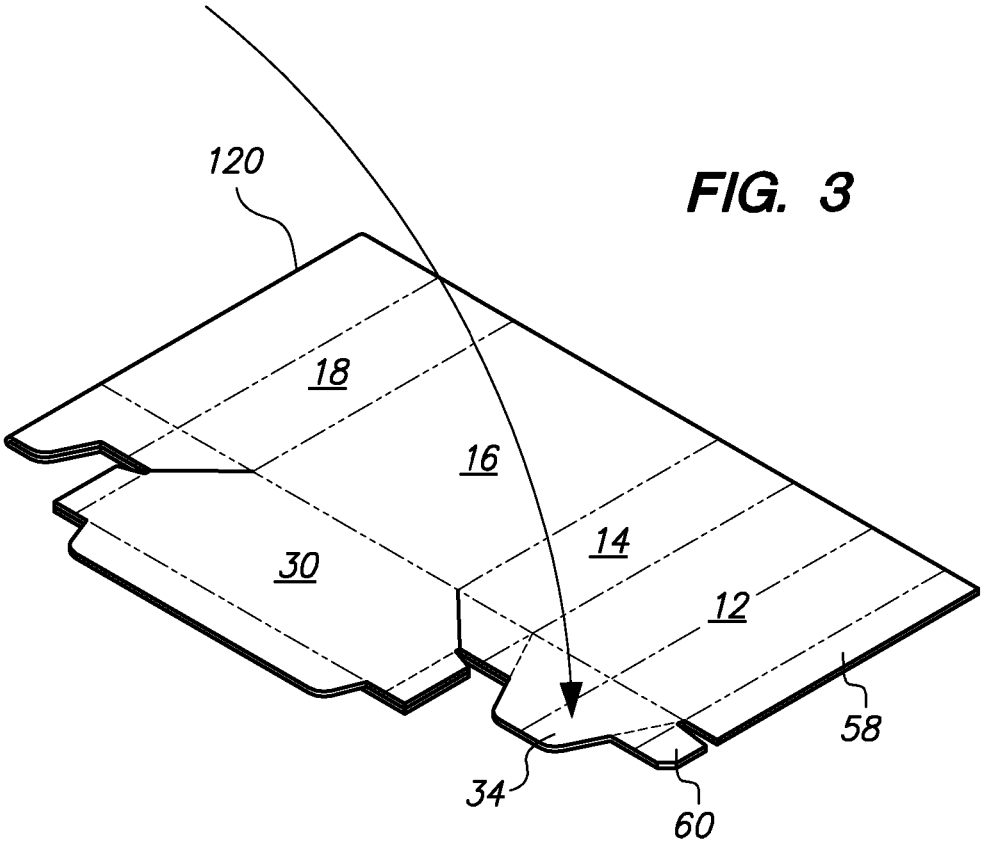
FIG. 3 is a perspective view of the blank of FIG. 1 completely folded along score line 120.
Figure 4:
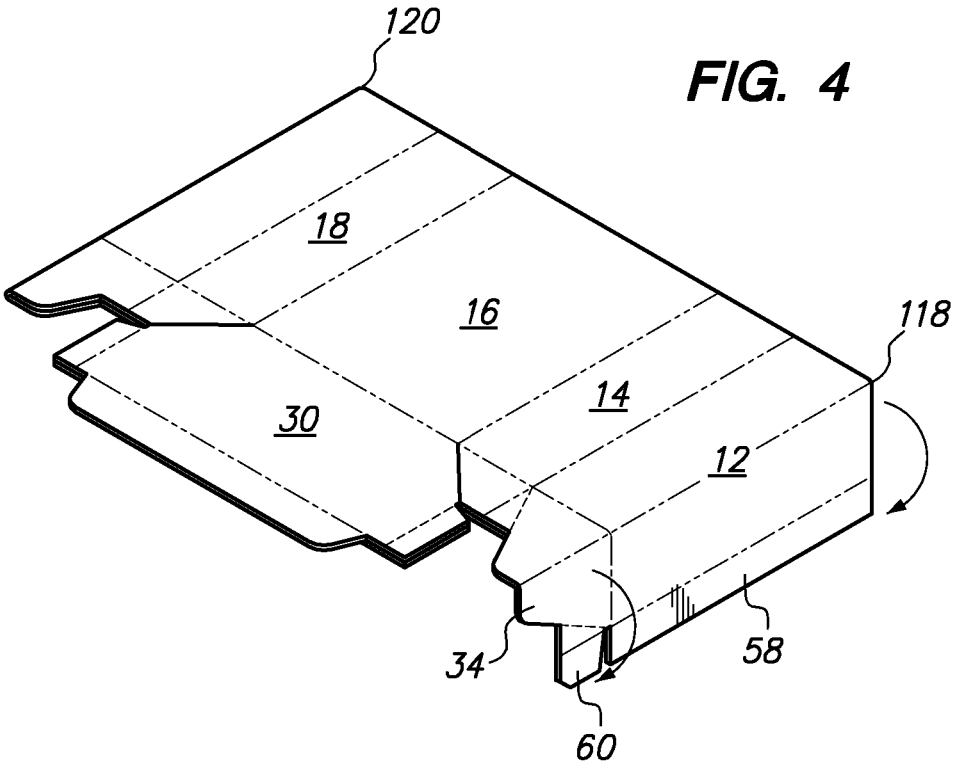
FIG. 4 is a perspective view of the blank of FIG. 3 partially folded along score line 118.
Figure 5:
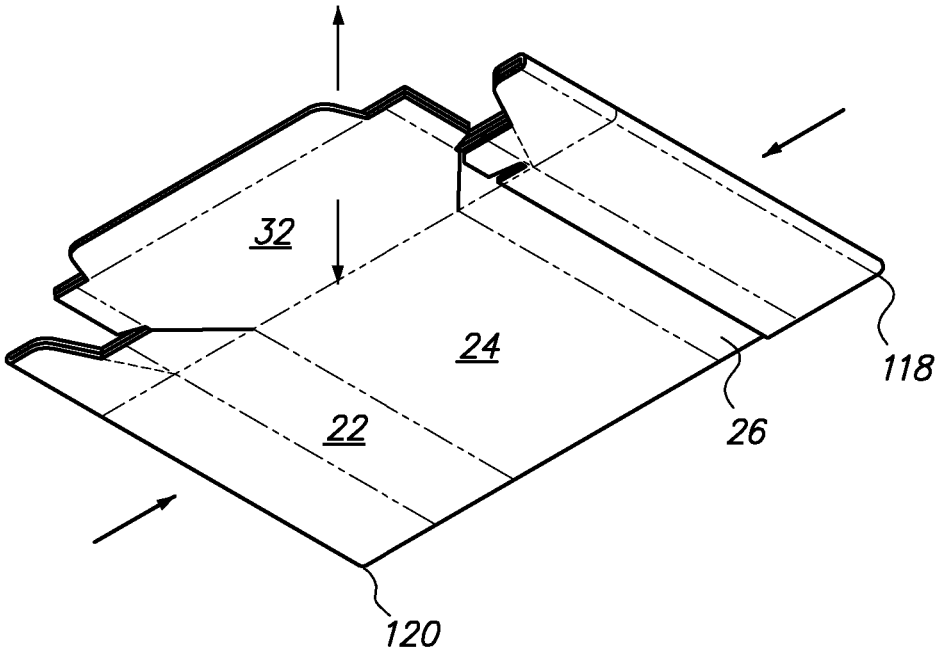
FIG. 5 is a perspective view of the blank of FIG. 4 with glue flap 58 joined to eighth wall 26 and glue flap 60 joined to outside fold 76.
Figure 6:
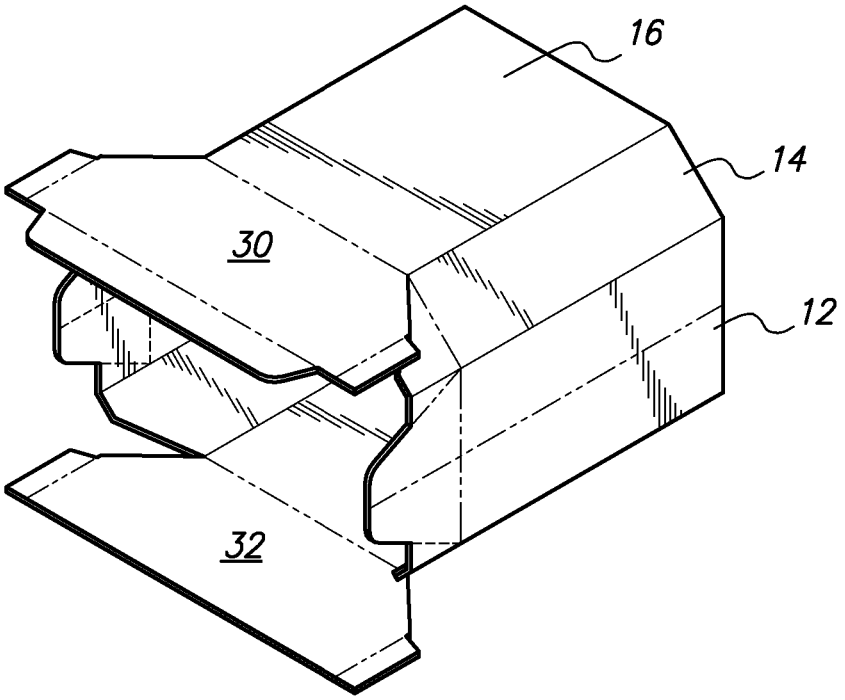
FIG. 6 is a perspective view of the pallet container constructed from the blank of FIG. 1 with the top of the container in the open position.
Figure 7:
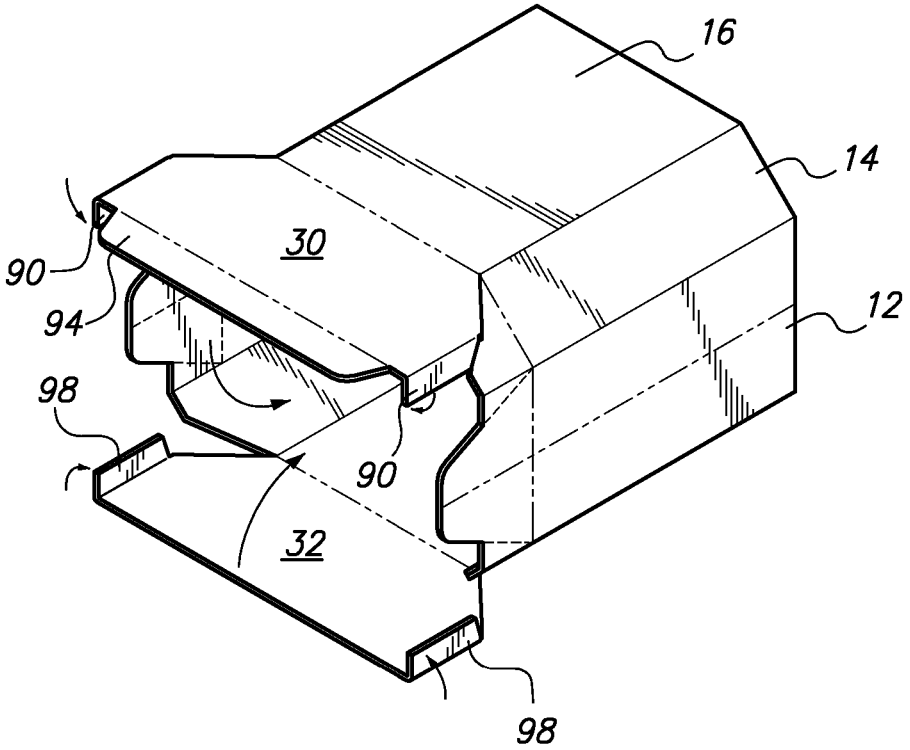
FIG. 7 is a perspective view of the pallet container of FIG. 6 with the inside flaps folded along score lines 88 and 96.
Figure 8:
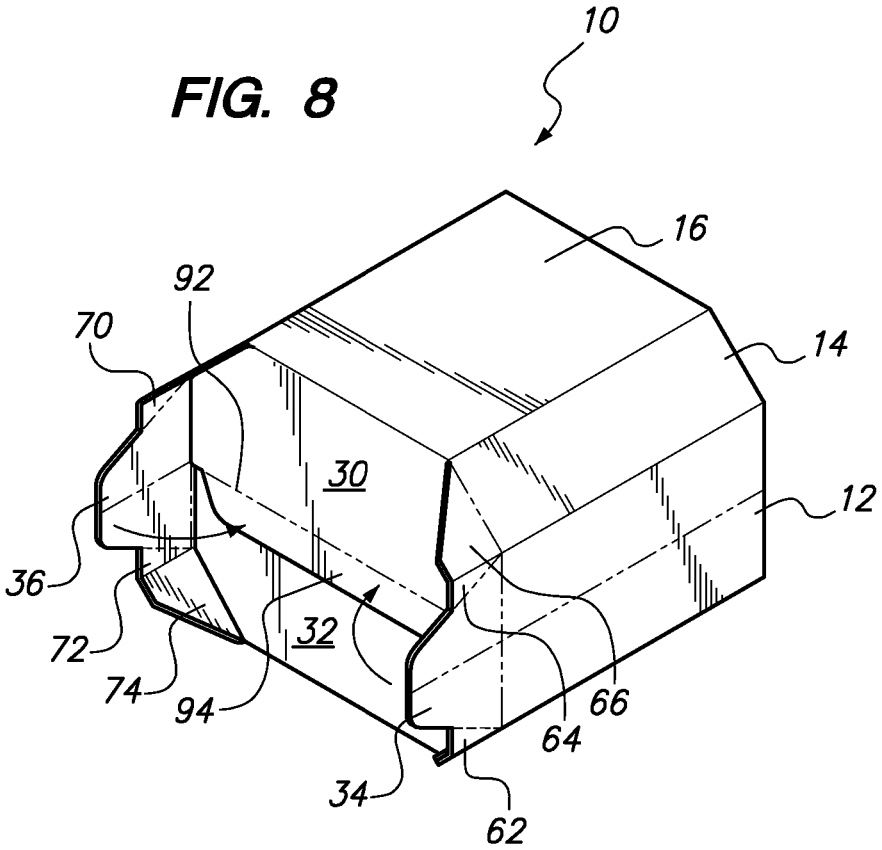
FIG. 8 is a perspective view of the bottom of the pallet container of FIG. 6 with bottom flap 30 joined to bottom flap 32.
Figure 99:
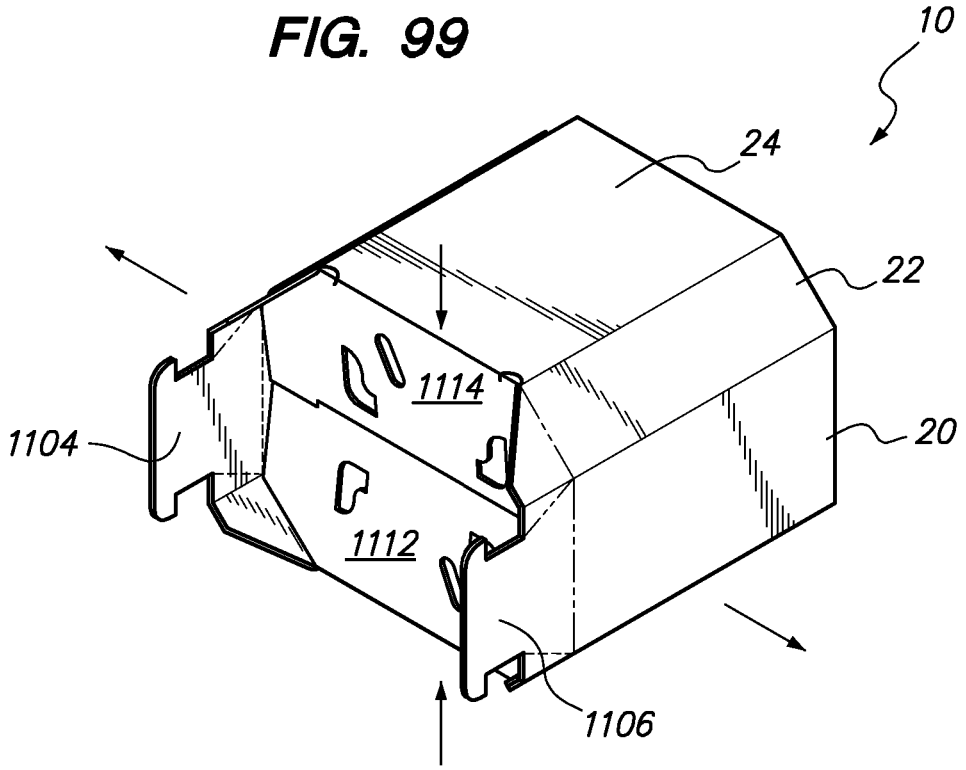
FIG. 99 is a perspective view of the bottom of the pallet container of FIG. 96 transitioning from the deployed position to the collapsed position.

With reference to FIGS. 1-99, the preferred embodiments of the present invention may be described. The pallet container 10 has eight side walls 12, 14, 16, 18, 20, 22, 24, 26, a bottom piece 28, two leg flaps 34, 36 that are used to automatically deploy the container 10 from a flat, collapsed position (or a closed position), and a series of inside folds and outside folds. The pallet container 10 is constructed from a blank made of cardboard. The preferable size of the container 10 will vary based on the goods being transported in the container 10. As described herein, the pallet container 10 can be constructed from blanks having different configurations.

In the first preferred embodiment, as shown in FIGS. 1-13, the blank 100 has a first row 38 and a second row 40. The first row 38 is comprised of a glue flap 58, a first wall 12, a second wall 14, a third wall 16, a fourth wall 18, a fifth wall 20, a sixth wall 22, a seventh wall 24, and an eighth wall 26. The glue flap 58, first wall 12, second wall 14, third wall 16, fourth wall 18, fifth wall 20, sixth wall 22, seventh wall 24, and eighth wall 26 are all preferably rectangular in shape. The glue flap 58 is joined to the first wall 12 via a score line 42. Similarly, the first wall 12 is joined to the second wall 14 via score line 44, the second wall 14 to the third wall 16 via score line 46, the third wall 16 to the fourth wall 18 via score line 48, the fourth wall 18 to the fifth wall 20 via score line 50, the fifth wall 20 to the sixth wall 22 via score line 52, the sixth wall 22 to the seventh wall 24 via score line 54, and the seventh wall 24 to the eighth wall 26 via score line 56.

The first row 38 is joined to the second row 40 along score line 78. The second row 40 of blank 100 is comprised of a glue flap 60, an inside fold 62, a first leg flap 34, an inside fold 64, an outside fold 66, a first bottom flap 30, an outside fold 68, an inside fold 70, a second leg flap 36, an inside fold 72, an outside fold 74, a second bottom flap 32, and an outside fold 76.

The glue flap 60 is joined to the inside fold 62 along score line 42. First leg flap 34 is joined to inside fold 62 along score line 80 on one side and joined to inside fold 64 along score line 82 on the other side. Inside fold 64 is joined to outside fold 66 along score line 44. First bottom flap 30 abuts, but is not joined to, the outside fold 66 on one side and the outside fold 68 on the other side. The outside fold 68 is joined to the inside fold 70 along score line 50. The second leg flap 36 is joined to inside fold 70 along score line 84 on one side and to inside fold 72 along score line 86 on the other side. Inside fold 72 is joined to outside fold 74 along score line 52. Second bottom flap 32 abuts, but is not joined to, the outside fold 74 on one side and the outside fold 76 on the other side. The inside folds 62, 64, 70, 72 are triangular-shaped, preferably in the shape of a right triangle.

The first bottom flap 30 and second bottom flap 32 are preferably in the shape of pentagon. The top side of the flaps 30, 32 is along score line 78. The bottom side (or free side) of the flaps 30, 32 is parallel to the top side. Joined to the two parallel left and right sides of the first bottom flap 30 via score lines 88 are inside flaps 90. Joined to the bottom side of the flap 30 via score line 92 is glue flap 94. Joined to the two parallel sides of the second bottom flap 32 via score lines 96 are inside flaps 98.

As shown in FIGS. 2-8, to construct the pallet container 10 from the blank 100 of the first embodiment, the glue flap 58 is attached to eighth wall 26 and the eight walls are folded inward along the score lines 42, 44, 46, 48, 50, 52, 54, 56 of the first row 38 to form the octagon opening 122 of the container 10. Glue flap 58 is preferably glued to the exterior surface of the eighth wall 26. Glue flap 60 of the second row 40 of the blank 100 is similarly attached to the outside fold 76. When glue flaps 58, 60 are attached to the eighth wall 26, score line 42 is aligned with side edge of the eighth wall 26.

Figure 9:
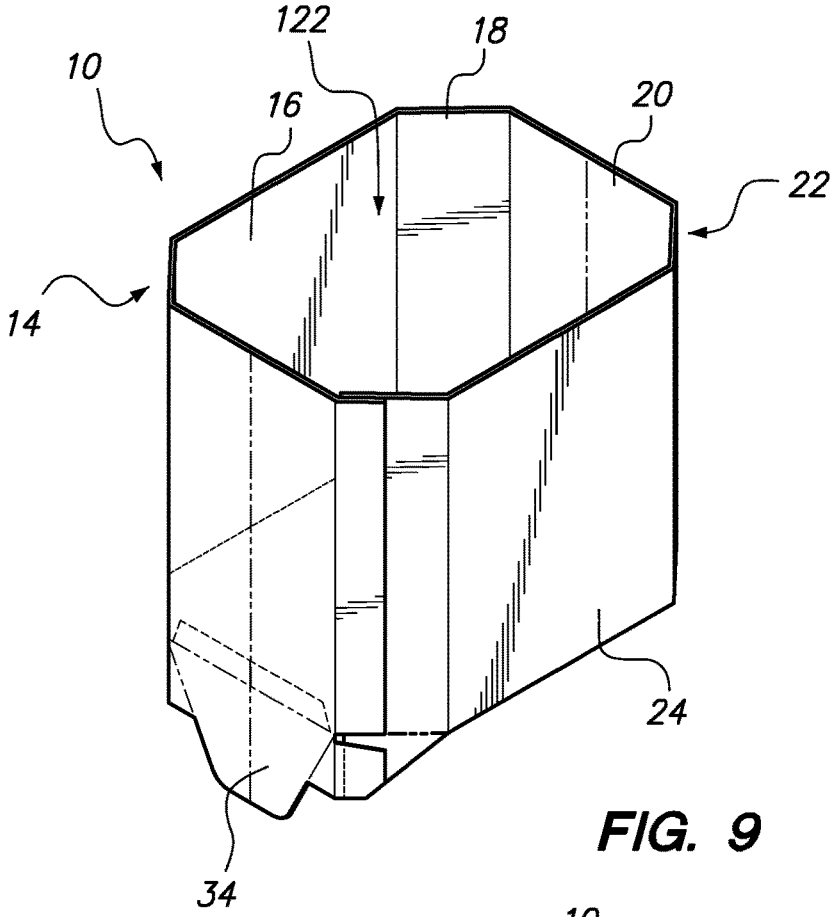
FIG. 9 is a perspective view of the top of the pallet container of FIG. 6 with leg flap 36 folded underneath the bottom piece of the pallet container.

The bottom piece 28 of the container is formed by joining bottom flaps 30, 32 via glue flap 94. The glue flap 94 of the first bottom flap 30 is preferably glued to the exterior surface of second bottom flap 32. As shown in FIG. 9, when the container is the open position, the inside flaps 90, 98 are bent upward along score lines 88, 96. One inside flap 90 and one inside flap 98 are positioned end-to-end and abut first wall 12 in the interior of the container 10. Similarly, one inside flap 90 and one inside flap 98 are positioned end-to-end and abut the fifth wall in the interior of the container 10. The inside flaps 90, 98 serve to seal the interior of the container 10.

Figure 10:
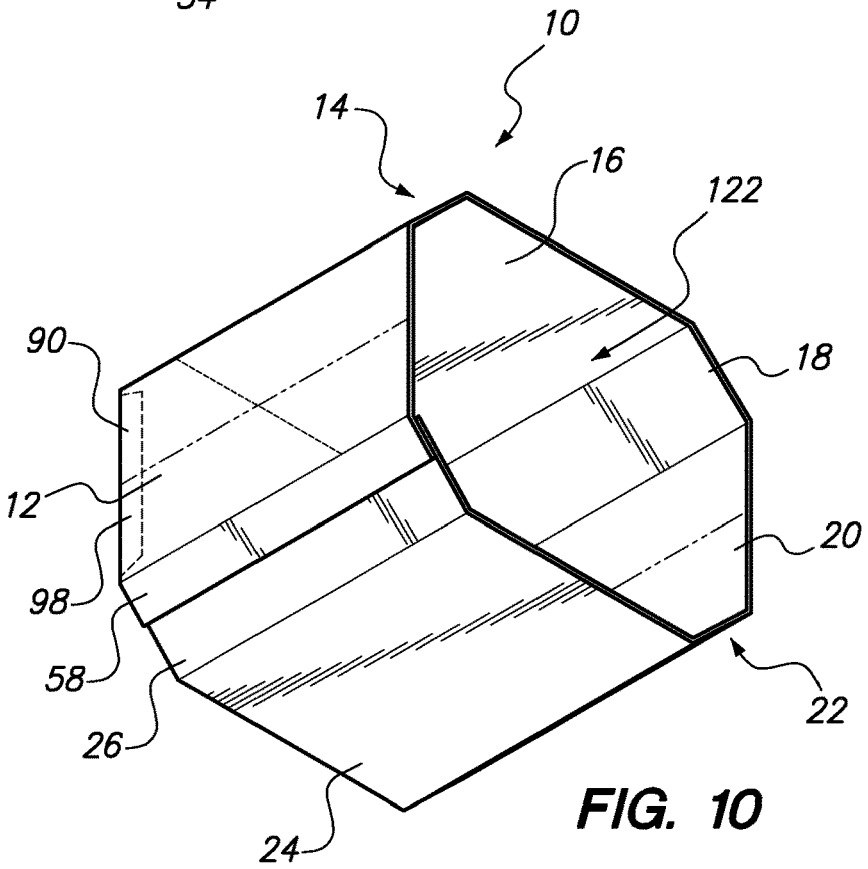
FIG. 10 is a perspective view of the top of the pallet container of FIG. 6.
Figure 12:
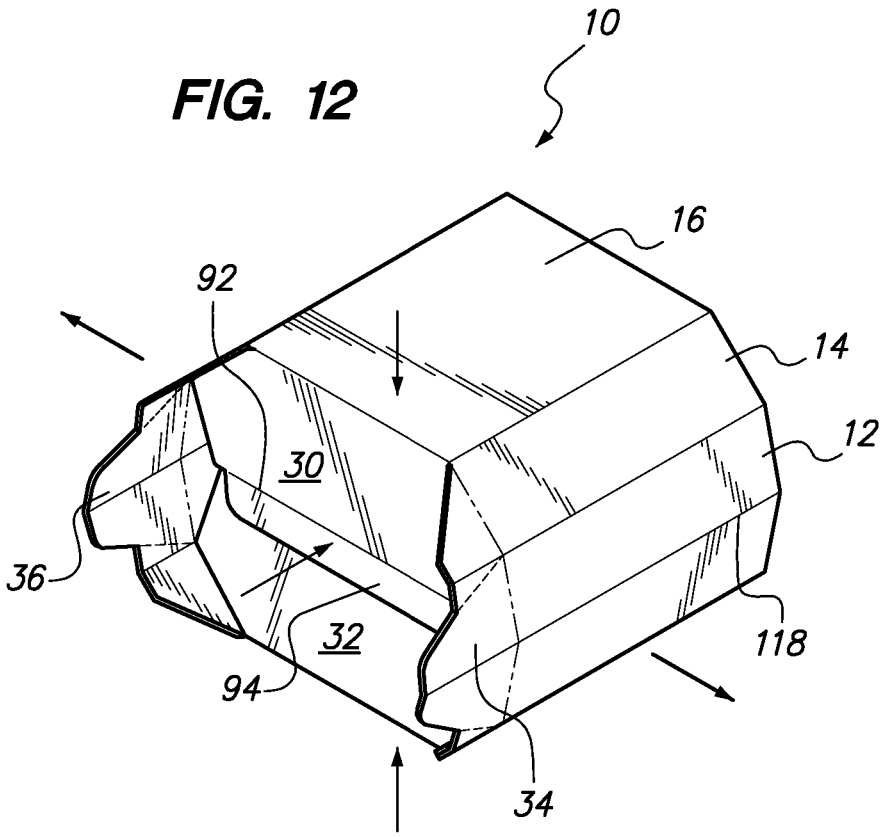
FIG. 12 is a perspective view of the bottom of the pallet container of FIG. 6 transitioning from the deployed position to the collapsed position.
Figure 13:
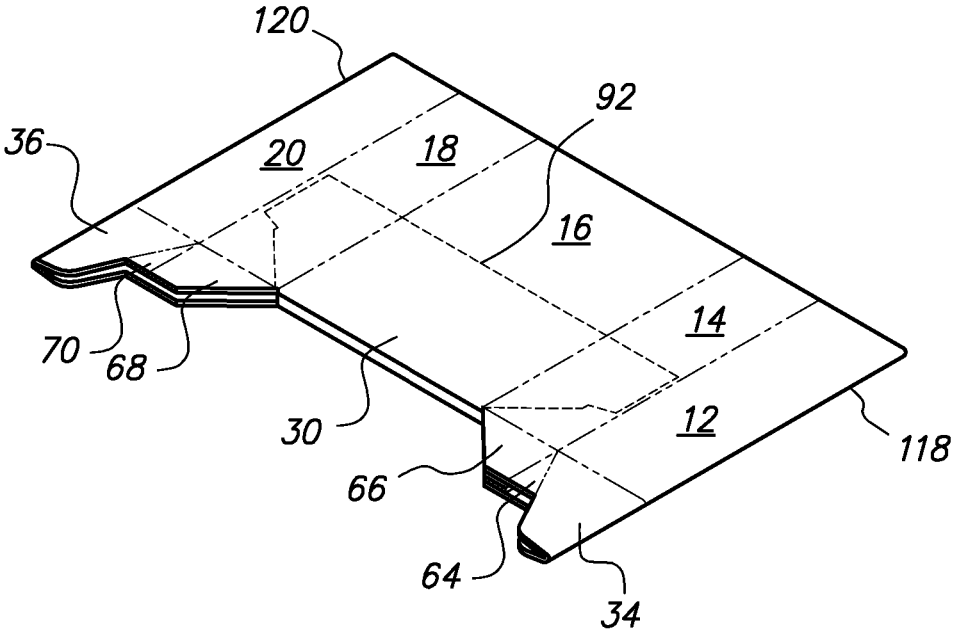
FIG. 13 is a perspective view of the pallet container of FIG. 6 in the collapsed position.
Figure 14:
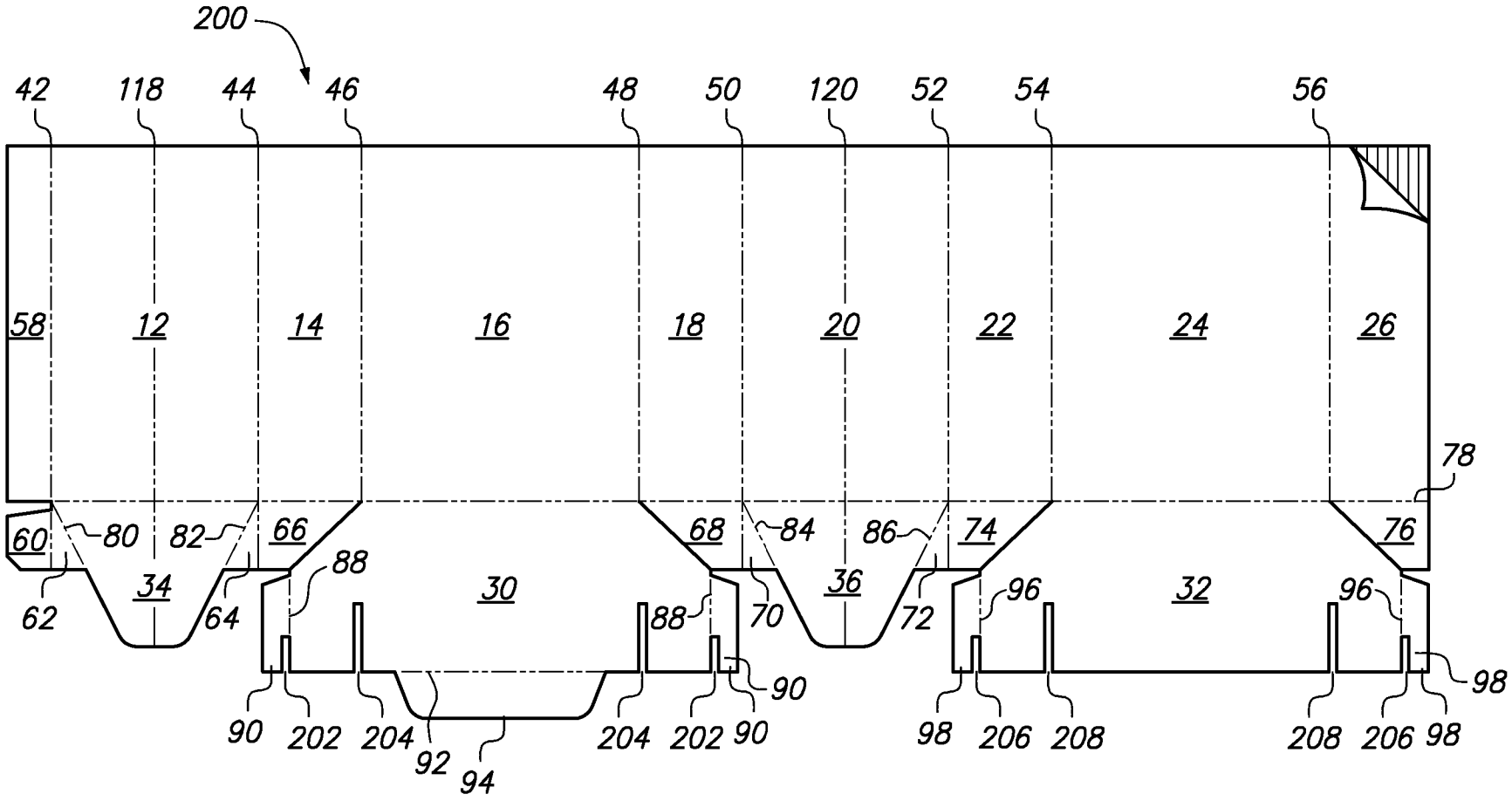
FIG. 14 is a flat plan view of the blank of the second embodiment of the present invention.
Figure 15:
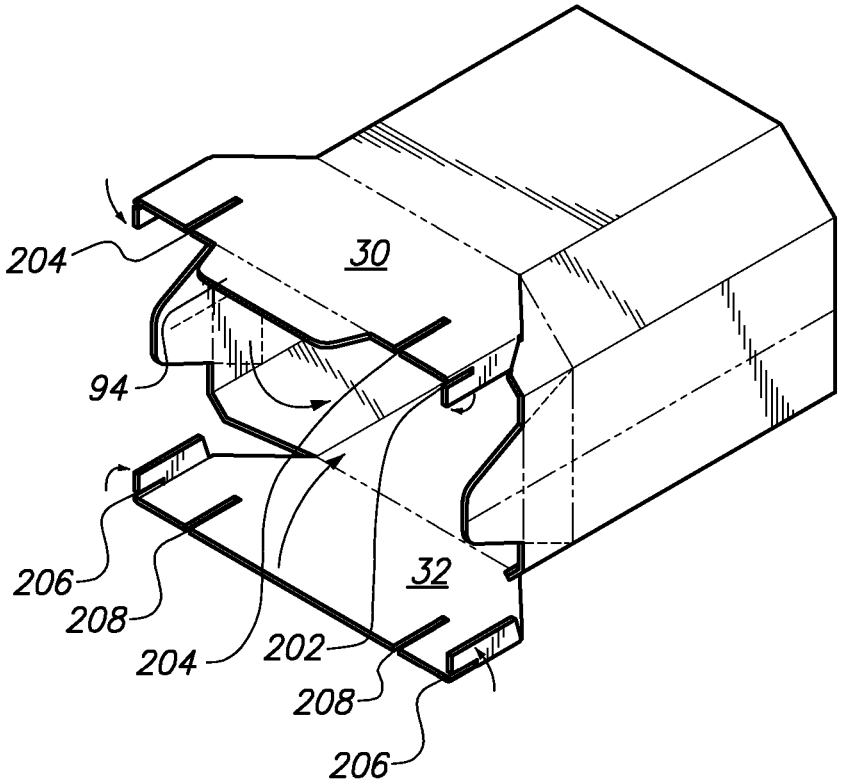
FIG. 15 is a perspective view of the pallet container constructed from the blank of FIG. 14 with the inside flaps folded along score lines 88 and 96.
Figure 16:
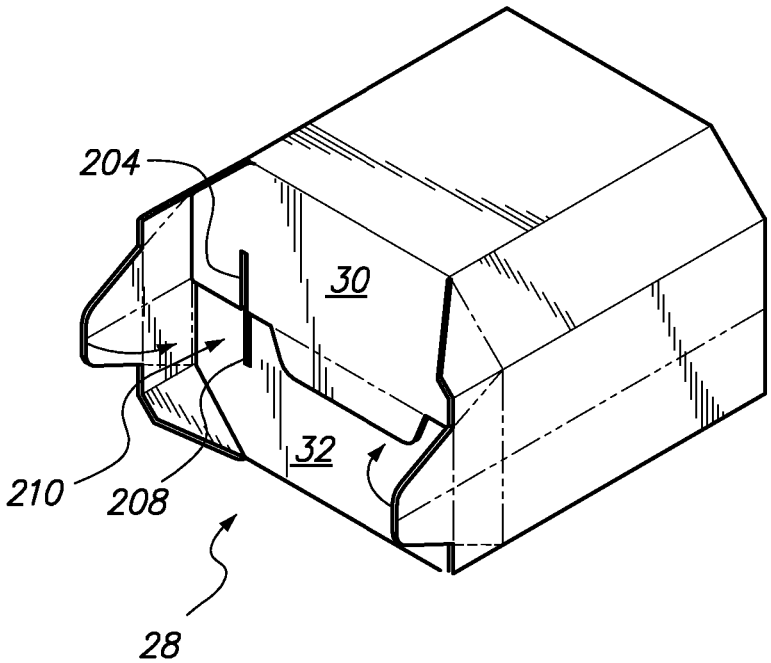
FIG. 16 is a perspective view of the bottom of the pallet container of FIG. 15 with bottom flap 30 joined to bottom flap 32.
Figure 17:
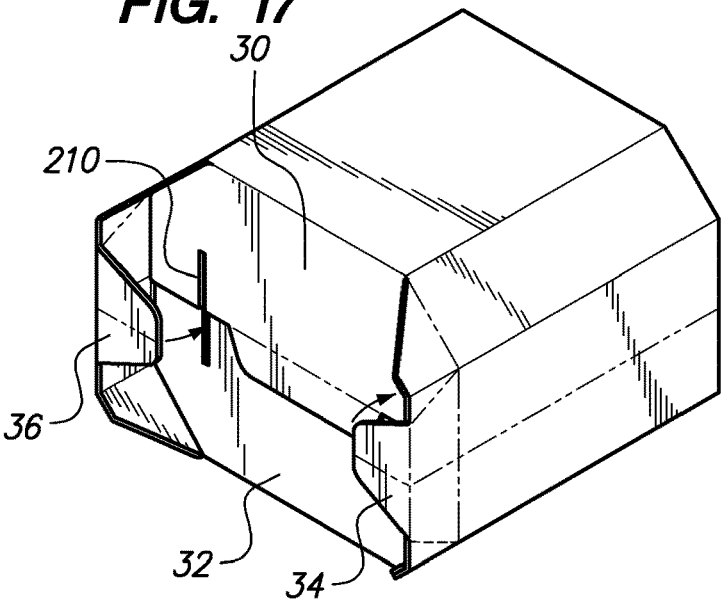
FIG. 17 is a perspective view of the bottom of the pallet container of FIG. 16 with the free ends of leg flaps 34, 36 being inserted into slots 210.
Figure 18:
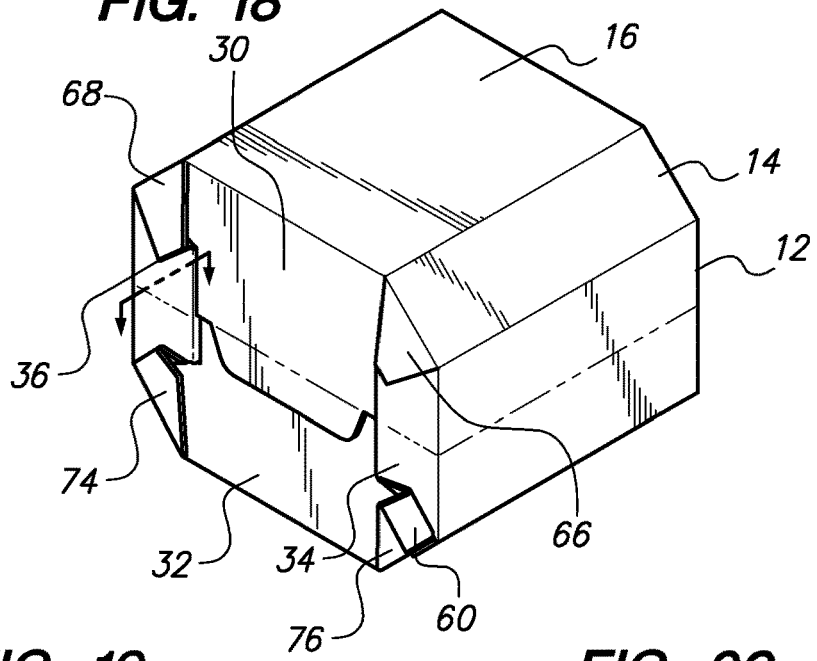
FIG. 18 is a perspective view of the bottom of the pallet container of FIG. 16 with the free ends of the leg flaps 34, 36 inserted into slots 210.
Figure 19:
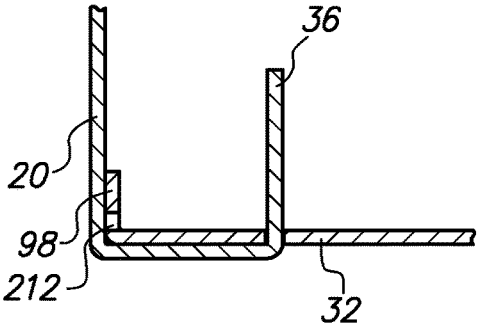
FIG. 19 is a cross-section view of the FIG. 18 with the free end of leg flap 36 in the interior of the pallet container in the unlocked position.
Figure 20:
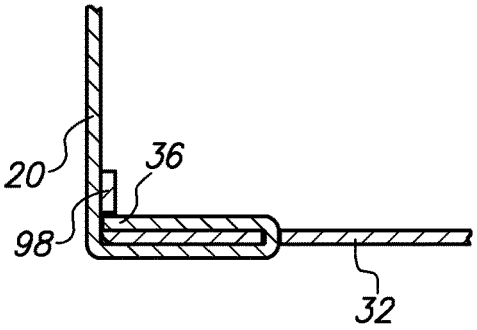
FIG. 20 is a cross-section view of FIG. 18 with the free end of leg flap 36 in the interior of the pallet container in the locked position in slot 212.
Figure 21:
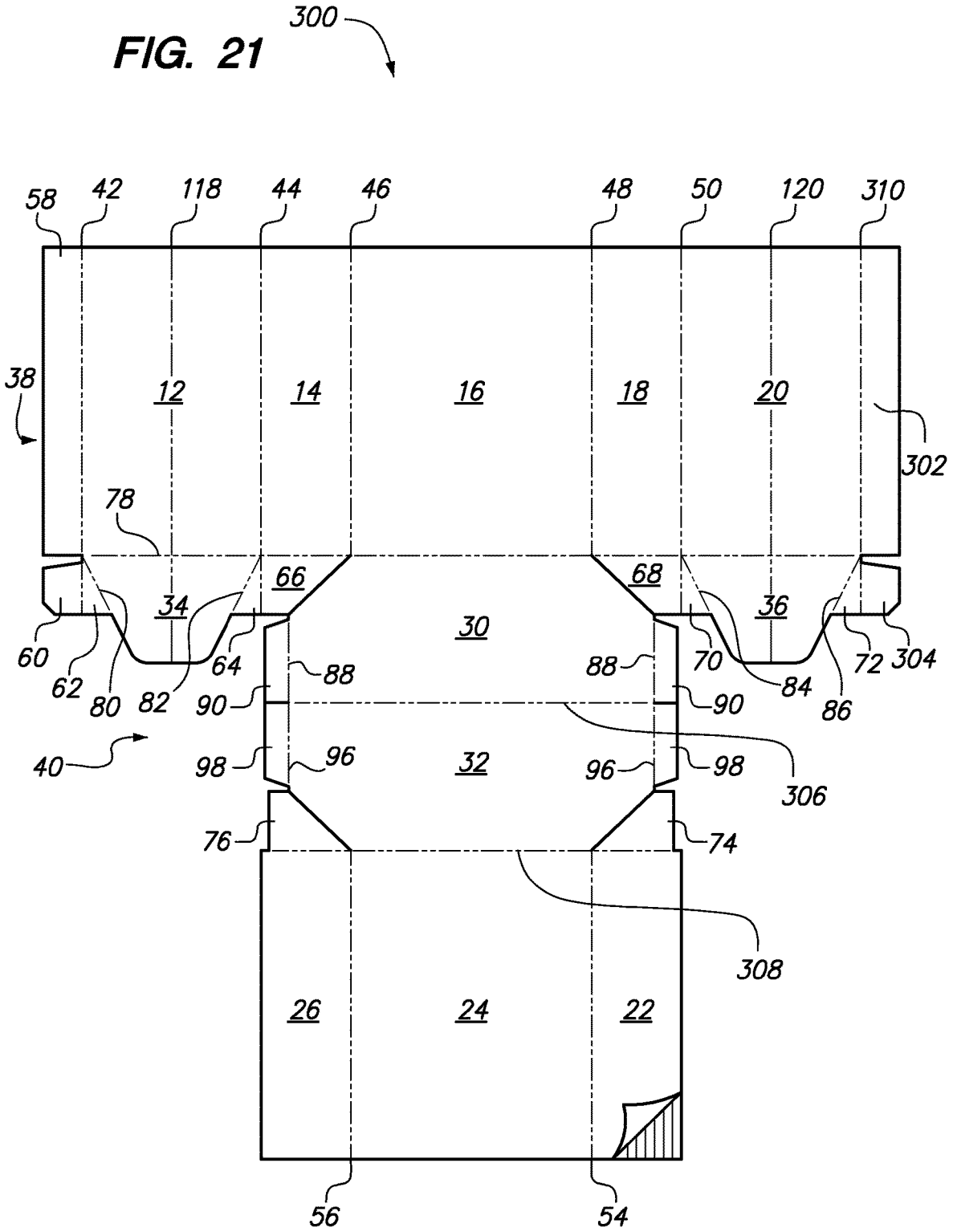
FIG. 21 is a flat plan view of the blank of the third embodiment of the present invention.
Figure 22:
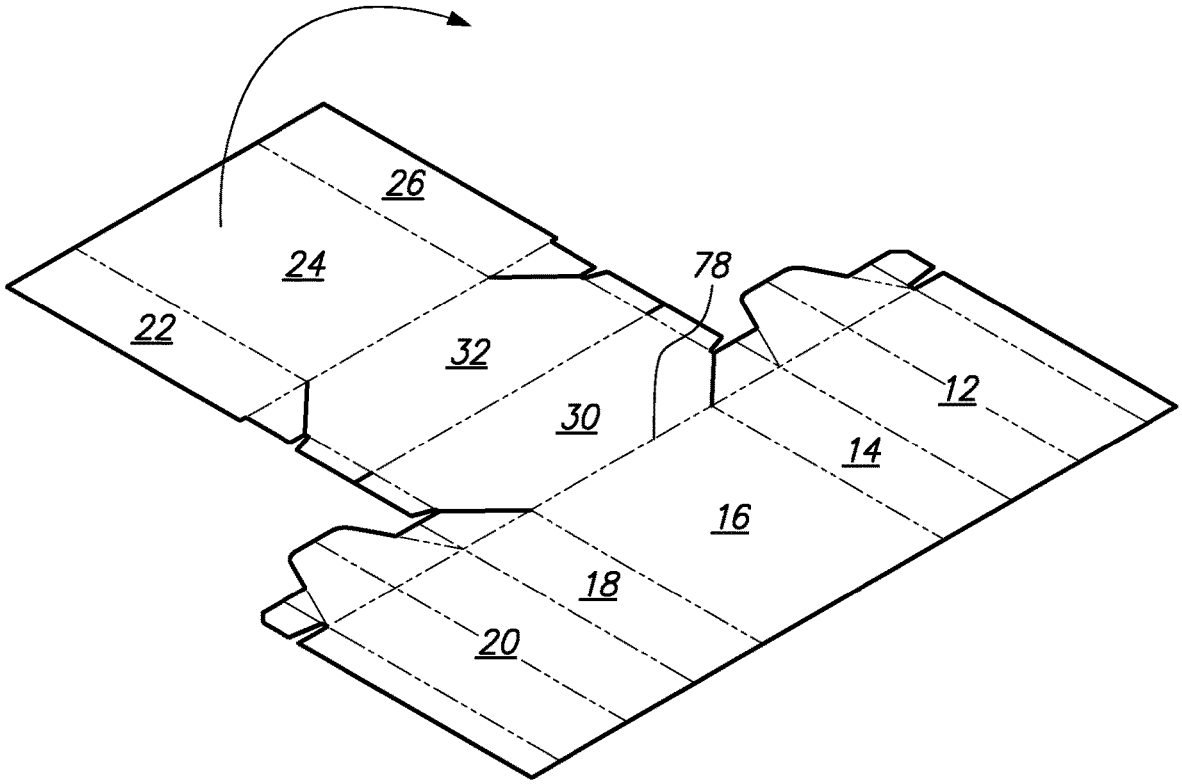
FIG. 22 is a perspective view of the blank of FIG. 21.
Figure 23:
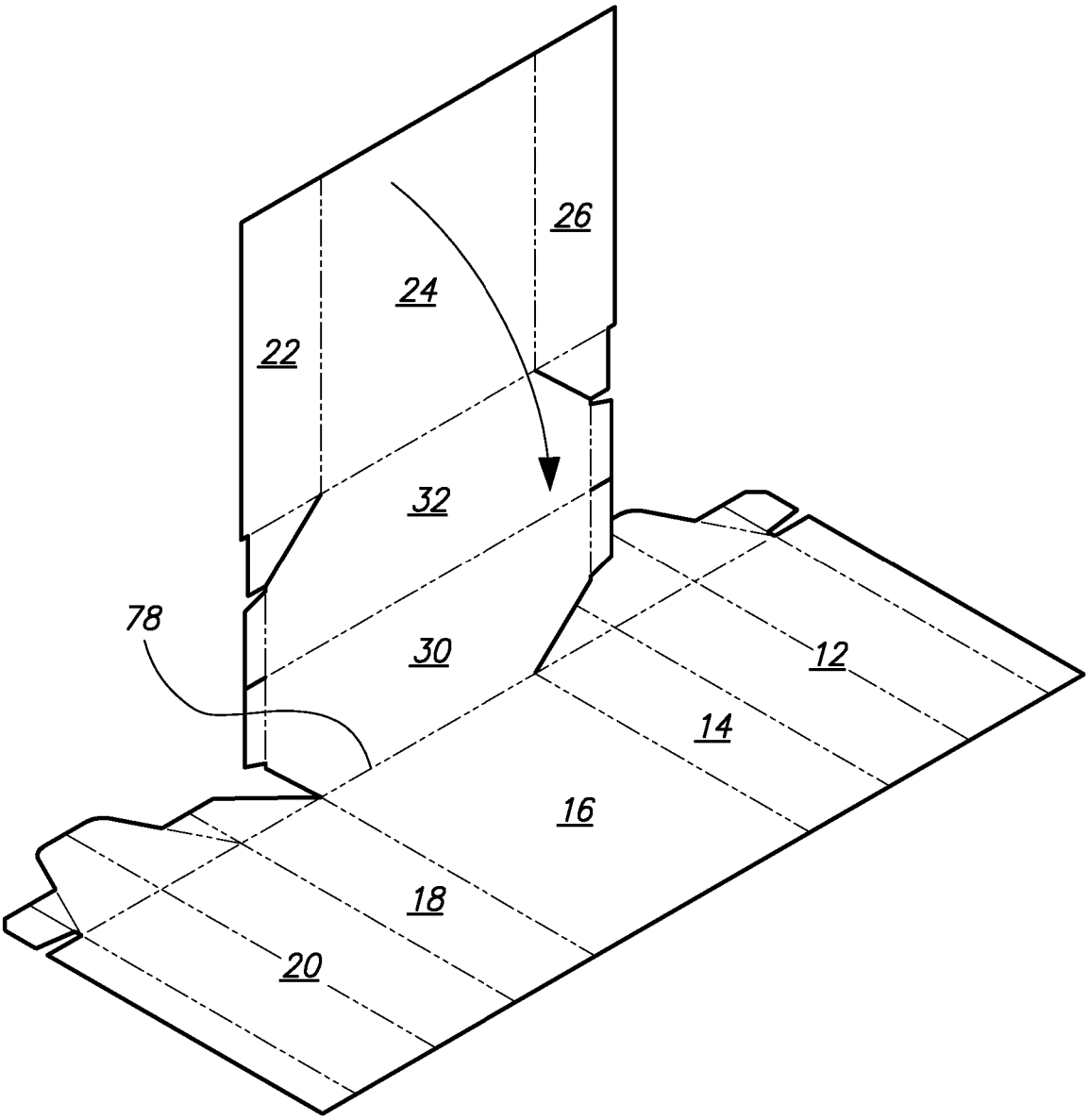
FIG. 23 is a perspective view of the blank of FIG. 21 partially folded along score line 78.
Figure 24:
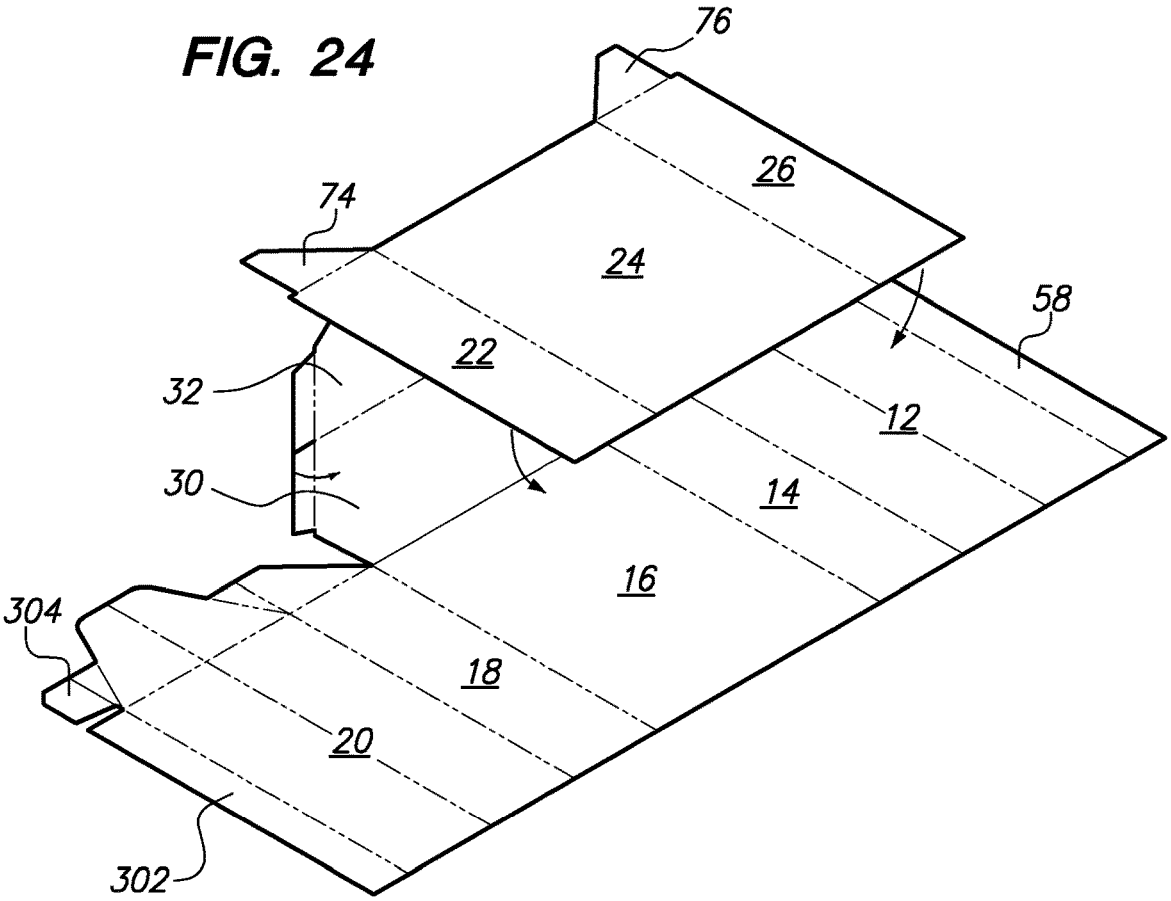
FIG. 24 is a perspective view of the blank of FIG. 23 partially folded along score line 308.
Figure 25:
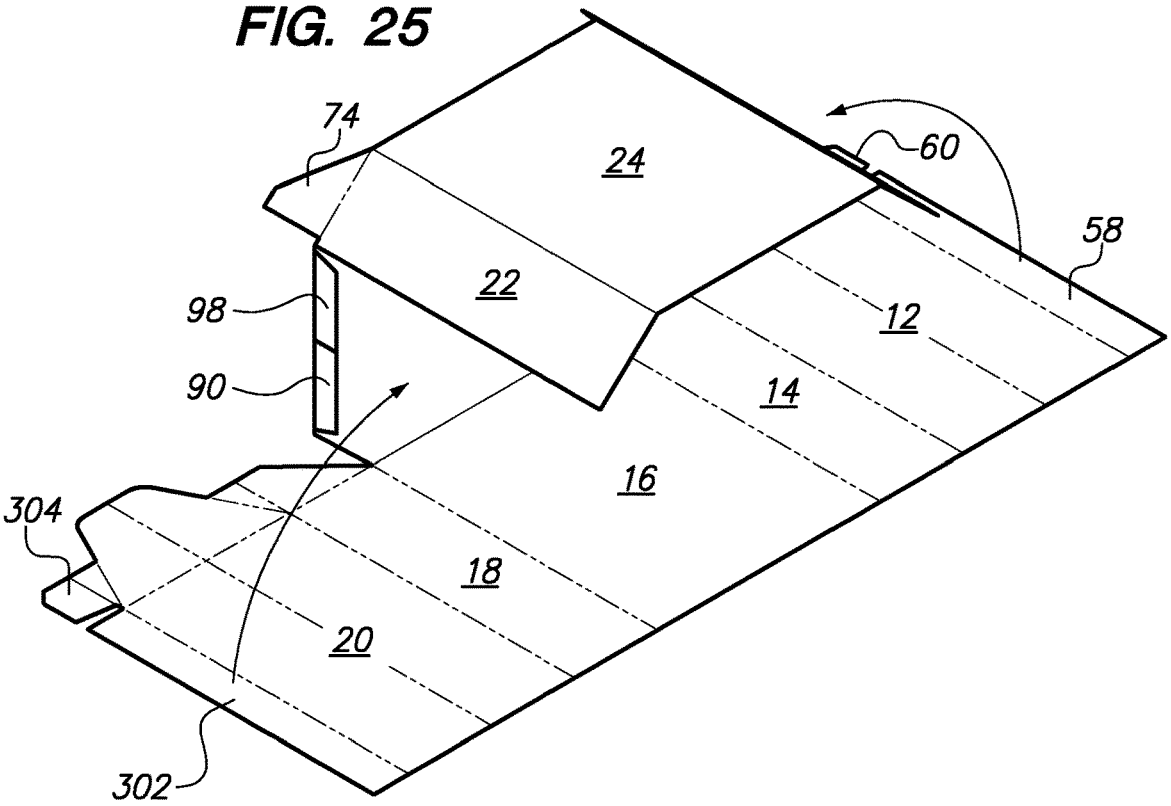
FIG. 25 is a perspective view of the blank of FIG. 24 with the inside flaps folded along score lines 88 and 96.
Figure 26:
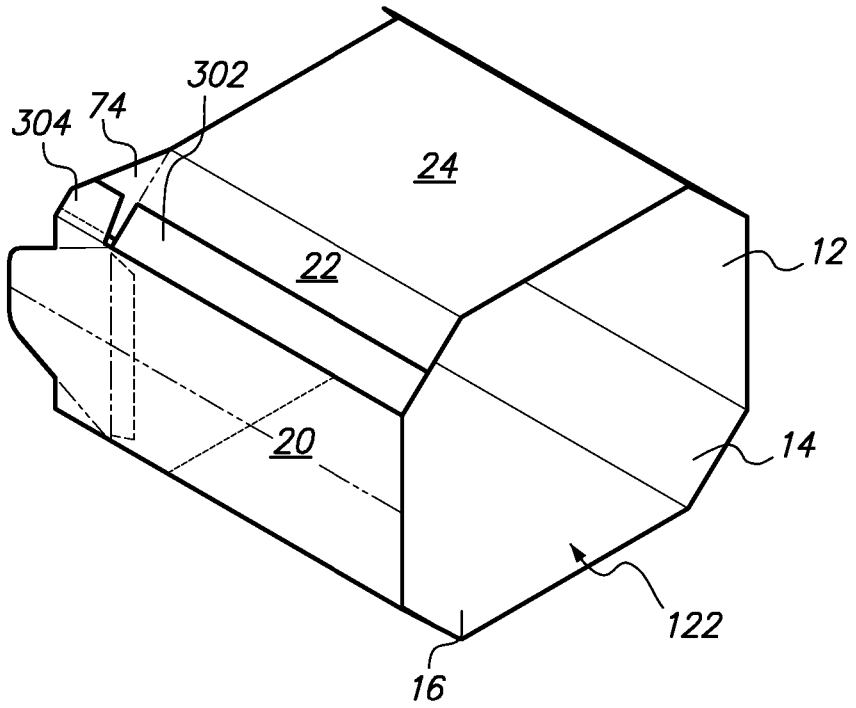
FIG. 26 is a perspective view of the pallet container constructed from the blank of FIG. 21 with glue flap 302 joined to sixth wall 22 and glue flap 304 joined to outside fold 74.
Figure 27:
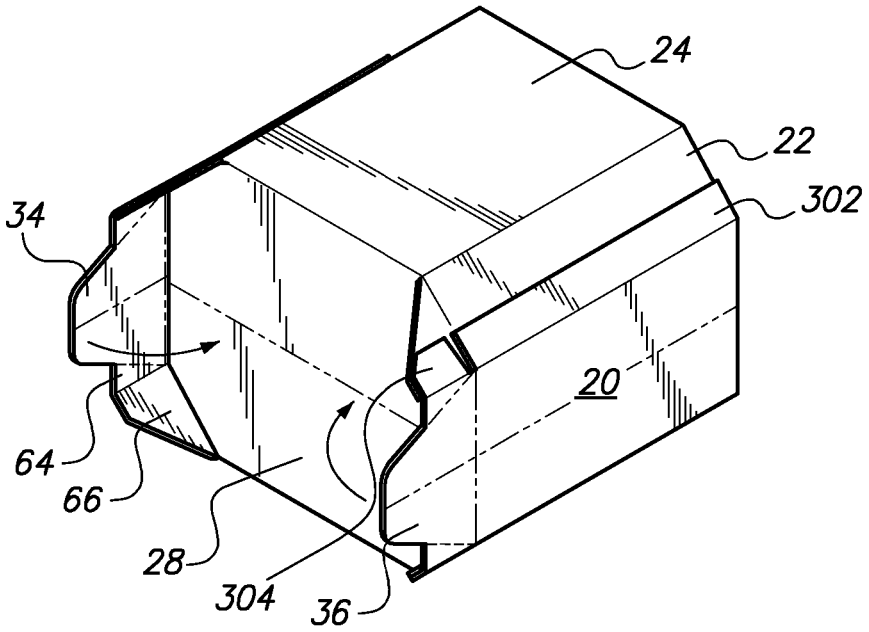
FIG. 27 is a perspective view of the pallet container of FIG. 26 with glue flap 302 joined to sixth wall 22 and glue flap 304 joined to outside fold 74.
Figure 31:
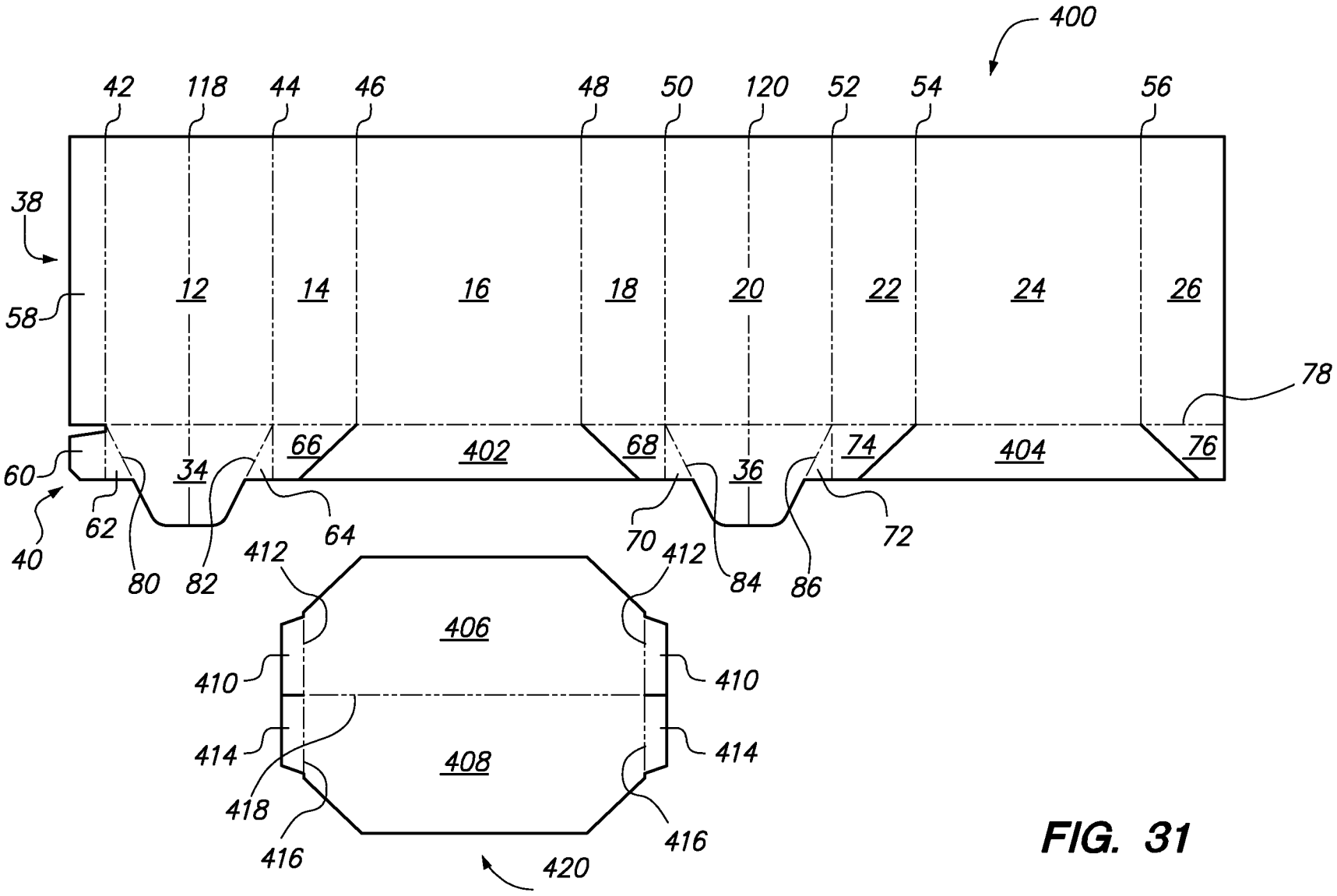
FIG. 31 is a flat plan view of the blanks of the fourth embodiment of the present invention.
Figure 32:
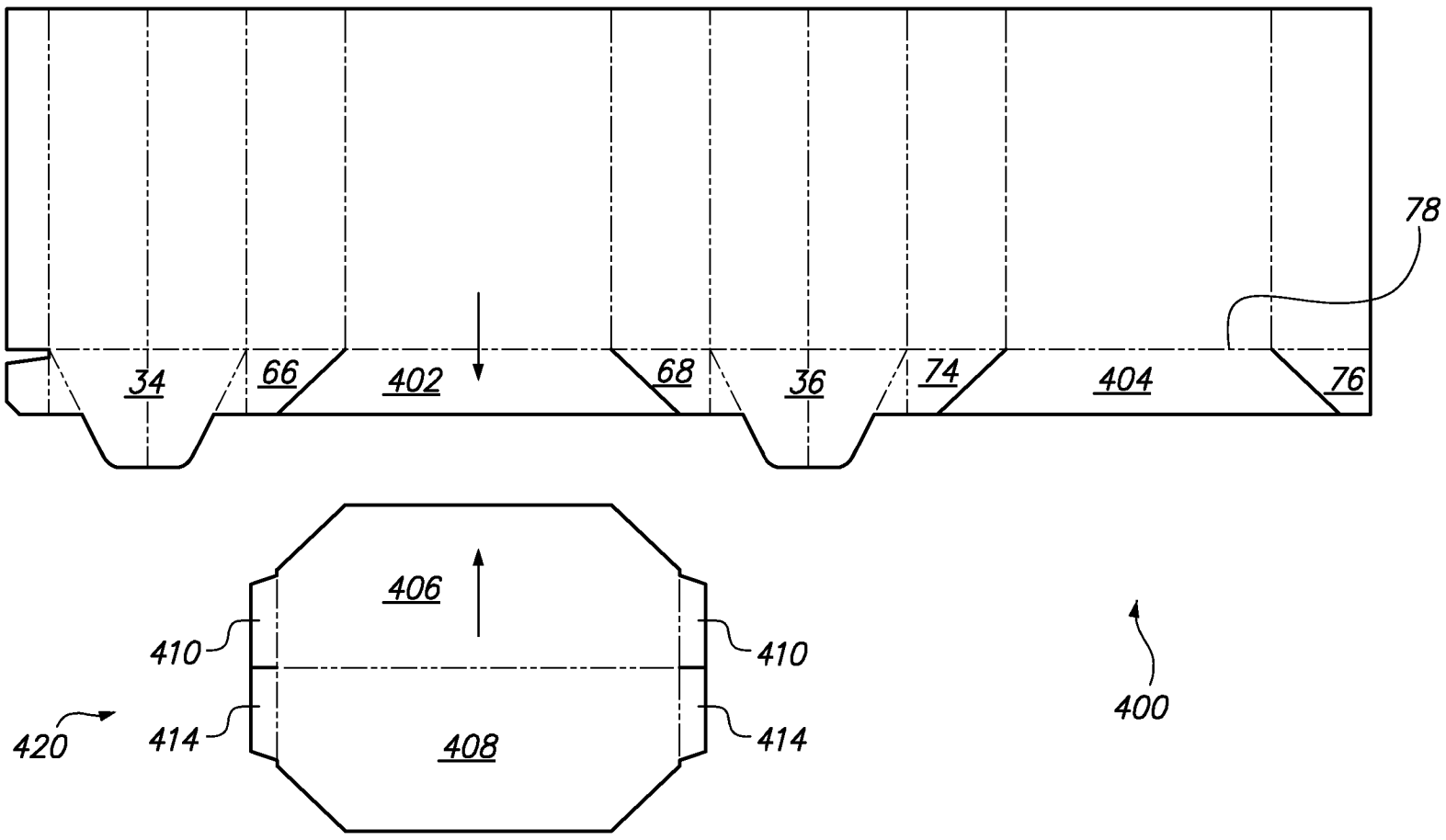
FIG. 32 is a flat plan view of the blanks of FIG. 31.
Figure 33:
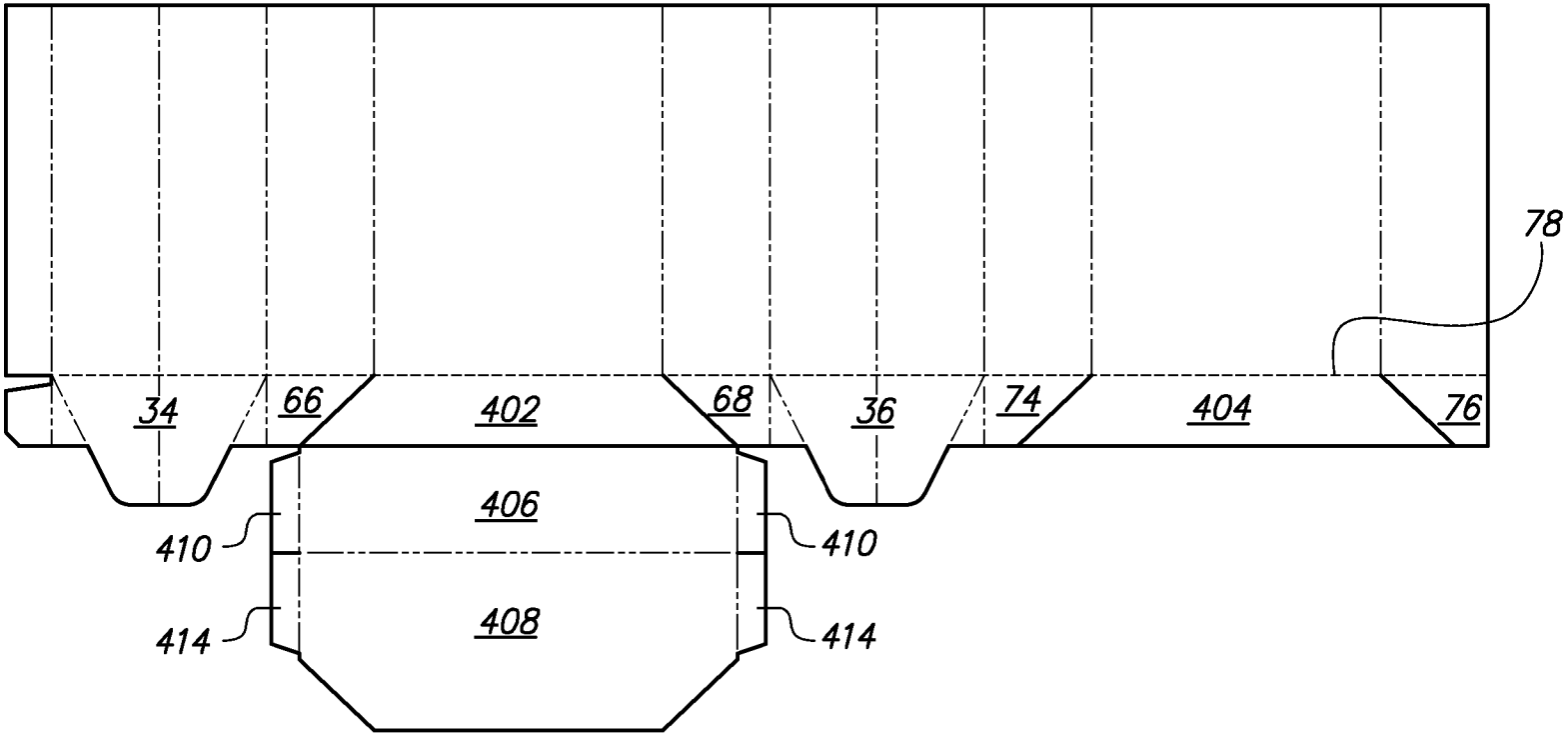
FIG. 33 a flat plan view of blank 400 joined to blank 420.
Figure 34:
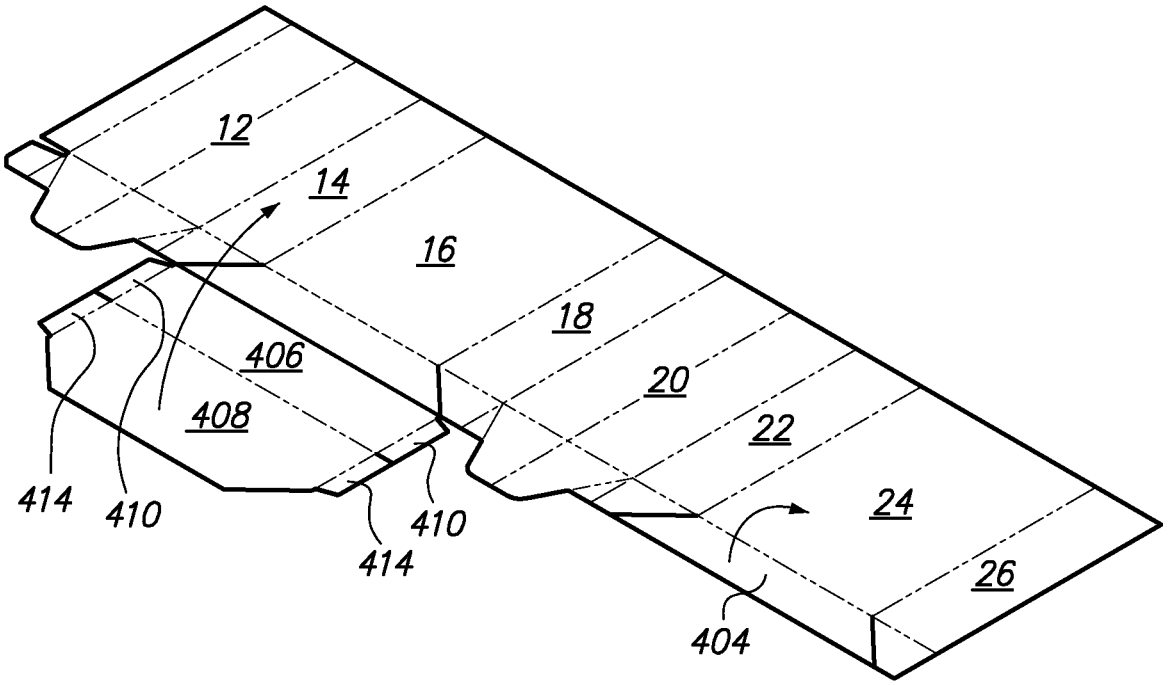
FIG. 34 is a perspective view of blank 400 joined to blank 420.
Figure 35:
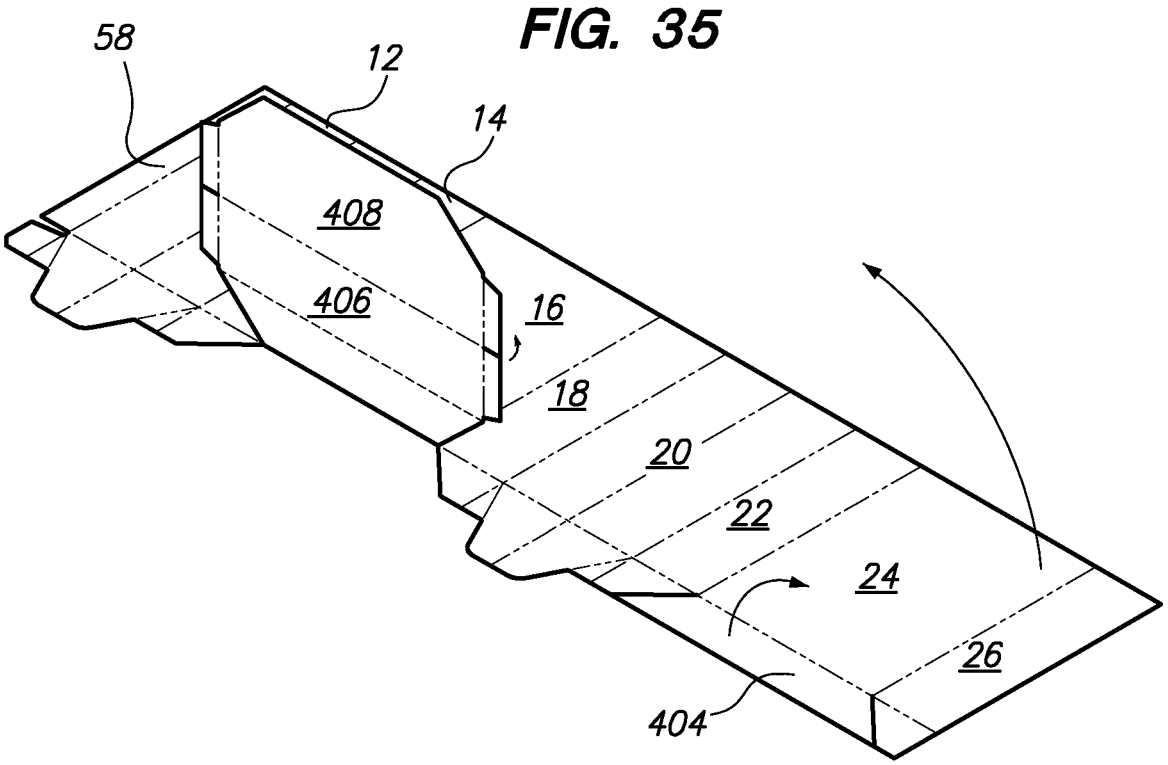
FIG. 35 is a perspective view of the blanks of FIG. 34 partially folded along score line 78.
Figure 36:
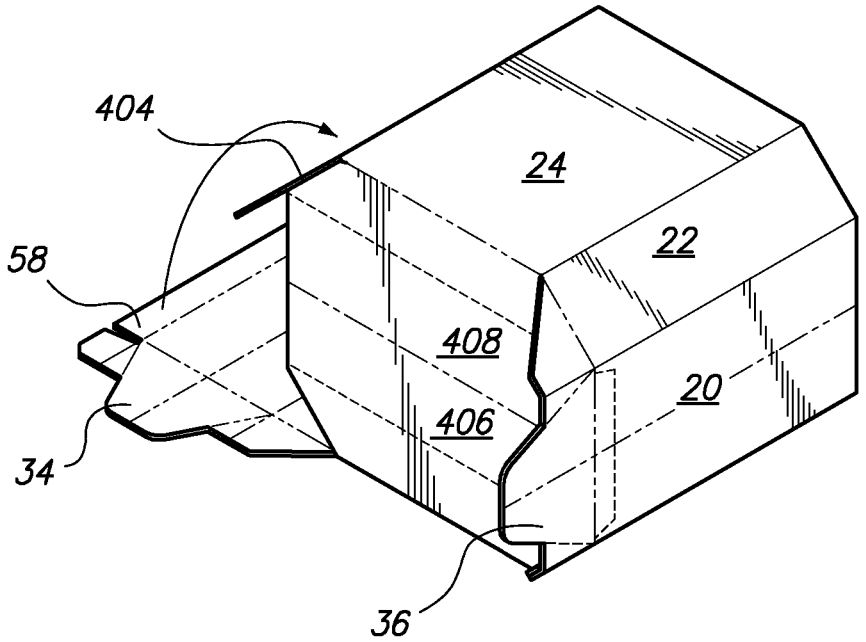
FIG. 36 is a perspective view of the blanks of FIG. 34 partially folded along score lines 48, 50, 52, 54, 56.
Figure 37:
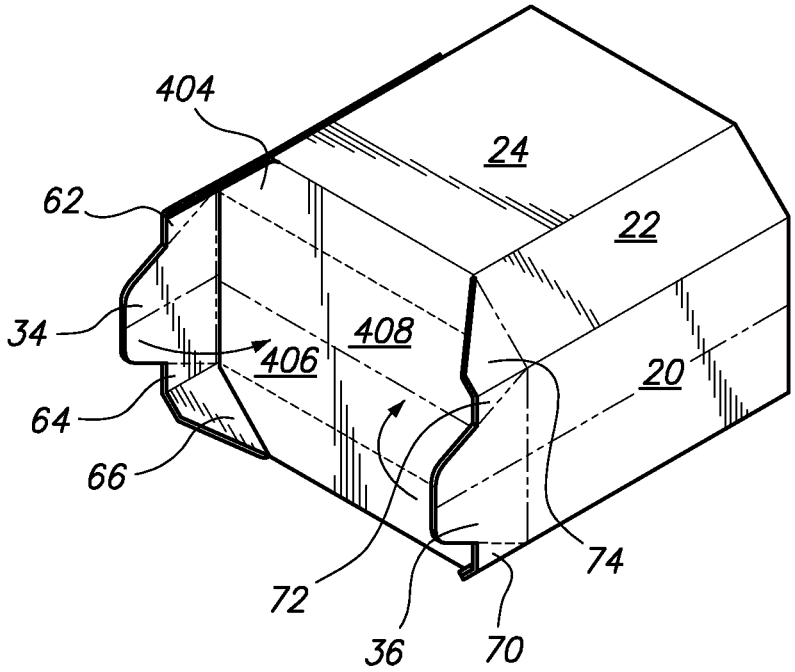
FIG. 37 is a perspective view of the pallet container constructed from the blanks of FIG. 31 with glue flap 58 joined to eighth wall 26 and glue flap 60 joined to outside fold 76.
Figure 38:
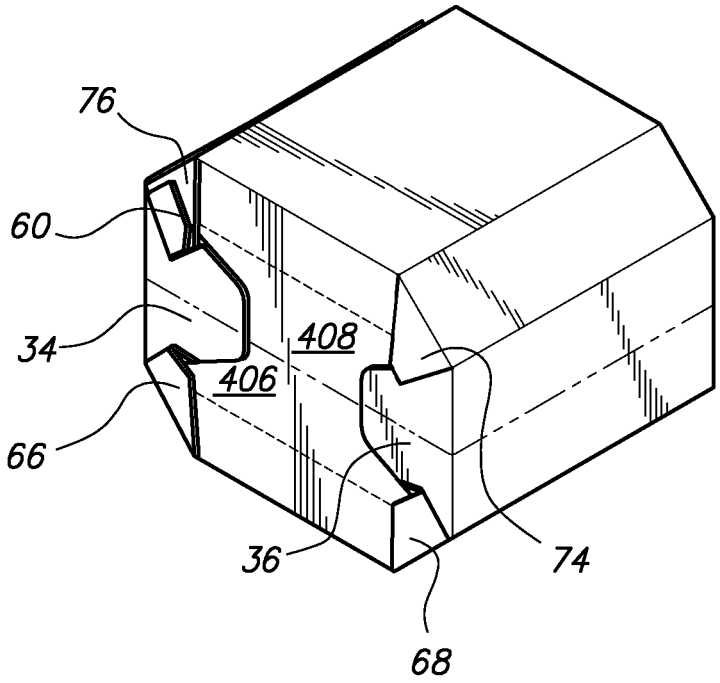
FIG. 38 is a perspective view of the pallet container of FIG. 37 in the deployed position.

The deployment process of converting the container 10 from a flat position (as shown in FIG. 13) to a fully deployed container in the open position (as shown in FIG. 10) comprises two steps. The first step is the top opening process. In the flat position, the container 10 is collapsed on itself. For example, third wall 16 is collapsed on seventh wall 24. Folded between third wall 16 and seventh wall 24 is bottom piece 28. First bottom flap 30 is folded on second bottom flap 32 along score line 92. The first wall 12 and fifth wall 20 are folded in half along score lines 118, 120. To deploy the container from this flat position, the user pushes the first wall 12 and fifth wall 20 towards each other. This action transitions the container 10 into the open position as shown in FIG. 12. An opening 122 in the top end of the container 10 is created by the eight joined walls 12, 14, 16, 18, 20, 22, 24, 26. In addition, the bottom piece 28 unfolds along score line 92.

Figure 11:
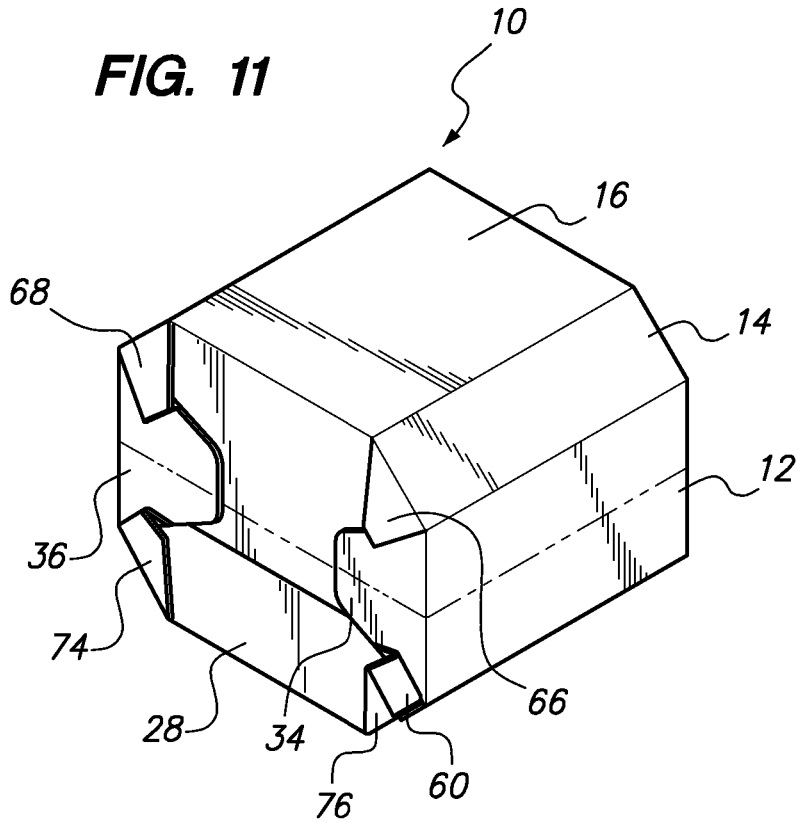
FIG. 11 is a perspective view of the bottom of the pallet container of FIG. 6 in the deployed position.

The second step of the deployment process is the bottom closing process. With the container 10 in the upright position as shown in FIG. 9, the user exerts downward pressure on the first leg flap 34 and the second leg flap 36, preferably in a rocking motion. As pressure is exerted on the first leg flap 34 and the second leg flap 36, the leg flaps 34, 36 fold under the bottom piece of the container 10 along score line 78. During the folding process of first leg flap 34, as shown in FIG. 11, outside fold 76 (connected to glue flap 60) is forced to fold on top of first leg flap 34 along score lines 78, 42, and 80. Thus, inside fold 62 is folded between outside fold 76 and first leg flap 34. Similarly, outside fold 66 is forced to fold on top of first leg flap 34 along score lines 78, 44, and 82. Thus, inside fold 64 is folded between outside fold 66 and the first leg flap 34. During the folding process of second leg flap 36, outside fold 68 is forced to fold on top of second leg flap 36 along score lines 78, 50, and 84. Thus, inside fold 70 is folded between outside fold 68 and second leg flap 36. Similarly, outside fold 74 is forced to fold on top of second leg flap 36 along score lines 78, 52, and 86. Thus, inside fold 72 is folded between outside fold 74 and second leg flap 36. In application, the weight of the load inside the container 10 holds the first leg flap 34 and the second leg flap 36 parallel with bottom piece 28, and thus allows the flaps 34, 36 to serve as reinforcement to the bottom piece 28 of the container.

To convert the container 10 back from the open position to the closed position, first wall 12 and fifth wall 20 are pulled outward and away from one another. This causes the container 10 to collapse along score line 118 and score line 120. The bottom piece 28 also folds inward along score line 92. The deployment and collapsing process can easily be performed by a single person.

In addition to being utilized in the deployment and collapsing processes, score lines 118, 120 provide an advantage over prior art containers by preventing the risk of bulging on all sides of the container 10. By being susceptible to bulging along score lines 118, 120, bulging at the third wall 16 and/or seventh wall 20 is therefore prevented. Maintaining the integrity of third wall 16 and seventh 20 is essential to ensure the most economical packing and transport of the multiple pallets with pallet containers.

In the second preferred embodiment, as shown in FIGS. 14-20, the container 10 is constructed from blank 200. The second embodiment provides for a container 10 with a locking mechanism for first leg flap 34 and second leg flap 36. Blank 200 is identical to blank 100 (described above) except for differences in first bottom flap 30, second bottom flap 32, inside flaps 90, inside flaps 98, and glue flap 94. Whereas in the first embodiment inside flaps 90 are joined along their length to first bottom flap 30, in the second embodiment the inside flaps 90 are notched, thus creating notches 202 between the inside flaps 90 and the first bottom flap 30. The bottom side (free end) of first bottom flap 30 is also double notched, thus creating notches 204 on either side of glue flap 94. Because of the notches 204, the glue flap 94 in this embodiment is preferably only approximately half the length of the free end of the first bottom flap 30.

The inside flaps 98 joined to the second bottom flap 32 are also notched, thus creating notches 206 between the inside flaps 98 and the second bottom flap 32. The bottom side of second bottom flap 32 is also double notched, thus creating notches 208.

As shown in FIGS. 16-20, when the first bottom flap 30 and the second bottom flap 32 are glued together to form bottom piece 28, two bottom slots 210 are formed in the bottom piece 28 which receive the free end of first leg flap 34 and second leg flap 36. Each slot is formed by abutting one notch 204 and one notch 208. The free end of first leg flap 34 and the second leg flap 36 are bent upwardly and tucked into the interior of the container 10 through the two slots 210.

Once the bottom piece 28 is formed, the inside flaps 90, 98 are bent upward along score lines 88, 96 and abut first wall 12 and fifth wall 18 in the interior of the container 10. One notch 204 and one notch 206 abut one another in the interior of the container and form slots 212. Once the free ends of first leg flap 34 and second leg flap 36 are received through slots 210 in the bottom piece 28, the free ends are folded parallel to the interior surface of the bottom piece 28 and are received and secured by slots 212.

In the third preferred embodiment, as shown in FIGS. 21-30, the container 10 is constructed from blank 300. Blank 300 is comprised of first row 38 and second row 40. First row 38 is comprised of a glue flap 58, first wall 12, second wall 14, third wall 16, fourth wall 18, fifth wall 20, and glue flap 302. The glue flap 58, first wall 12, second wall 14, third wall 16, fourth wall 18, fifth wall 20, and glue flap 302 are preferably rectangular in shape. The glue flap 58 is joined to the first wall 12 via a score line 42. Similarly, the first wall 12 is joined to the second wall 14 via score line 44, the second wall 14 to the third wall 16 via score line 46, the third wall 16 to the fourth wall 18 via score line 48, the fourth wall 18 to the fifth wall 20 via score line 50, and the fifth wall to glue flap 302 along score line 310. Unlike the embodiments previously described, fifth wall 20 is joined to a glue flap 302 along score line 310. The first row 38 is joined to the second row 40 along score line 78.

The second row 40 of blank 300 is comprised of glue flap 60, inside fold 62, a first leg flap 34, inside fold 64, outside fold 66, first bottom flap 30, outside fold 68, inside fold 70, second leg flap 36, inside fold 72, and a glue flap 304. The glue flap 60 is joined to the inside fold 62 along score line 42. First leg flap 34 is joined to inside fold 62 along score line 80 on one side and joined to inside fold 64 along score line 82 on the other side. Inside fold 64 is joined to outside fold 66 along score line 44. First bottom flap 30 abuts, but is not joined to, the outside fold 66 on one side and the outside fold 68 on the other side. The outside fold 68 is joined to the inside fold 70 along score line 50. The second leg flap 36 is joined to inside fold 70 along score line 84 on one side and to inside fold 72 along score line 86 on the other side. Glue flap 304 is joined to inside fold 72 along score line 310.

The first bottom flap 30 is joined to the second bottom flap 32 along score line 306, thus forming bottom piece 28. The first bottom flap 30 and second bottom flap 32 are preferably in the shape of a pentagon. The first bottom flap 30 and second bottom flap 32 are joined along their longest sides. The third wall 16 is joined to the first bottom flap 30 at its opposite end along score line 78, while the seventh wall 24 is joined to second bottom flap 32 at its opposite end along score line 308. Joined to the two parallel sides of the first bottom flap 30 via score lines 88 are inside flaps 90. Joined to the two parallel sides of the second bottom flap 32 via score lines 96 are inside flaps 98. Sixth wall 22 is joined to seventh wall 24 on one of its sides along score line 54. Seventh wall 24 is joined to eighth wall 26 on one of its opposite side along score line 56.

As shown in FIGS. 22-30, to construct the pallet container 10 from blank 300, the first row 38 is folded along score line 78 forming a 90 degree angle with first bottom flap 30. The glue flap 58, first wall 12, second wall 14, third wall 16, fourth wall 18, fifth wall 20, and glue flap 302 are bent inward along score lines 42, 44, 46, 48, 50, and 310. Similarly, the sixth wall 22, seventh wall 24, and eighth wall 26 are folded along score line 308 forming a 90 degree angle with second bottom flap 32. The sixth wall 22, seventh wall 24, and eight wall 26 are bent towards the first row 38 along score lines 54, 56. To create the opening 122 of the container 10, glue flap 302 is attached lengthwise to sixth wall 22, glue flap 304 is attached to outside fold 74, glue flap 58 is attached to eighth wall 26, and glue flap 60 is attached to outside fold 76. The bottom piece 28 of the container 10 is capable of folding inward along score line 306. Thus in the flat position, the first bottom flap 30 is folded between third wall 16 and second bottom flap 32, while the second bottom flap 32 is folded between first bottom flap 30 and seventh wall 24.

The deployment and collapsing process of the container 10 constructed from blank 300 is the same as previously described.

In the fourth preferred embodiment, as shown in FIGS. 31-38, the container 10 is constructed from blank 400 and blank 420. Blank 400 has a first row 38 and a second row 40. The first row 38 is comprised of a glue flap 58, a first wall 12, a second wall 14, a third wall 16, a fourth wall 18, a fifth wall 20, a sixth wall 22, a seventh wall 24, and an eighth wall 26. The glue flap 58, first wall 12, second wall 14, third wall 16, fourth wall 18, fifth wall 20, sixth wall 22, seventh wall 24, and eighth wall 26 are all preferably rectangular in shape. The glue flap 58 is joined to the first wall 12 via a score line 42. Similarly, the first wall 12 is joined to the second wall 14 via score line 44, the second wall 14 to the third wall 16 via score line 46, the third wall 16 to the fourth wall 18 via score line 48, the fourth wall 18 to the fifth wall 20 via score line 50, the fifth wall 20 to the sixth wall 22 via score line 52, the sixth wall 22 to the seventh wall 24 via score line 54, and the seventh wall 24 to the eighth wall 26 via score line 56.

The first row 38 is joined to the second row 40 along score line 78. The second row 40 of blank 400 is comprised of a glue flap 60, an inside fold 62, a first leg flap 34, an inside fold 64, an outside fold 66, a first bottom glue flap 402, an outside fold 68, an inside fold 70, a second leg flap 36, an inside fold 72, an outside fold 74, a second bottom glue flap 404, and an outside fold 76.

The glue flap 60 is joined to the inside fold 62 along score line 42. First leg flap 34 is joined to inside fold 62 along score line 80 on one side and joined to inside fold 64 along score line 82 on the other side. Inside fold 64 is joined to outside fold 66 along score line 44. First bottom glue flap 402 abuts, but is not joined to, the outside fold 66 on one side and the outside fold 68 on the other side. The outside fold 68 is joined to the inside fold 70 along score line 50. The second leg flap 36 is joined to inside fold 70 along score line 84 on one side and to inside fold 72 along score line 86 on the other side. Inside fold 72 is joined to outside fold 74 along score line 52. Second bottom glue flap 404 abuts, but is not joined to, the outside fold 74 on one side and the outside fold 76 on the other side. The inside folds 62, 64, 70, 72 are triangular-shaped, preferably in the shape of a right triangle.

The first bottom glue flap 402 and second bottom glue flap 404 are preferably in the shape of an isosceles trapezoid (i.e. trapezoid with two non-parallel sides the same length). The top side of the glue flaps 402, 404 is along score line 78. The bottom side (free end) of the flaps 402, 404 is parallel to the top side.

Blank 420 is comprised of a first bottom section 406 and a second bottom section 408. The bottom sections 406, 408 are preferably in the shape of pentagon and are joined to one another along score line 418. Joined to the two parallel sides of the first bottom section 406 via score lines 412 are inside flaps 410. Joined to the two parallel sides of the second bottom section 408 via score lines 416 are inside flaps 414.

As shown in FIGS. 31-38, to form the container 10, blank 420 is attached to blank 400. Second blank 420 forms the bottom piece 28 of the container 10.

First bottom section 406 is preferably glued to the bottom surface of first bottom glue flap 402, while second bottom section 408 is preferably glued to the bottom surface of second bottom glue flap 404. To construct the top piece of pallet container 10 from the blank 400 of the fourth embodiment, the eight walls are folded inward along the score lines 42, 44, 46, 48, 50, 52, 54, 56 of the first row 38. Glue flap 58 is attached to eighth wall 26 to form the octagon opening 122 of the container 10. Glue flap 58 is preferably glued to the exterior surface of the eighth wall. Glue flap 60 of the second row 40 of the blank 100 is similarly attached to the outside fold 76. When glue flaps 58, 60 are attached to the eighth wall 26, score line 42 is aligned with side edge of the eighth wall 26.

When the container is the open position, the inside flaps 410, 414 are bent upward along score lines 412, 416 and abut first wall 12 and fifth wall 18 in the interior of the container 10. The inside flaps 410, 414 serve to seal the interior of the container 10.

The deployment and collapsing process of the container 10 constructed from blanks 400, 420 is the same as previously described.

Figure 39:
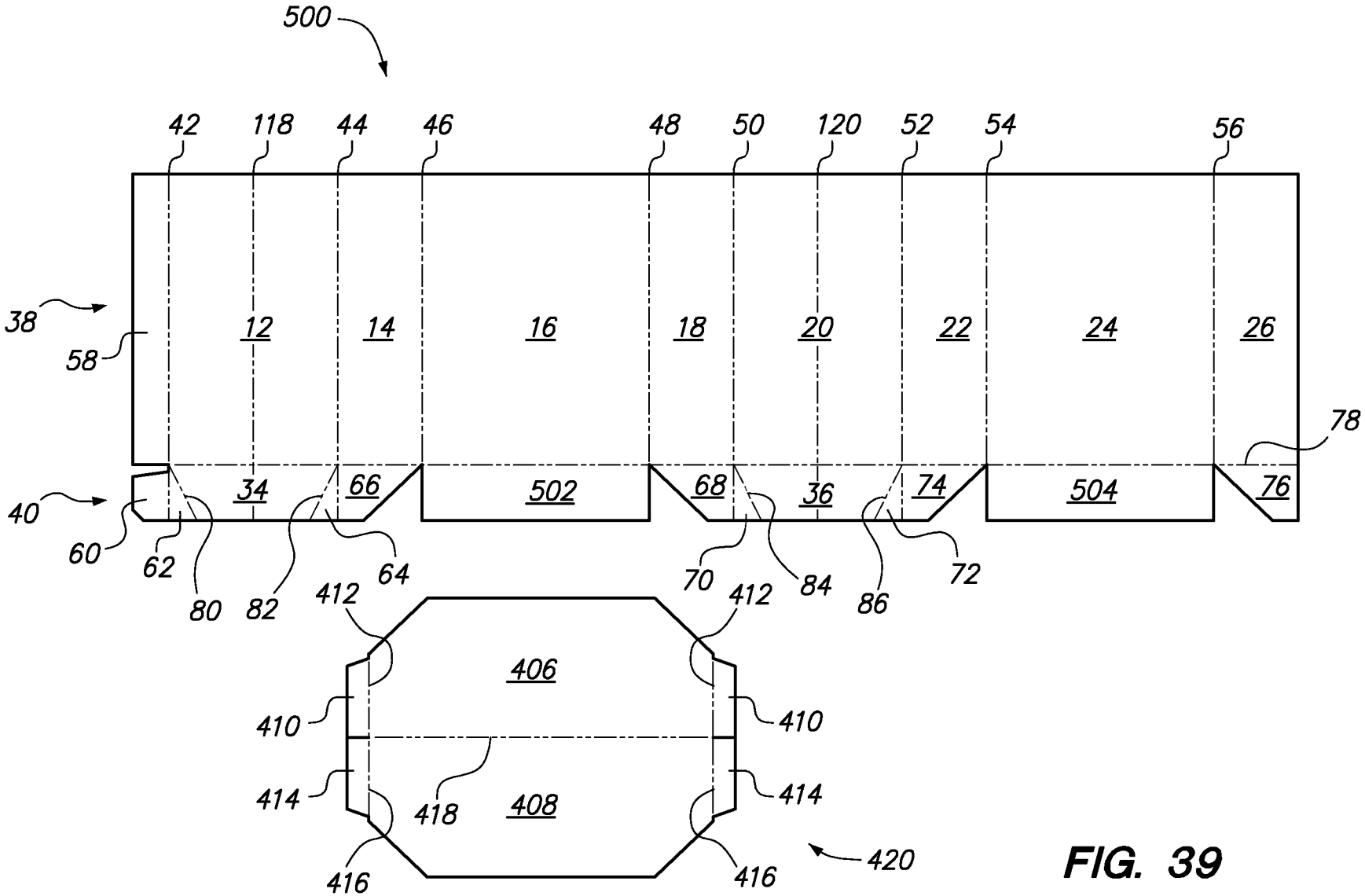
FIG. 39 is a flat plan view of the blanks of the fifth embodiment of the present invention.
Figure 40:
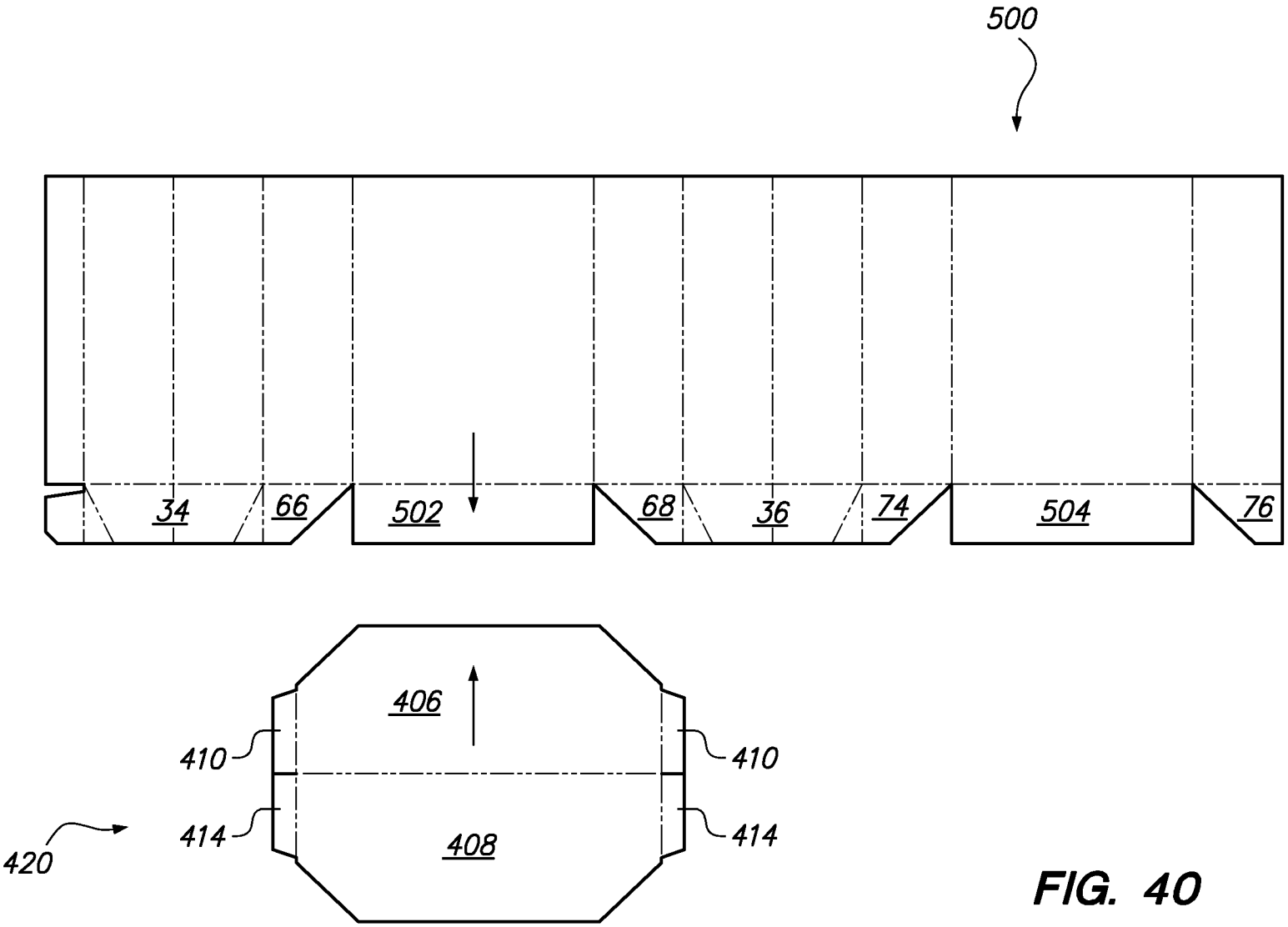
FIG. 40 is a flat plan view of the blanks of FIG. 39.
Figure 41:
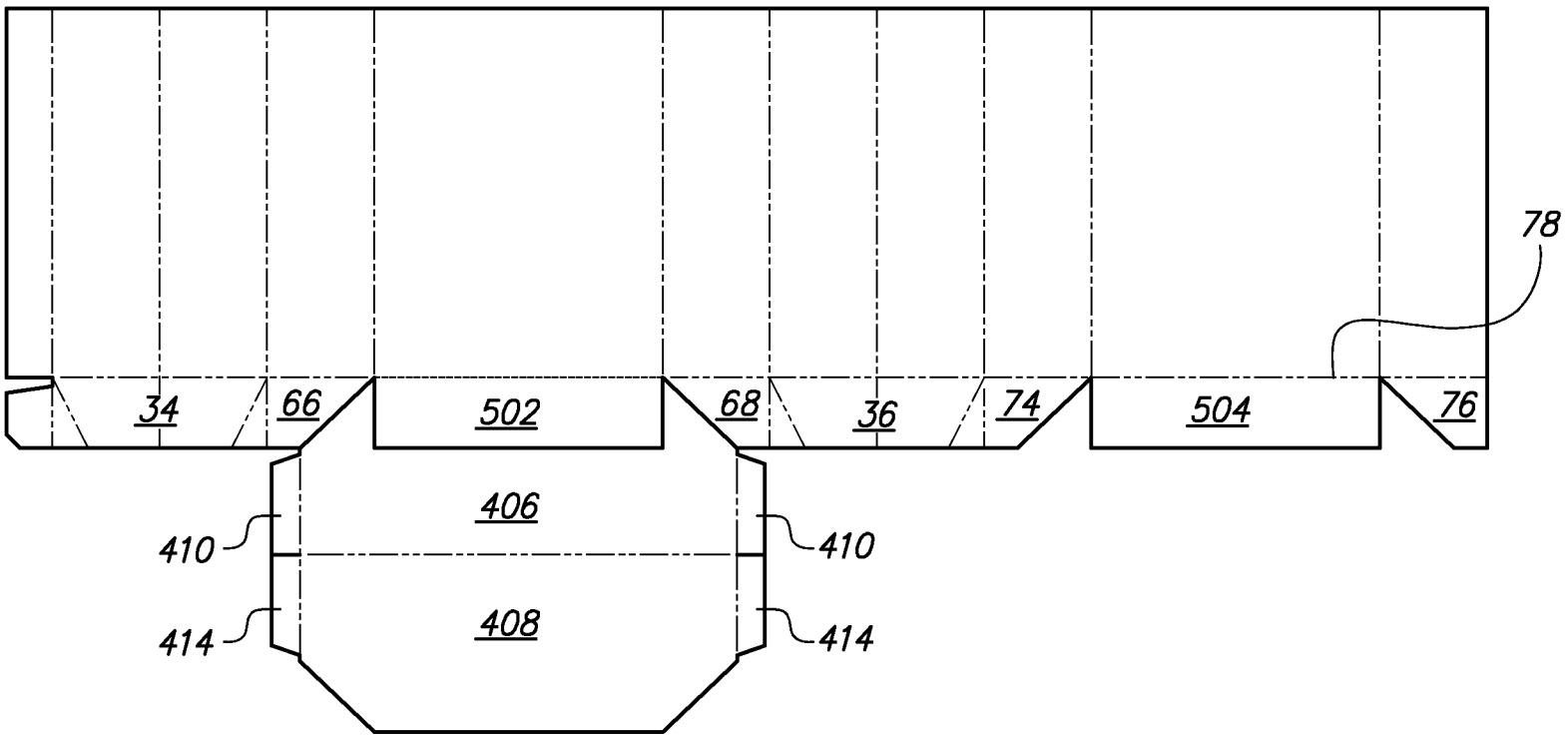
FIG. 41 is a flat plan view of blank 500 joined to blank 420.

In the fifth preferred embodiment, as shown in FIGS. 39-41, the container 10 is constructed from blank 500 and blank 420. Blank 500 has a first row 38 and a second row 40. The first row 38 is comprised of a glue flap 58, a first wall 12, a second wall 14, a third wall 16, a fourth wall 18, a fifth wall 20, a sixth wall 22, a seventh wall 24, and an eighth wall 26. The glue flap 58, first wall 12, second wall 14, third wall 16, fourth wall 18, fifth wall 20, sixth wall 22, seventh wall 24, and eighth wall 26 are all preferably rectangular in shape. The glue flap 58 is joined to the first wall 12 via a score line 42. Similarly, the first wall 12 is joined to the second wall 14 via score line 44, the second wall 14 to the third wall 16 via score line 46, the third wall 16 to the fourth wall 18 via score line 48, the fourth wall 18 to the fifth wall 20 via score line 50, the fifth wall 20 to the sixth wall 22 via score line 52, the sixth wall 22 to the seventh wall 24 via score line 54, and the seventh wall 24 to the eighth wall 26 via score line 56.

The first row 38 is joined to the second row 40 along score line 78. The second row 40 of blank 500 is comprised of a glue flap 60, an inside fold 62, a first leg flap 34, an inside fold 64, an outside fold 66, a first bottom glue flap 502, an outside fold 68, an inside fold 70, a second leg flap 36, an inside fold 72, an outside fold 74, a second bottom glue flap 504, and an outside fold 76. Unlike previously described embodiments, the first leg flap 34 and second leg flap 36 do not have a free end.

The glue flap 60 is joined to the inside fold 62 along score line 42. First leg flap 34 is joined to inside fold 62 along score line 80 on one side and joined to inside fold 64 along score line 82 on the other side. Inside fold 64 is joined to outside fold 66 along score line 44. The outside fold 68 is joined to the inside fold 70 along score line 50. The second leg flap 36 is joined to inside fold 70 along score line 84 on one side and to inside fold 72 along score line 86 on the other side. Inside fold 72 is joined to outside fold 74 along score line 52. The inside folds 62, 64, 70, 72 are triangular-shaped, preferably in the shape of a right triangle.

The first bottom glue flap 502 and second bottom glue flap 504 are preferably in the shape of a rectangle. Thus, first flap 502 does not abut outside fold 66 or outside fold 68. Likewise, second flap 504 does not abut outside fold 74 or outside fold 76. The top side of the flaps 502, 504 is along score line 78. The bottom side (free end) of the flaps 502, 504 is parallel to the top side.

Blank 420 is comprised of a first bottom section 406 and a second bottom section 408. The bottom sections 406, 408 are preferably in the shape of pentagon and are joined to one another along score line 418. Joined to the two parallel sides of the first bottom section 406 via score lines 412 are inside flaps 410. Joined to the two parallel sides of the second bottom flap 408 via score lines 416 are inside flaps 414.

As shown in FIGS. 39-41, to form the container 10, blank 420 is attached to blank 500. Second blank 420 forms the bottom piece 28 of the container 10. First bottom section 406 is preferably glued to the bottom surface of first bottom glue flap 502, while second bottom section 408 is preferably glued to the bottom surface of second bottom glue flap 504. To construct the top piece of pallet container 10 from the blank 500 of the fifth embodiment, the eight walls are folded inward along the score lines 42, 44, 46, 48, 50, 52, 54, 56 of the first row 38. Glue flap 58 is attached to eighth wall 26 to form the octagon opening 122 of the container 10. Glue flap 58 is preferably glued to the exterior surface of the eighth wall. Glue flap 60 of the second row 40 of the blank 500 is similarly attached to the outside fold 76. When glue flaps 58, 60 are attached to the eighth wall 26, score line 42 is aligned with side edge of the eighth wall 26.

When the container is the open position, the inside flaps 410, 414 are bent upward along score lines 412, 416 and abut first wall 12 and fifth wall 18 in the interior of the container 10. The inside flaps 410, 414 serve to seal the interior of the container 10.

The deployment and collapsing process of the container 10 constructed from blanks 500, 420 is the same as previously described.

Figure 42:
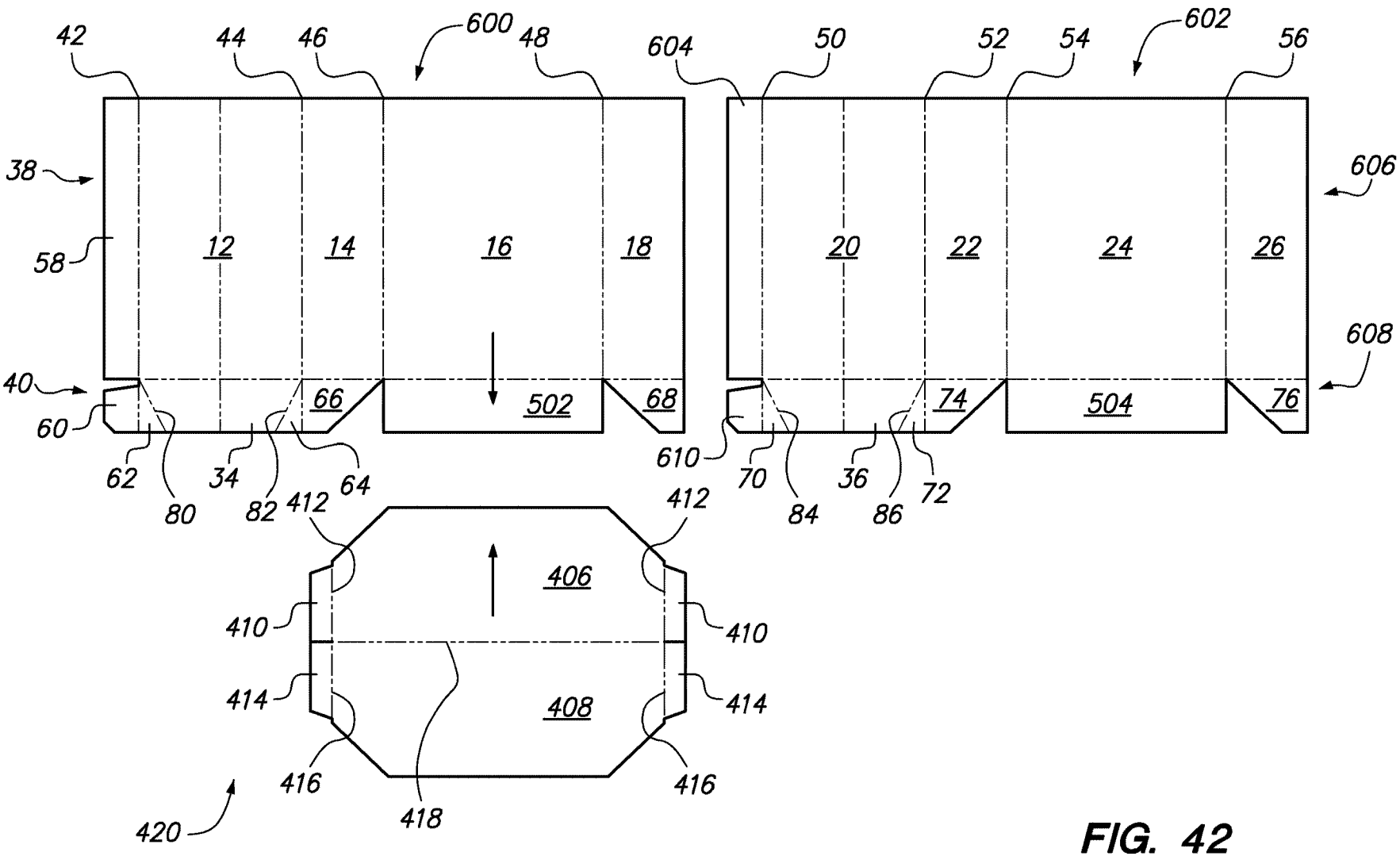
FIG. 42 is a flat plan view of the blanks of the sixth embodiment of the present invention.
Figure 43:
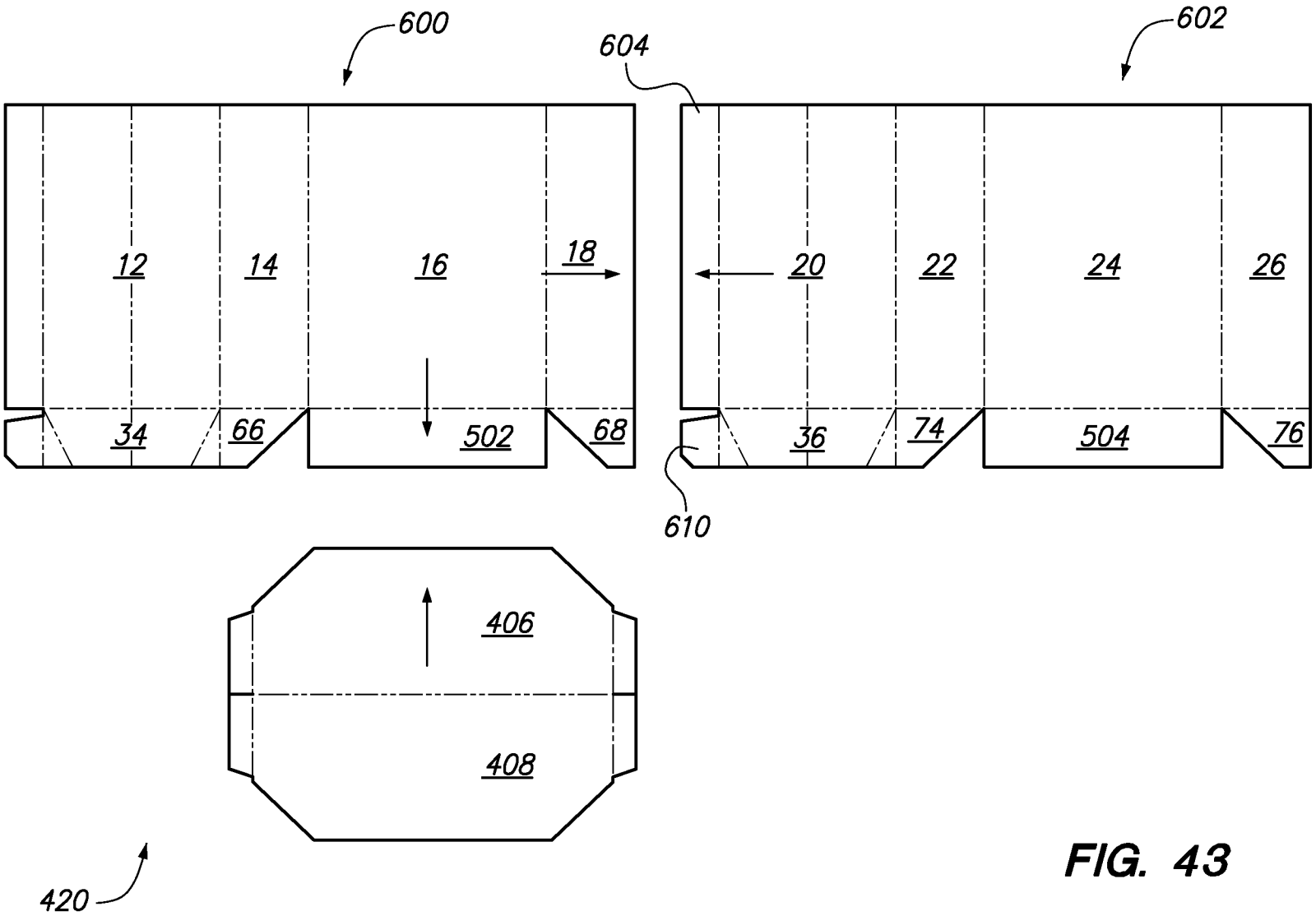
FIG. 43 is a flat plan view of the blanks of FIG. 42.
Figure 44:
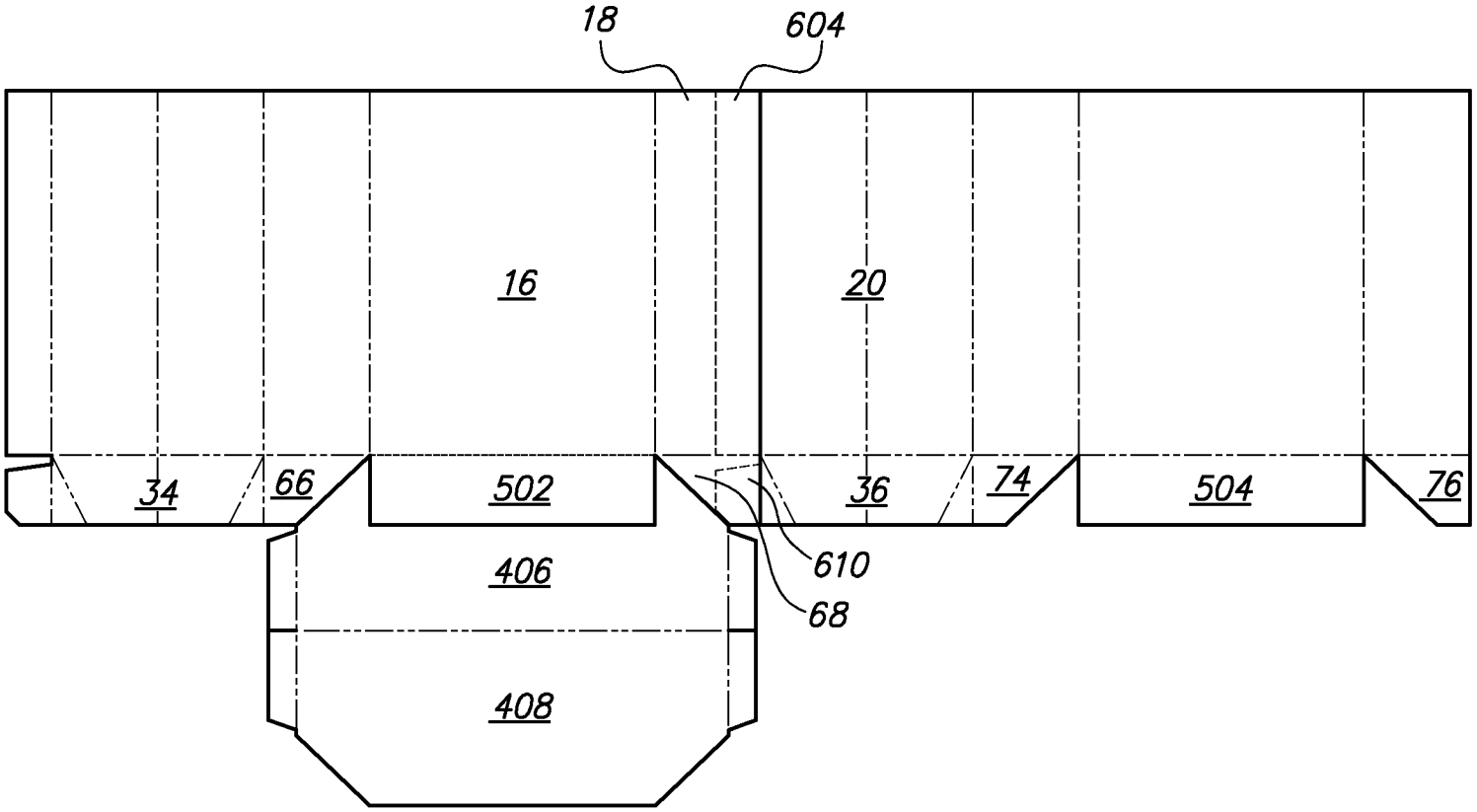
FIG. 44 is a flat plan view of blank 600 joined to blank 602 and blank 420 joined to blank 600.
Figure 45:
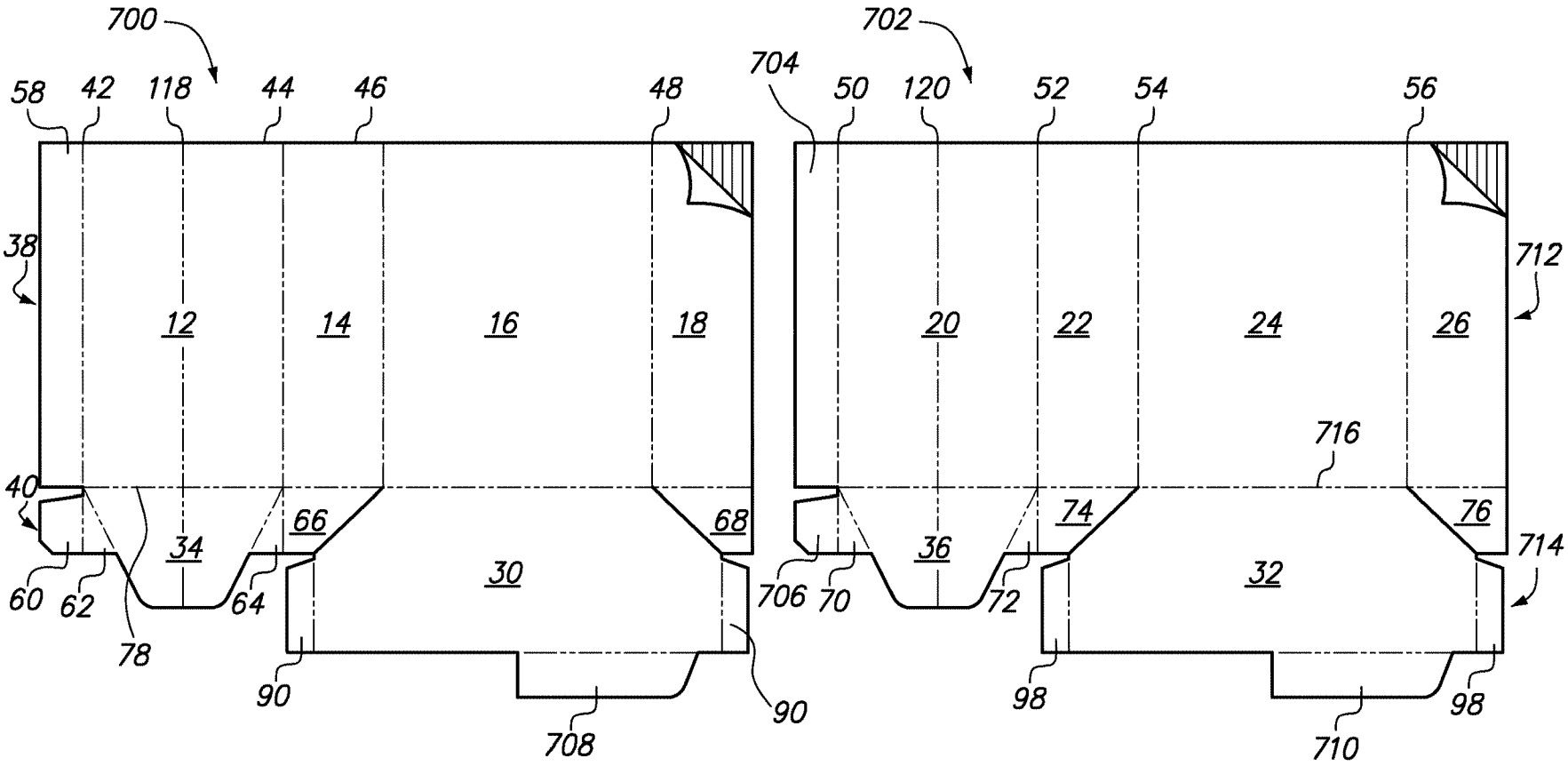
FIG. 45 is a flat plan view of the blanks of the sixth embodiment of the present invention.
Figure 46:
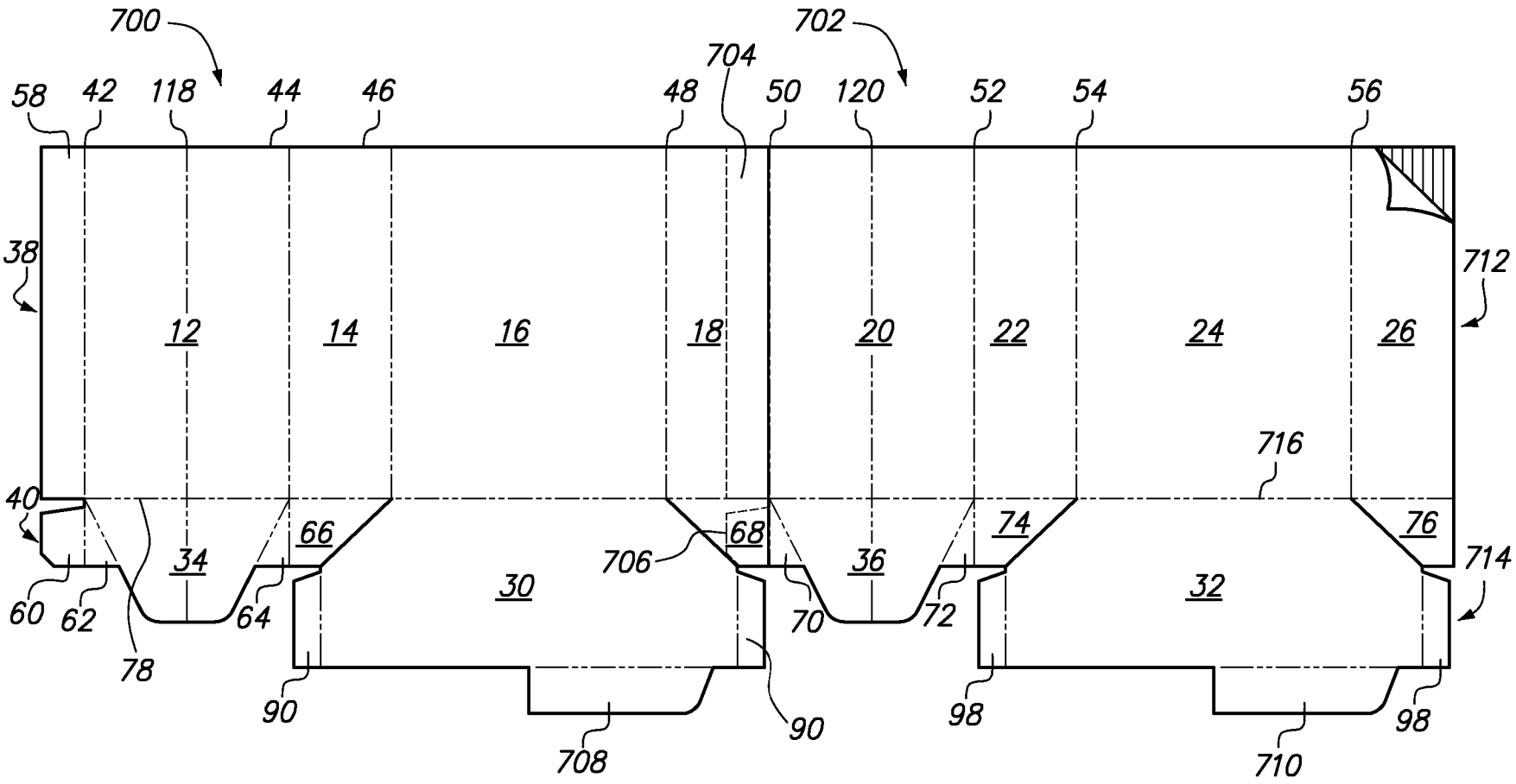
FIG. 46 is a flat plan view of blank 700 joined to blank 720.
Figure 47:
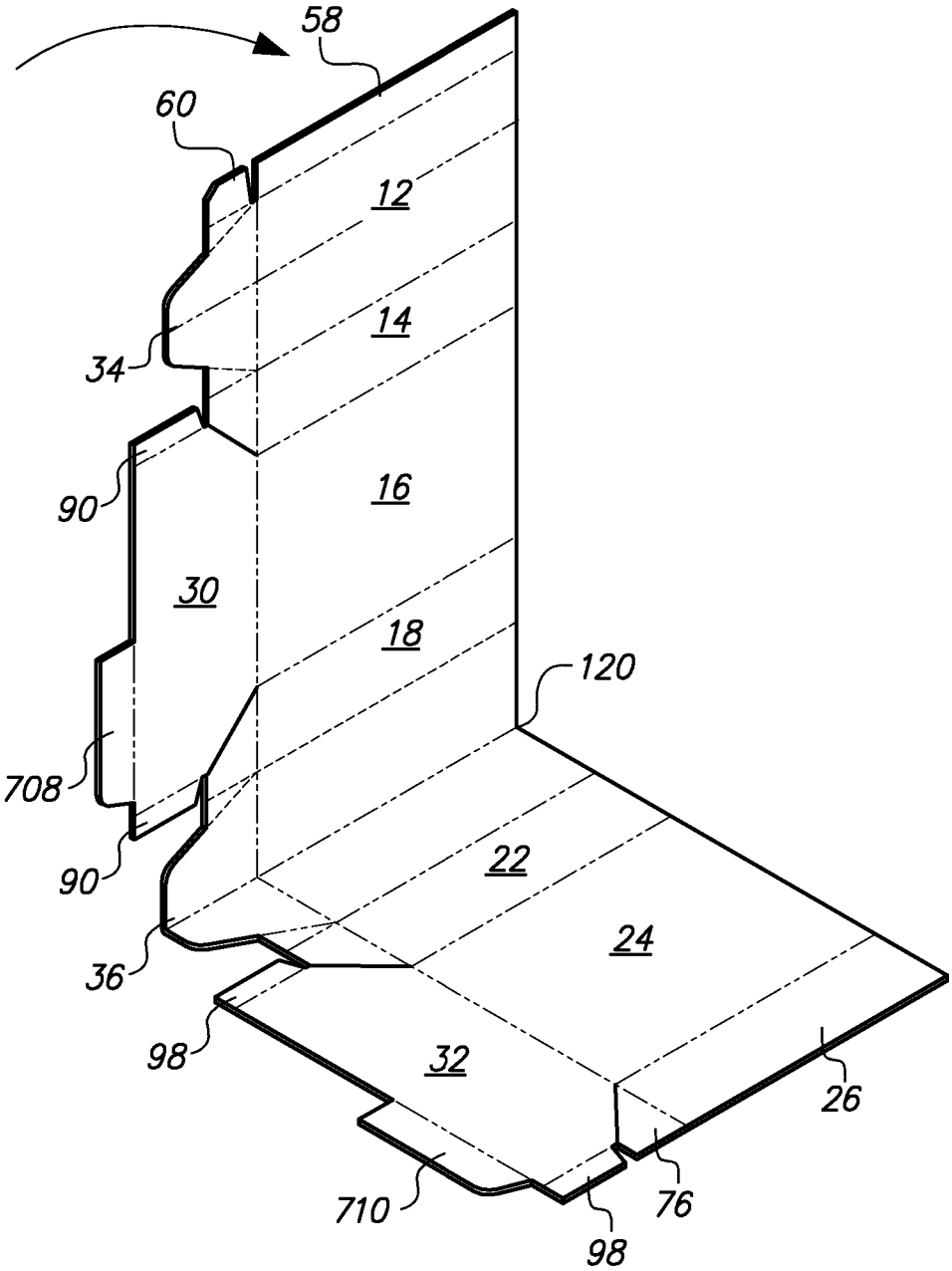
FIG. 47 is a perspective view of the blanks of FIG. 46 partially folded along score line 120.
Figure 48:
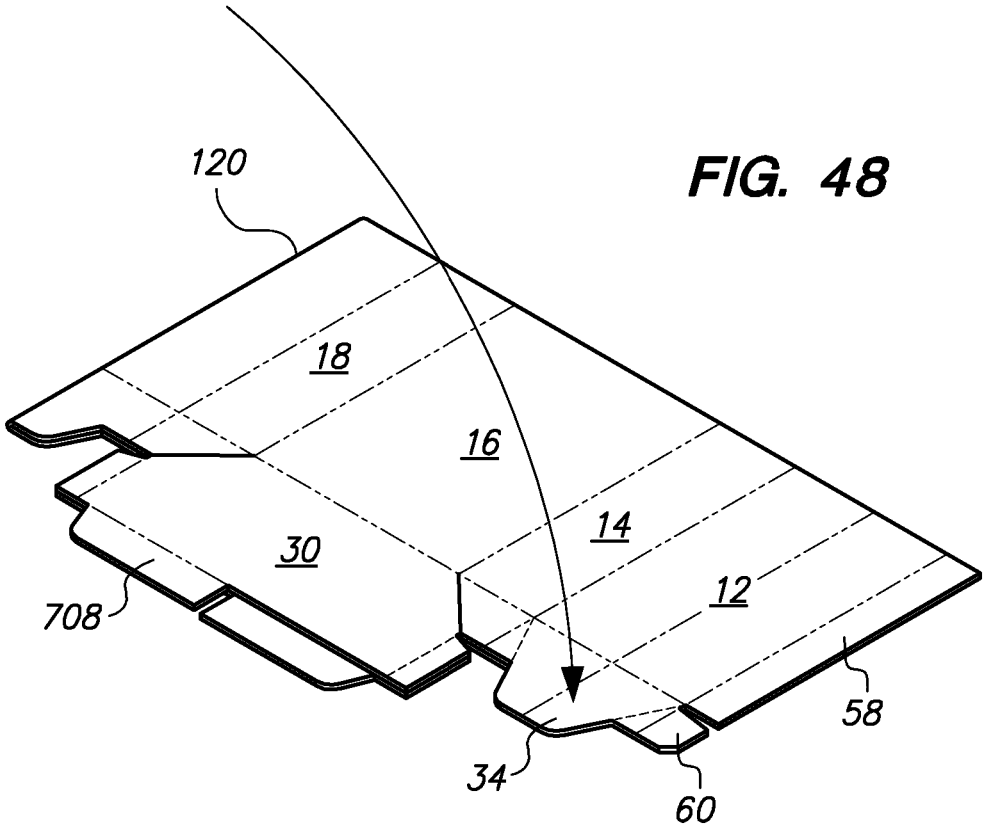
FIG. 48 is a perspective view of the blanks of FIG. 46 completely folded along score line 120.
Figure 49:
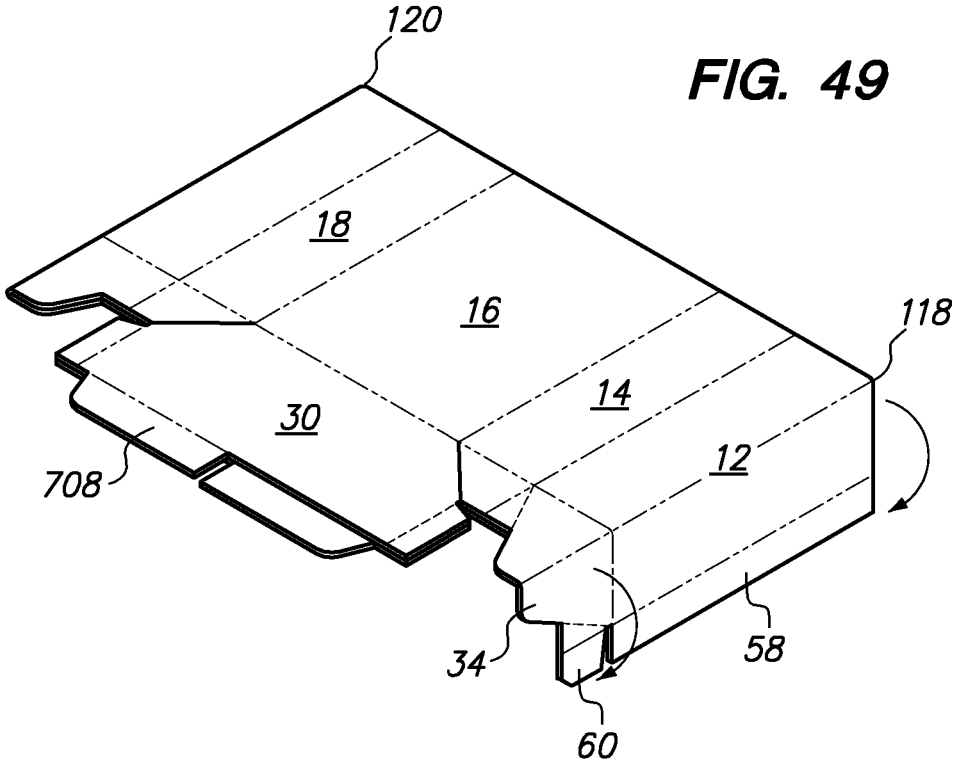
FIG. 49 is a perspective view of the blank of FIG. 46 partially folded along score line 118.
Figure 50:
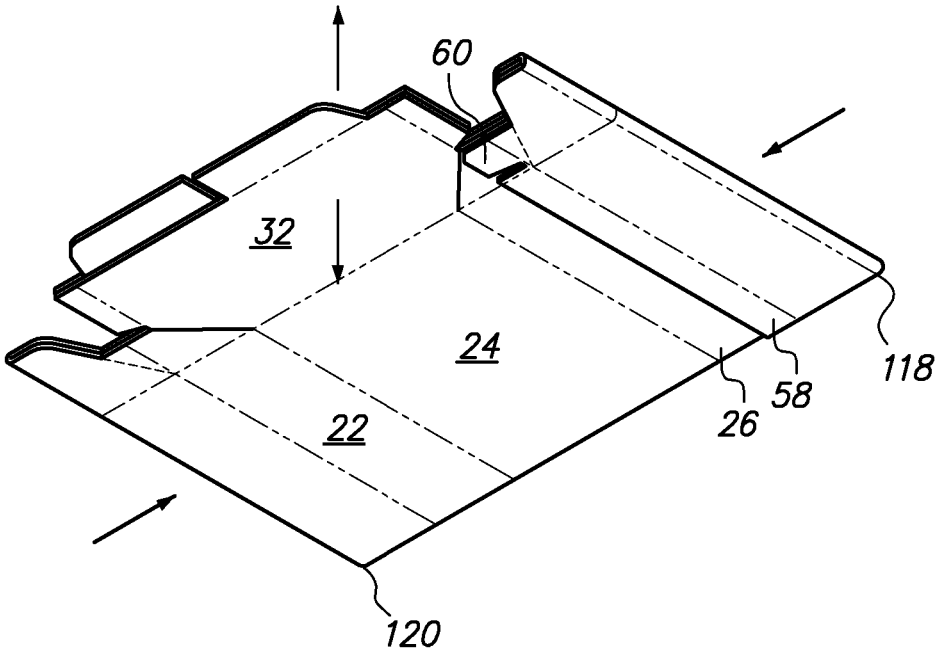
FIG. 50 is a perspective view of the blanks of FIG. 49 with glue flap 58 joined to eighth wall 26 and glue flap 60 joined to outside fold 76.
Figure 51:
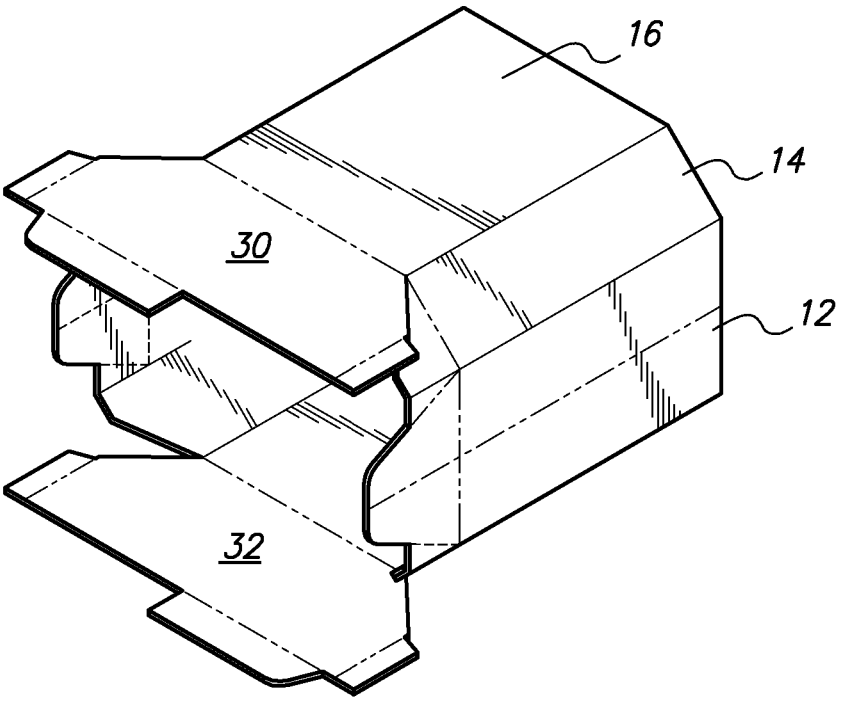
FIG. 51 is a perspective view of the pallet container constructed from the blanks of FIG. 43 with the top of the container in the open position.
Figure 52:
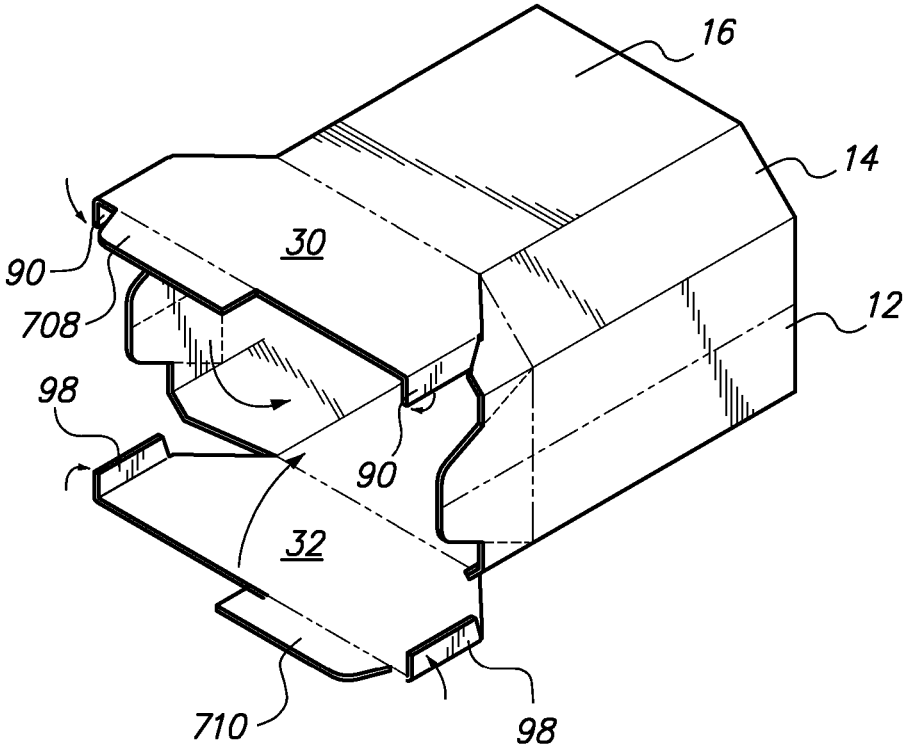
FIG. 52 is a perspective view of the pallet container of FIG. 51 with the inside flaps folded along score lines 88 and 96.
Figure 53:
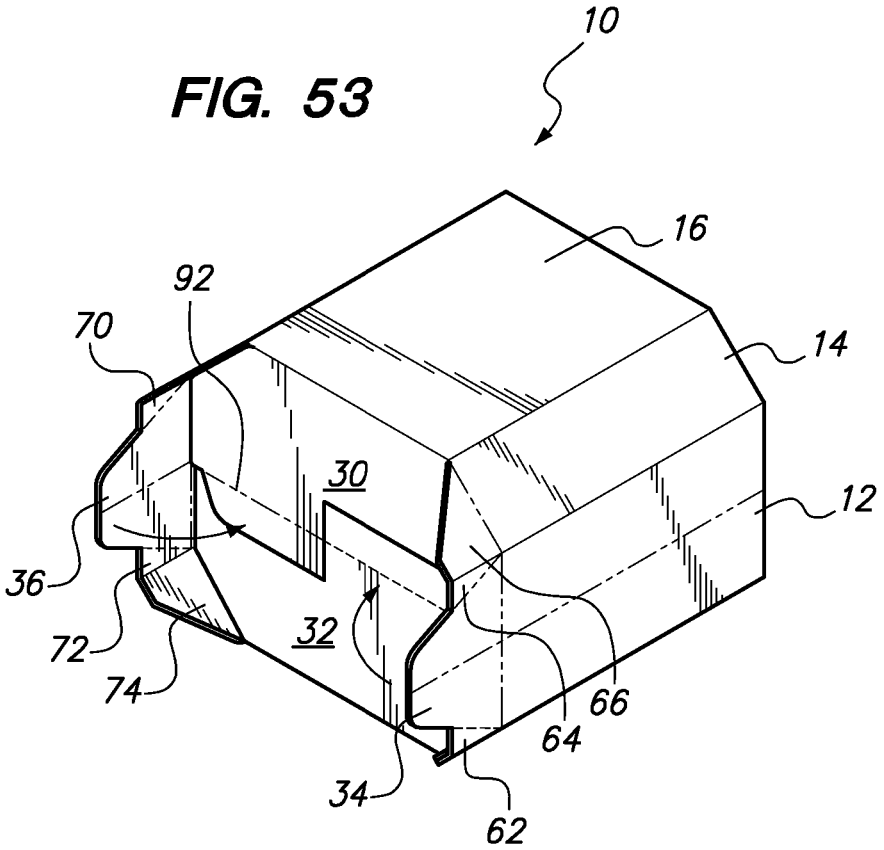
FIG. 53 is a perspective view of the bottom of the pallet container of FIG. 51 with bottom flap 30 joined to bottom flap 32.
Figure 54:
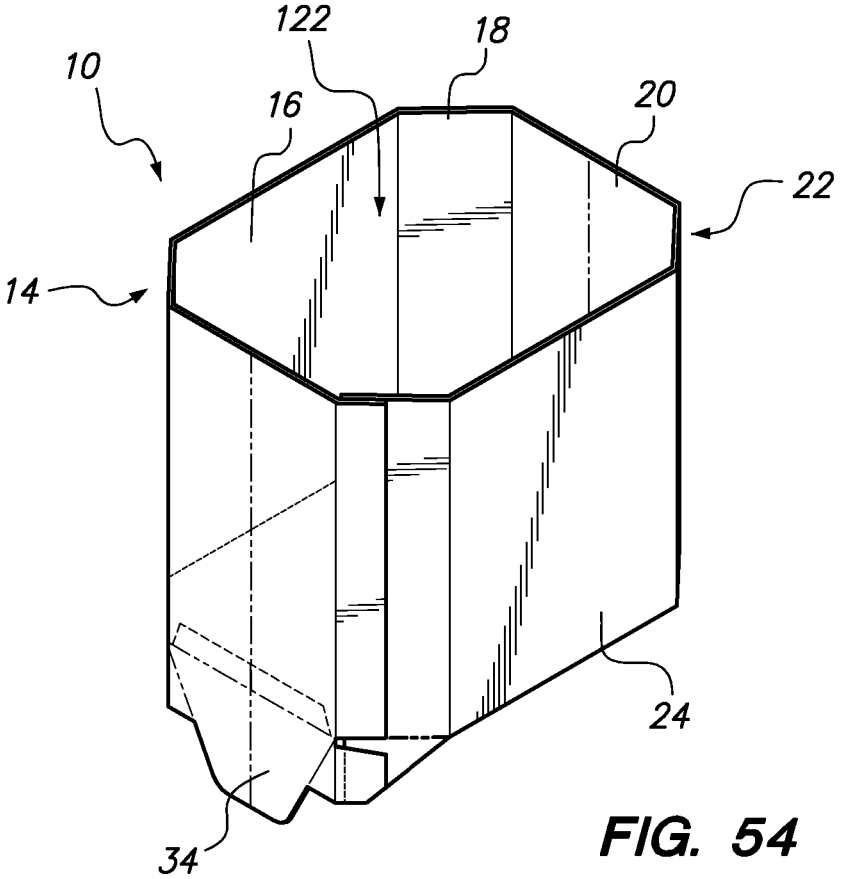
FIG. 54 is a perspective view of the top of the pallet container of FIG. 51 with leg flap 36 folded underneath the bottom piece of the pallet container.
Figure 55:
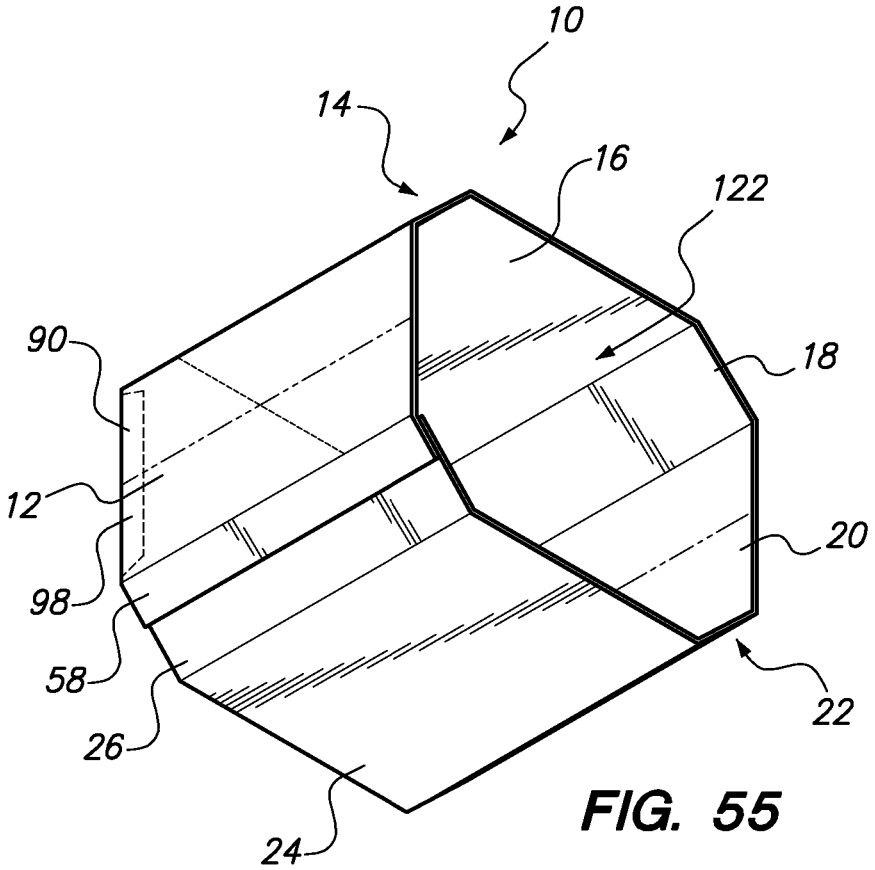
FIG. 55 is a perspective view of the top of the pallet container of FIG. 51.
Figure 56:
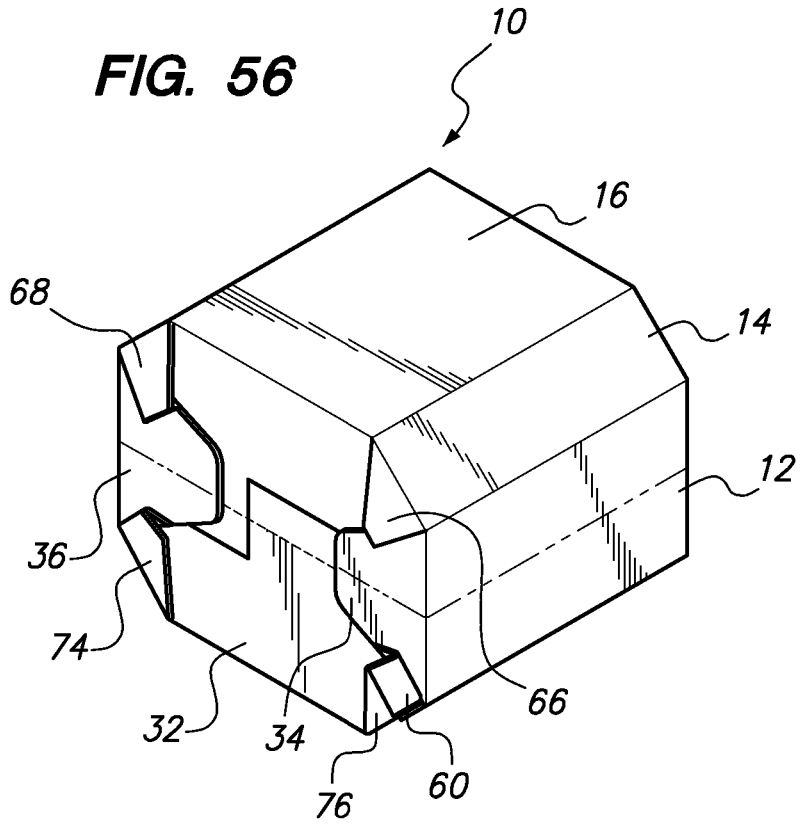
FIG. 56 is a perspective view of the bottom of the pallet container of FIG. 51 in the deployed position.
Figure 57:
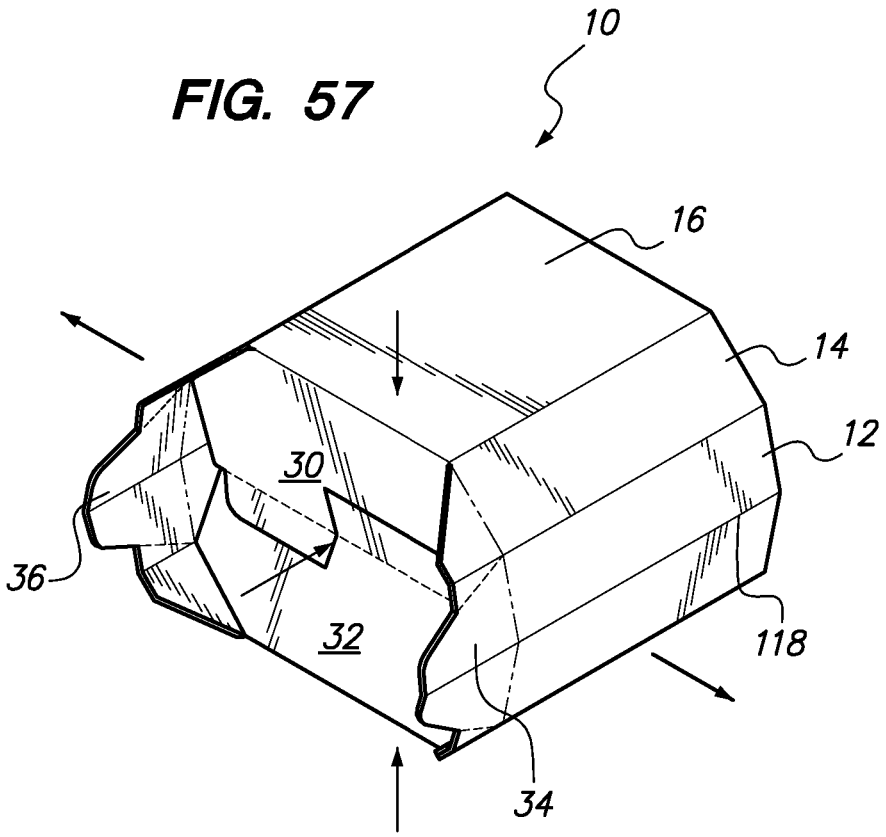
FIG. 57 is a perspective view of the bottom of the pallet container of FIG. 51 transitioning from the deployed position to the collapsed position.
Figure 58:
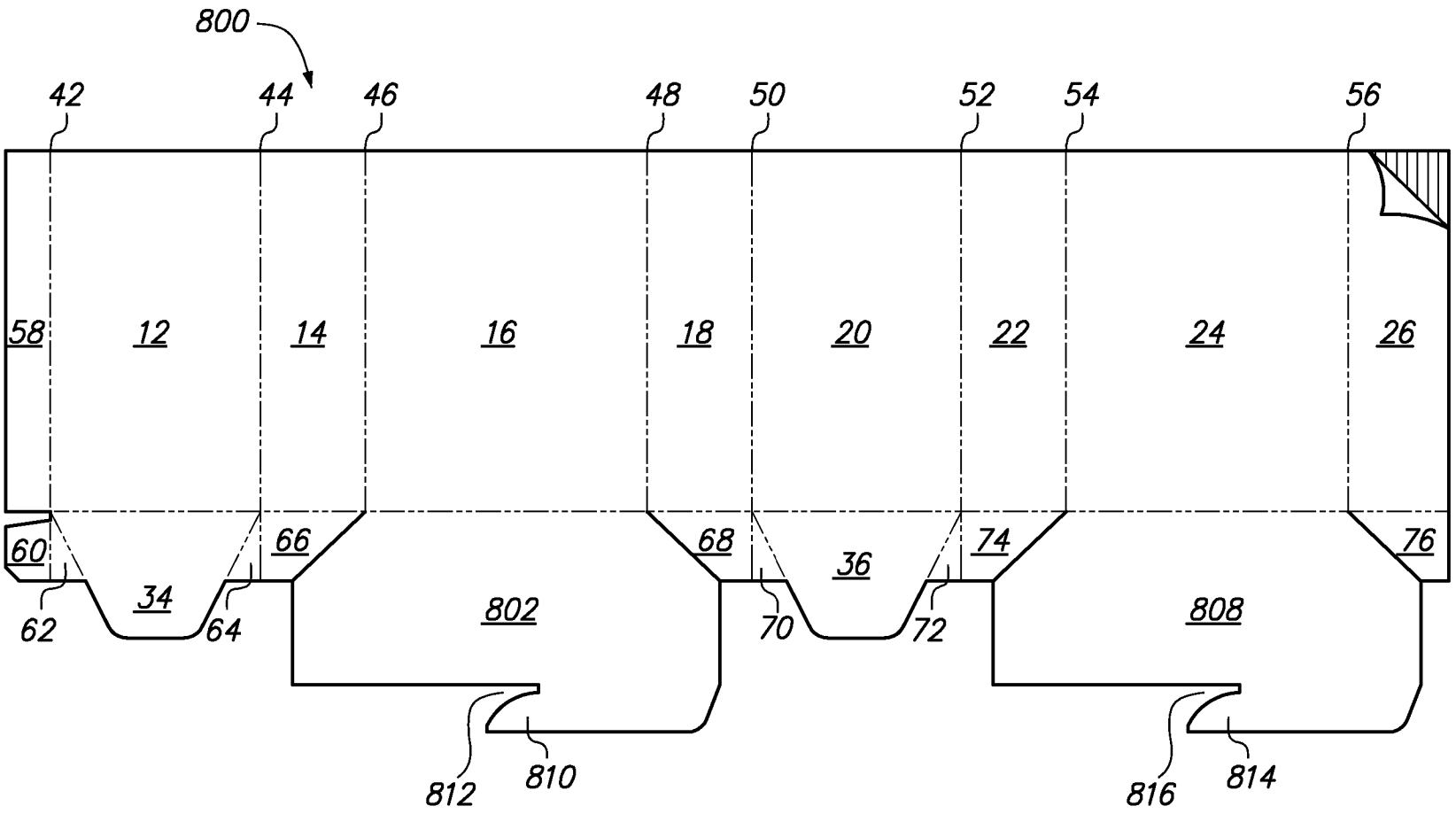
FIG. 58 is a flat plan view of the blank of the eighth embodiment of the present invention.
Figure 59:
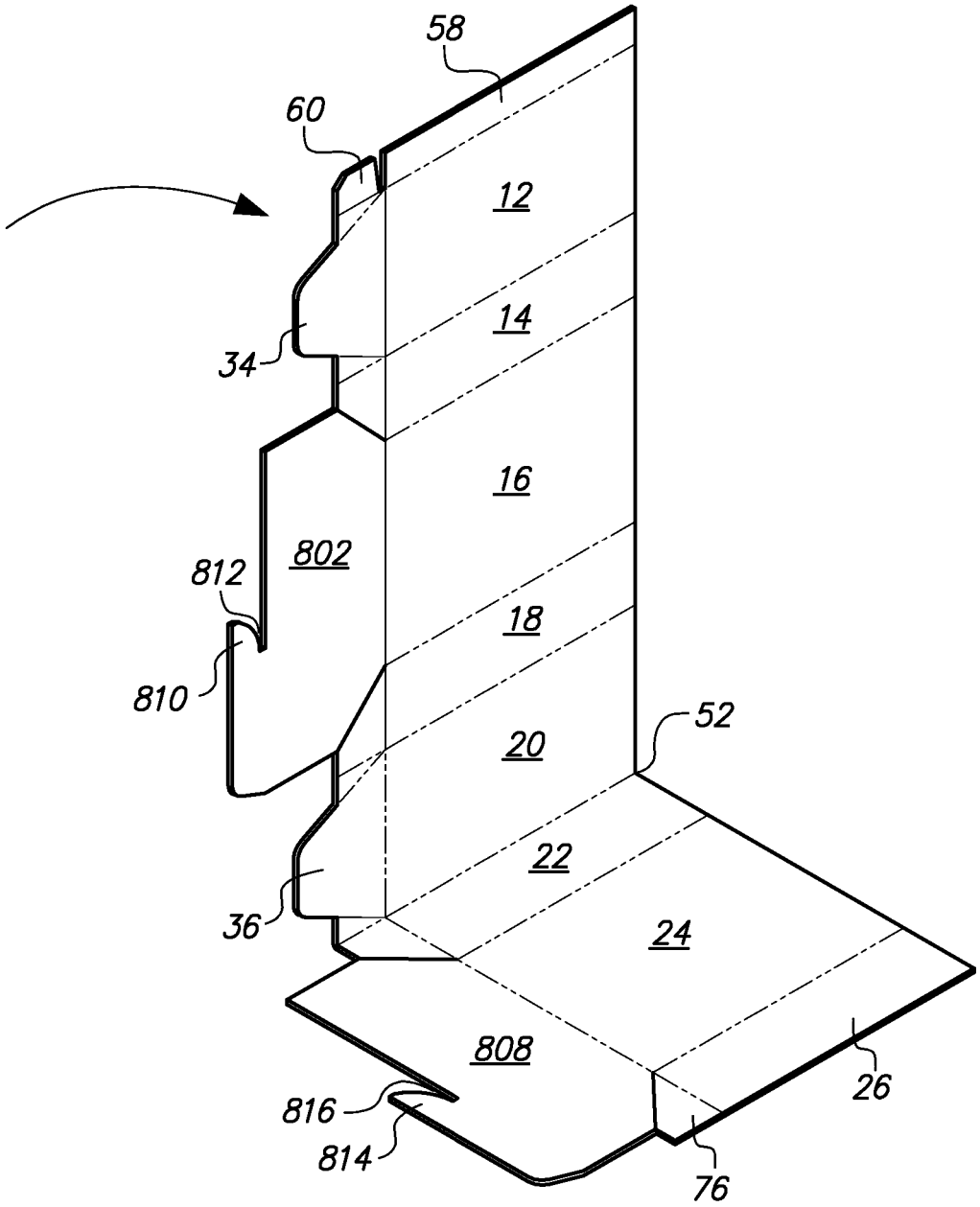
FIG. 59 is a perspective view of the blank of FIG. 58 partially folded along score line 52.
Figure 60:
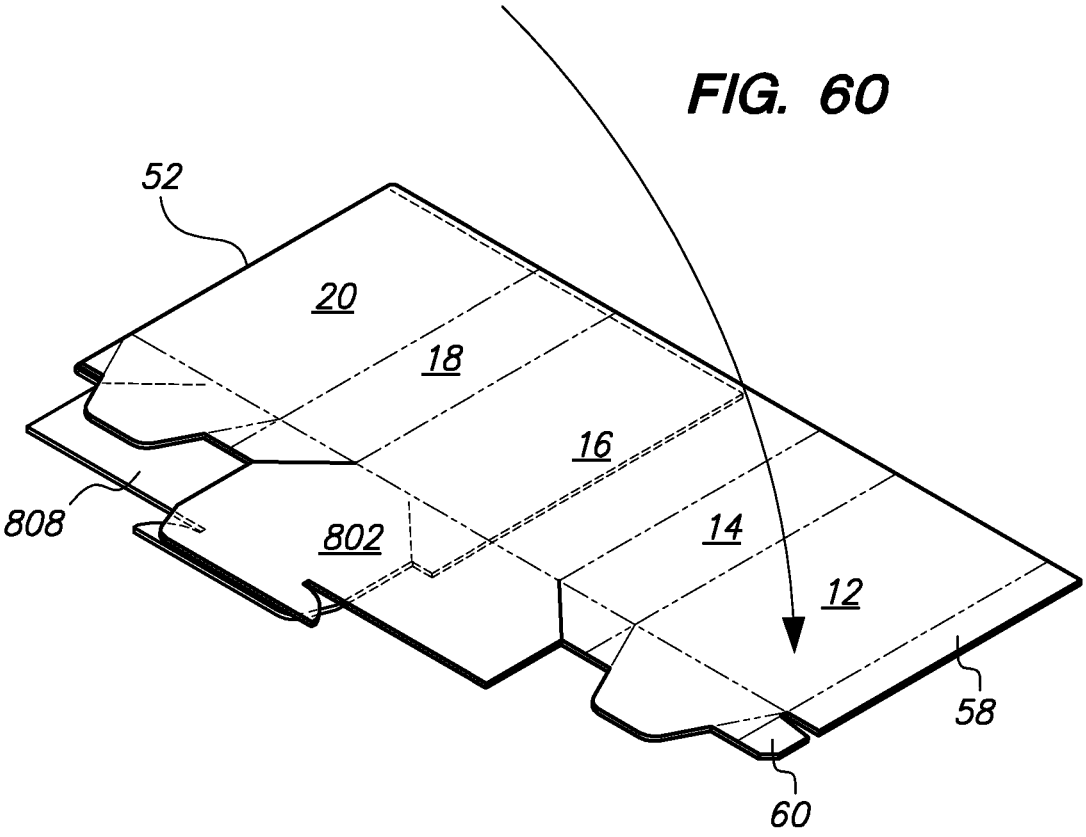
FIG. 60 is a perspective view of the blank of FIG. 58 completely folded along score line 52.
Figure 61:
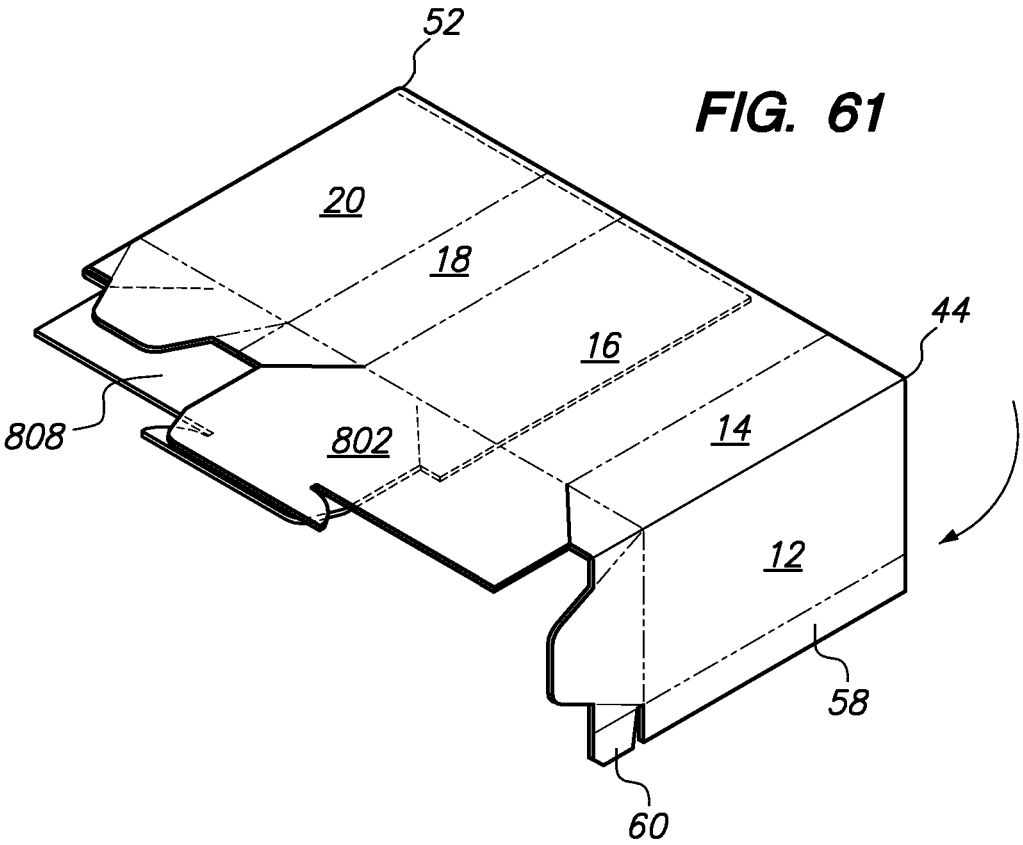
FIG. 61 is a perspective view of the blank of FIG. 60 partially folded along score line 44.
Figure 62:
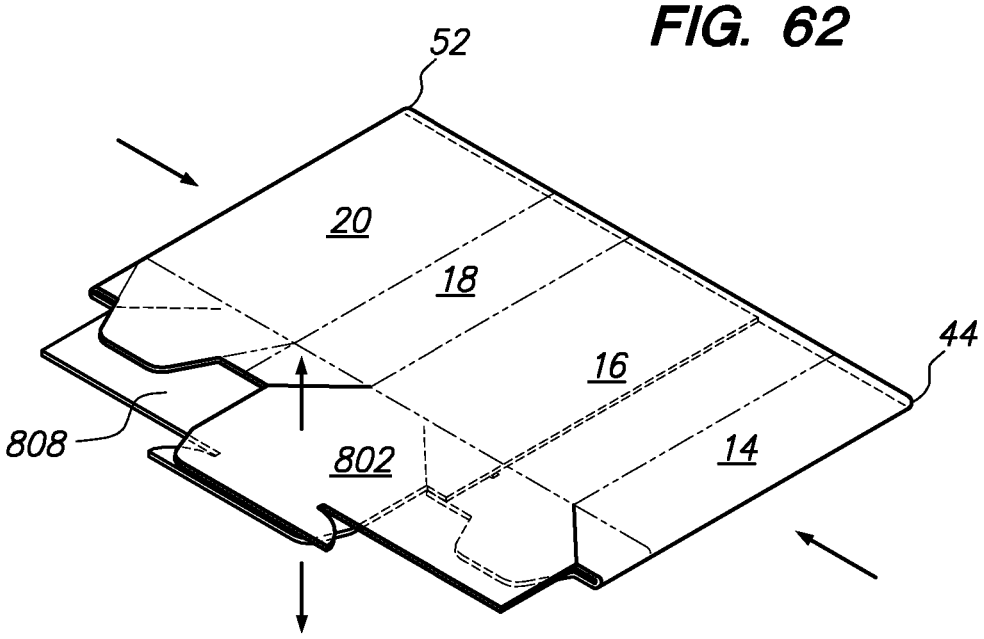
FIG. 62 is a perspective view of the blank of FIG. 60 completely folded along score line 44.
Figure 63:
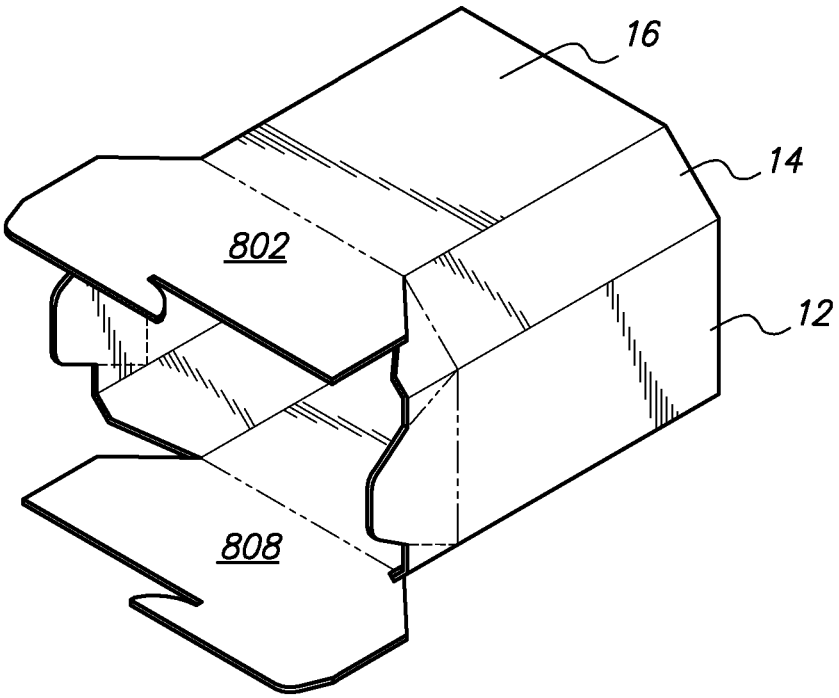
FIG. 63 is a perspective view of the pallet container constructed from the blank of FIG. 58 with the top of the container in the open position.
Figure 64:
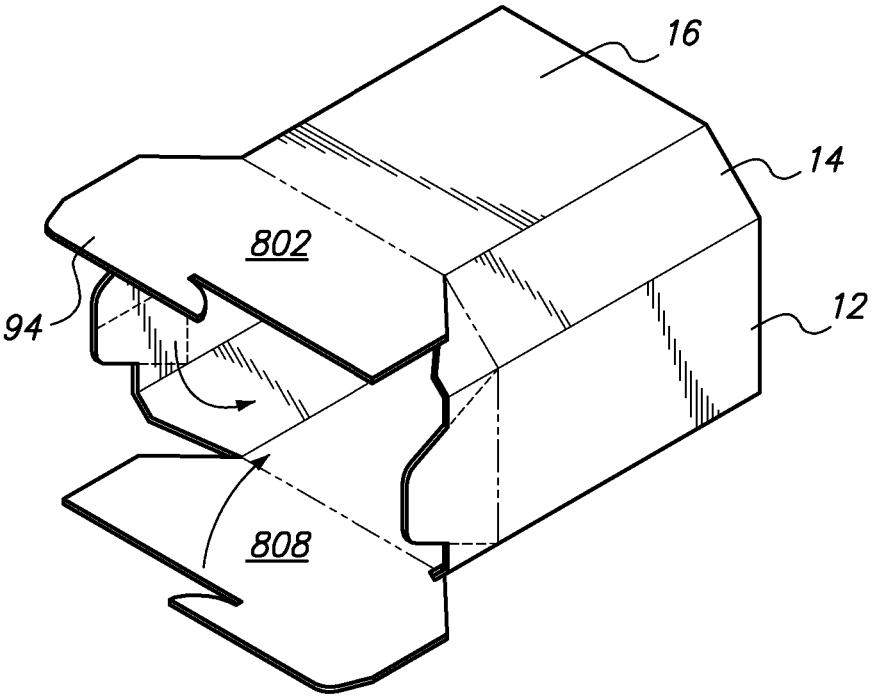
FIG. 64 is a perspective view of the pallet container of FIG. 63 with top of the container in the open position.
Figure 65:
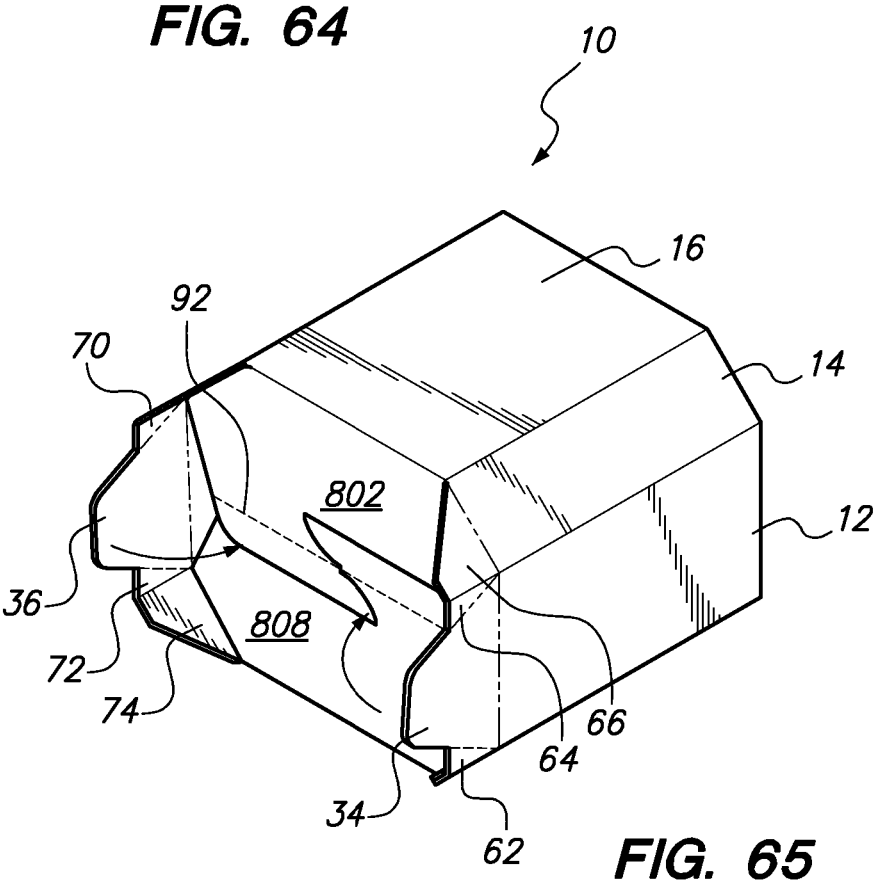
FIG. 65 is a perspective view of the bottom of the pallet container of FIG. 63 with bottom flap 802 joined to bottom flap 808.
Figure 66:
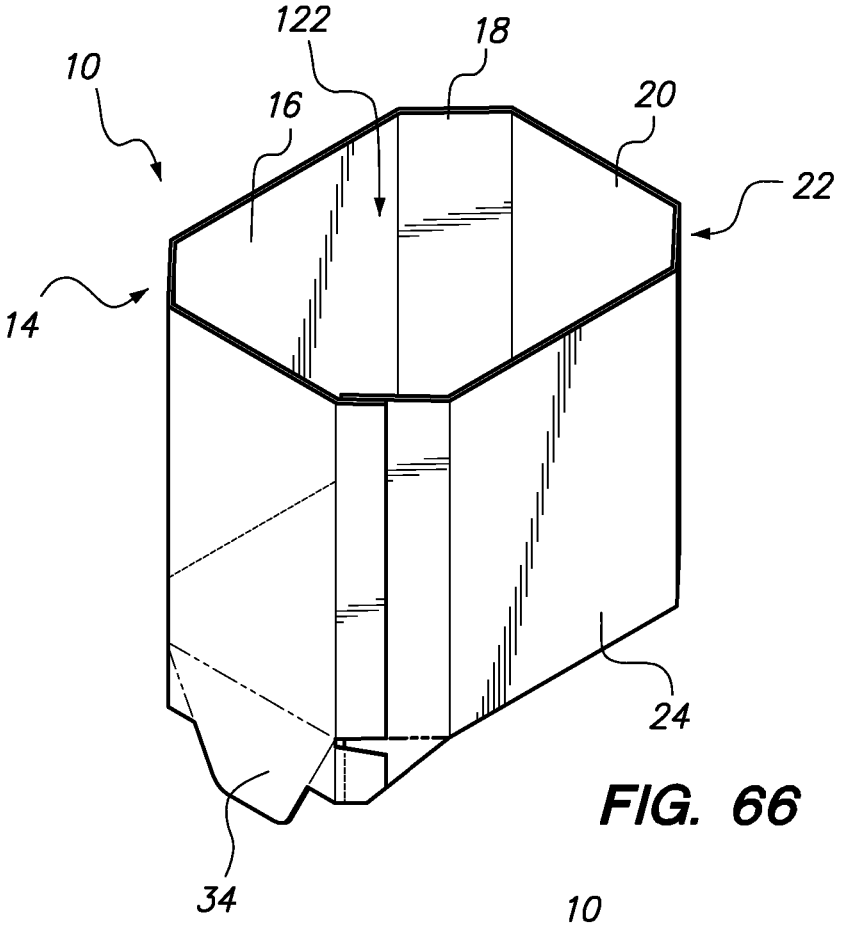
FIG. 66 is perspective view of the top of the pallet container of FIG. 63 with leg flap 36 folded underneath the bottom piece of the pallet container.
Figure 67:
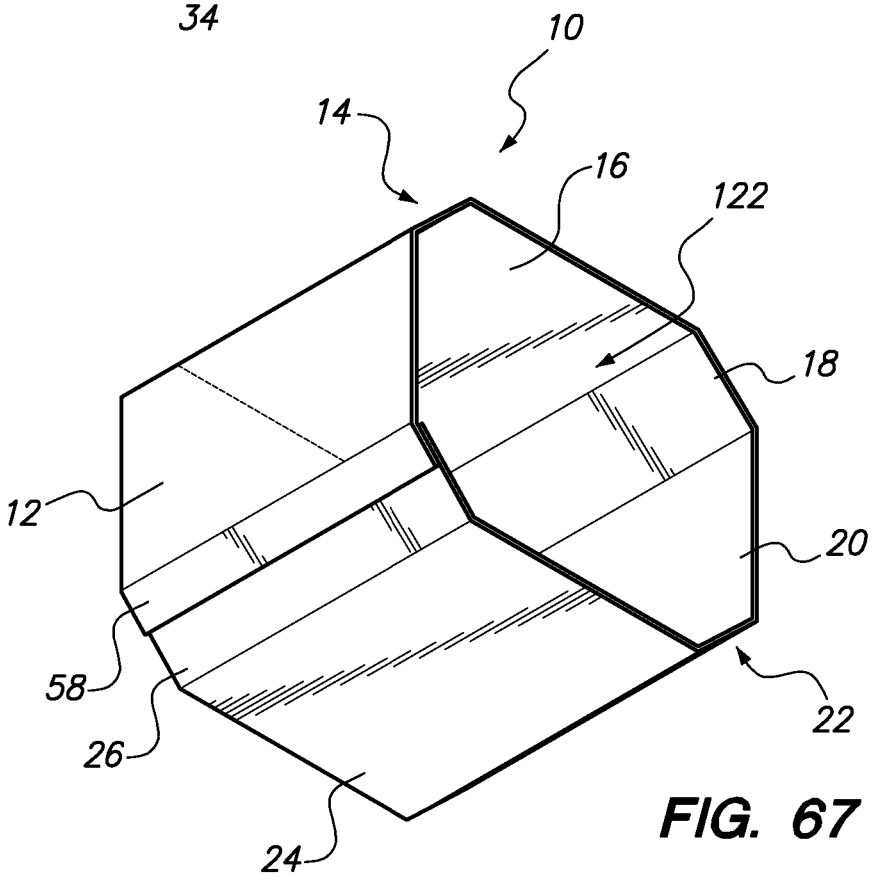
FIG. 67 is a perspective view of the top of the pallet container of FIG. 63.

In the sixth preferred embodiment, as shown in FIGS. 42-44, the container 10 is constructed from blank 600, blank 602 and blank 420. Blank 600 has a first row 38 and a second row 40. The first row 38 is comprised of a glue flap 58, a first wall 12, a second wall 14, a third wall 16, and a fourth wall 18. The glue flap 58, first wall 12, second wall 14, third wall 16, and fourth wall 18 are all preferably rectangular in shape. The glue flap 58 is joined to the first wall 12 via a score line 42. Similarly, the first wall 12 is joined to the second wall 14 via score line 44, the second wall 14 to the third wall 16 via score line 46, and the third wall 16 to the fourth wall 18 via score line 48.

Blank 602 has a first row 606 and a second row 608. The first row 606 is comprised of glue flap 604, a fifth wall 20, a sixth wall 22, a seventh wall 24, and an eighth wall 26. Glue flap 604, fifth wall 20, sixth wall 22, seventh wall 24, and eighth wall 26 are all preferably rectangular in shape. The glue flap is preferably joined to the fifth wall 20 via score line 50, the fifth wall 20 to the sixth wall 22 via score line 52, the sixth wall 22 to the seventh wall 24 via score line 54, and the seventh wall 24 to the eighth wall 26 via score line 56.

The first row 38 of blank 600 is joined to the second row 40 along score line 78. The second row 40 of blank 600 is comprised of a glue flap 60, an inside fold 62, a first leg flap 34, an inside fold 64, an outside fold 66, a first bottom glue flap 502, and an outside fold 68. The first row 606 of blank 602 is joined to the second row 608 along score line 78. The second row of blank 602 is comprised of glue flap 610, an inside fold 70, a second leg flap 36, an inside fold 72, an outside fold 74, a second bottom glue flap 504, and an outside fold 76.

Glue flap 60 is joined to the inside fold 62 along score line 42. First leg flap 34 is joined to inside fold 62 along score line 80 on one side and joined to inside fold 64 along score line 82 on the other side. Inside fold 64 is joined to outside fold 66 along score line 44. Glue flap 610 is joined to the inside fold 70 along score line 50. The second leg flap 36 is joined to inside fold 70 along score line 84 on one side and to inside fold 72 along score line 86 on the other side. Inside fold 72 is joined to outside fold 74 along score line 52. The inside folds 62, 64, 70, 72 are triangular-shaped, preferably in the shape of a right triangle.

The first bottom glue flap 502 and second bottom glue flap 504 are preferably in the shape of a rectangle. Thus, first flap 502 does not abut outside fold 66 or outside fold 68. Likewise, second flap 504 does not abut outside fold 74 or outside fold 76. The top side of the flaps 502, 504 is along score line 78. The bottom side of the flaps 502, 504 is parallel to the top side.

Blank 420 is comprised of a first bottom section 406 and a second bottom section 408. The bottom sections 406, 408 are preferably in the shape of pentagon and are joined to one another along score line 418. Joined to the two parallel sides of the first bottom section 406 via score lines 412 are inside flaps 410. Joined to the two parallel sides of the second bottom flap 408 via score lines 416 are inside flaps 414.

As shown in FIGS. 42-44, to construct the top piece of pallet container 10 from the blank 600 and blank 602, the glue flap 604 is attached to fourth wall 18 and glue flap 601 is attached to outside fold 68. Blank 420 is attached to the attached blanks 600, 602. Second blank 420 forms the bottom piece 28 of the container 10. First bottom section 406 is preferably glued to the bottom surface of first bottom glue flap 502, while second bottom section 408 is preferably glued to the bottom surface of second bottom glue flap 504.

The eight walls are folded inward along the score lines 42, 44, 46, 48, 50, 52, 54, 56 of the first row 38. Glue flap 58 is attached to eighth wall 26 to form the octagon opening 122 of the container 10. Glue flap 58 is preferably glued to the exterior surface of the eighth wall. Glue flap 60 of the second row 40 of the blank 600 is similarly attached to the outside fold 76. When glue flaps 58, 60 are attached to the eighth wall 26, score line 42 is aligned with side edge of the eighth wall 26.

When the container is the open position, the inside flaps 410, 414 are bent upward along score lines 412, 416 and abut first wall 12 and fifth wall 18 in the interior of the container 10. The inside flaps 410, 414 serve to seal the interior of the container 10.

The deployment and collapsing process of the container 10 constructed from blanks 600, 602, 420 is the same as previously described.

In the seventh preferred embodiment, as shown in FIGS. 45-57, the container 10 is constructed from blank 700 and blank 702. Blank 700 and blank 702 are preferably complementary. Blank 700 has a first row 38 and a second row 40. The first row 38 is comprised of a glue flap 58, a first wall 12, a second wall 14, a third wall 16, and a fourth wall 18. The glue flap 58, first wall 12, second wall 14, third wall 16, and fourth wall 18 are all preferably rectangular in shape. The glue flap 58 is joined to the first wall 12 via a score line 42. Similarly, the first wall 12 is joined to the second wall 14 via score line 44, the second wall 14 to the third wall 16 via score line 46, and the third wall 16 to the fourth wall 18 via score line 48.

Blank 702 has a first row 712 and a second row 714. The first row 712 is comprised of glue flap 704, a fifth wall 20, a sixth wall 22, a seventh wall 24, and an eighth wall 26. Glue flap 704, fifth wall 20, sixth wall 22, seventh wall 24, and eighth wall 26 are all preferably rectangular in shape. The glue flap is preferably joined to the fifth wall 20 via score line 50, the fifth wall 20 to the sixth wall 22 via score line 52, the sixth wall 22 to the seventh wall 24 via score line 54, and the seventh wall 24 to the eighth wall 26 via score line 56.

The first row 38 of blank 700 is joined to the second row 40 along score line 78. The second row 40 of blank 700 is comprised of a glue flap 60, an inside fold 62, a first leg flap 34, an inside fold 64, an outside fold 66, a first bottom flap 30, and an outside fold 68. The first row 712 of blank 702 is joined to the second row 608 along score line 716. The second row of blank 602 is comprised of glue flap 706, an inside fold 70, a second leg flap 36, an inside fold 72, an outside fold 74, a second bottom flap 32, and an outside fold 76.

The glue flap 60 of blank 700 is joined to the inside fold 62 along score line 42. First leg flap 34 is joined to inside fold 62 along score line 80 on one side and joined to inside fold 64 along score line 82 on the other side. Inside fold 64 is joined to outside fold 66 along score line 44. First bottom flap 30 abuts, but is not joined to, the outside fold 66 on one side and the outside fold 68 on the other side. The glue flap 706 of blank 702 is joined to the inside fold 70 along score line 50. The second leg flap 36 is joined to inside fold 70 along score line 84 on one side and to inside fold 72 along score line 86 on the other side. Inside fold 72 is joined to outside fold 74 along score line 52. Second bottom flap 32 abuts, but is not joined to, the outside fold 74 on one side and the outside fold 76 on the other side. The inside folds 62, 64, 70, 72 are triangular-shaped, preferably in the shape of a right triangle.

The first bottom flap 30 and second bottom flap 32 are preferably in the shape of pentagon. The top side of the flaps 30, 32 is along score line 78. The bottom side (free end) of the flaps 30, 32 is parallel to the top side. Joined to the two parallel sides of the first bottom flap 30 via score lines 88 are inside flaps 90. Joined to the two parallel sides of the second bottom flap 32 via score lines 96 are inside flaps 98. Joined to the bottom side of flap 30 is glue flap 708. Glue flap 708 extends approximately one-half of the length of the bottom side. Glue flap 710 is joined to the bottom side of flap 32. Glue Flap 710 extends approximately one-half of the length of the bottom side.

As shown in FIGS. 46-53, to construct the pallet container 10 from blanks 700, 702, glue flap 708 is attached to first bottom flap 30 and glue flap 710 is attached to second bottom flap 32. To construct the top piece of the container 10, glue flap 58 of blank 700 is attached to eighth wall 26 of blank 702. Glue flap 60 is also attached to outside fold 76. In addition, glue flap 704 of blank 702 is attached to fourth wall 18. Glue flap 706 is also attached to outside fold 68. Once the eight walls are folded inward along the score lines 42, 44, 46, 48, 50, 52, 54, 56, the octagon 122 opening of the container 10 is formed.

The deployment and collapsing process of the container 10 constructed from blanks 700, 702 is the same as previously described.

In eighth preferred embodiment, as shown in FIGS. 58-69, the container 10 is constructed from blank 800. The blank 800 has a first row 38 and a second row 40. The first row 38 is comprised of a glue flap 58, a first wall 12, a second wall 14, a third wall 16, a fourth wall 18, a fifth wall 20, a sixth wall 22, a seventh wall 24, and an eighth wall 26. The glue flap 58, first wall 12, second wall 14, third wall 16, fourth wall 18, fifth wall 20, sixth wall 22, seventh wall 24, and eighth wall 26 are all preferably rectangular in shape. The glue flap 58 is joined to the first wall 12 via a score line 42. Similarly, the first wall 12 is joined to the second wall 14 via score line 44, the second wall 14 to the third wall 16 via score line 46, the third wall 16 to the fourth wall 18 via score line 48, the fourth wall 18 to the fifth wall 20 via score line 50, the fifth wall 20 to the sixth wall 22 via score line 52, the sixth wall 22 to the seventh wall 24 via score line 54, and the seventh wall 24 to the eighth wall 26 via score line 56. In one version of this embodiment, first wall 12 and first leg flap 34 are bisected by score line 118. In another version, depending on the intended use of the container 10, score line 118 is absent. Similarly, fifth wall 20 and second leg flap 36 may or may not be bisected by score line 120.

The first row 38 is joined to the second row 40 along score line 78. The second row 40 of blank 800 is comprised of a glue flap 60, an inside fold 62, a first leg flap 34, an inside fold 64, an outside fold 66, a first bottom flap 802, an outside fold 68, an inside fold 70, a second leg flap 36, an inside fold 72, an outside fold 74, a second bottom flap 808, and an outside fold 76.

The glue flap 60 is joined to the inside fold 62 along score line 42. First leg flap 34 is joined to inside fold 62 along score line 80 on one side and joined to inside fold 64 along score line 82 on the other side. Inside fold 64 is joined to outside fold 66 along score line 44. First bottom flap 802 abuts, but is not joined to, the outside fold 66 on one side and the outside fold 68 on the other side. The outside fold 68 is joined to the inside fold 70 along score line 50. The second leg flap 36 is joined to inside fold 70 along score line 84 on one side and to inside fold 72 along score line 86 on the other side. Inside fold 72 is joined to outside fold 74 along score line 52. Second bottom flap 808 abuts, but is not joined to, the outside fold 74 on one side and the outside fold 76 on the other side. Inside folds 62, 64, 70, 72 are triangular-shaped, preferably in the shape of a right triangle.

The top sides of first bottom flap 802 and second bottom flap 808 are along score line 78. The bottom side (free end) of the flap 802 consists of a notch 812 which creates a locking tab 810. The free end of flap 808 consists of a notch 816 which creates a locking tab 814.

To construct the pallet container 10 from the blank 800, the eight walls are folded inward along the score lines 42, 44, 46, 48, 50, 52, 54, 56 of the first row 38. Glue flap 58, which is joined to first wall 12, is attached to eighth wall 26 to form the octagon opening 122 of the container 10. Glue flap 58 is preferably glued to the exterior surface of the eighth wall. Glue flap 60 of the second row 40 of the blank 100 is similarly attached to the outside fold 76. When glue flaps 58, 60 are attached to the eighth wall 26, score line 42 is aligned with side edge of the eighth wall 26.

Figure 68:
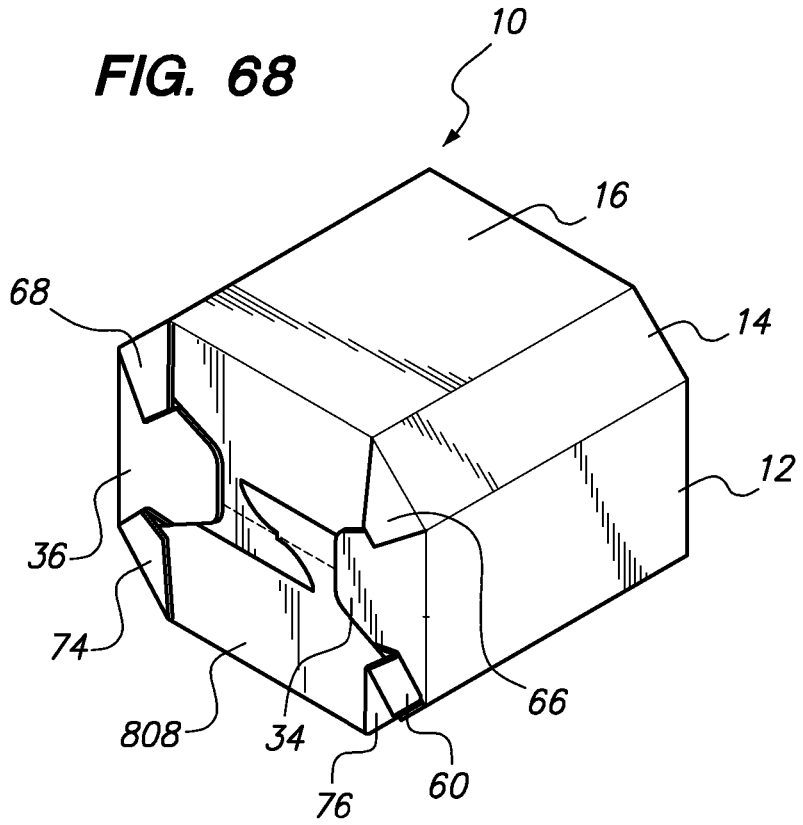
FIG. 68 is a perspective view of the bottom of the pallet container of FIG. 63 in the deployed position.
Figure 69:
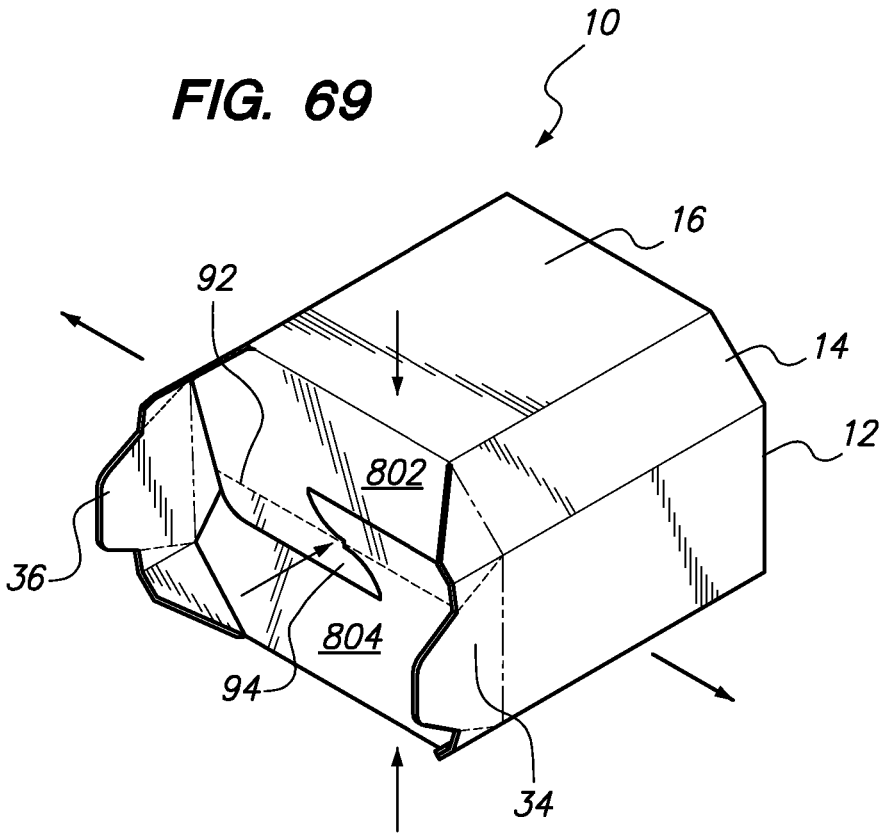
FIG. 69 is a perspective view of the bottom of the pallet container of FIG. 63 transitioning from the deployed position to the collapsed position.
Figure 70:
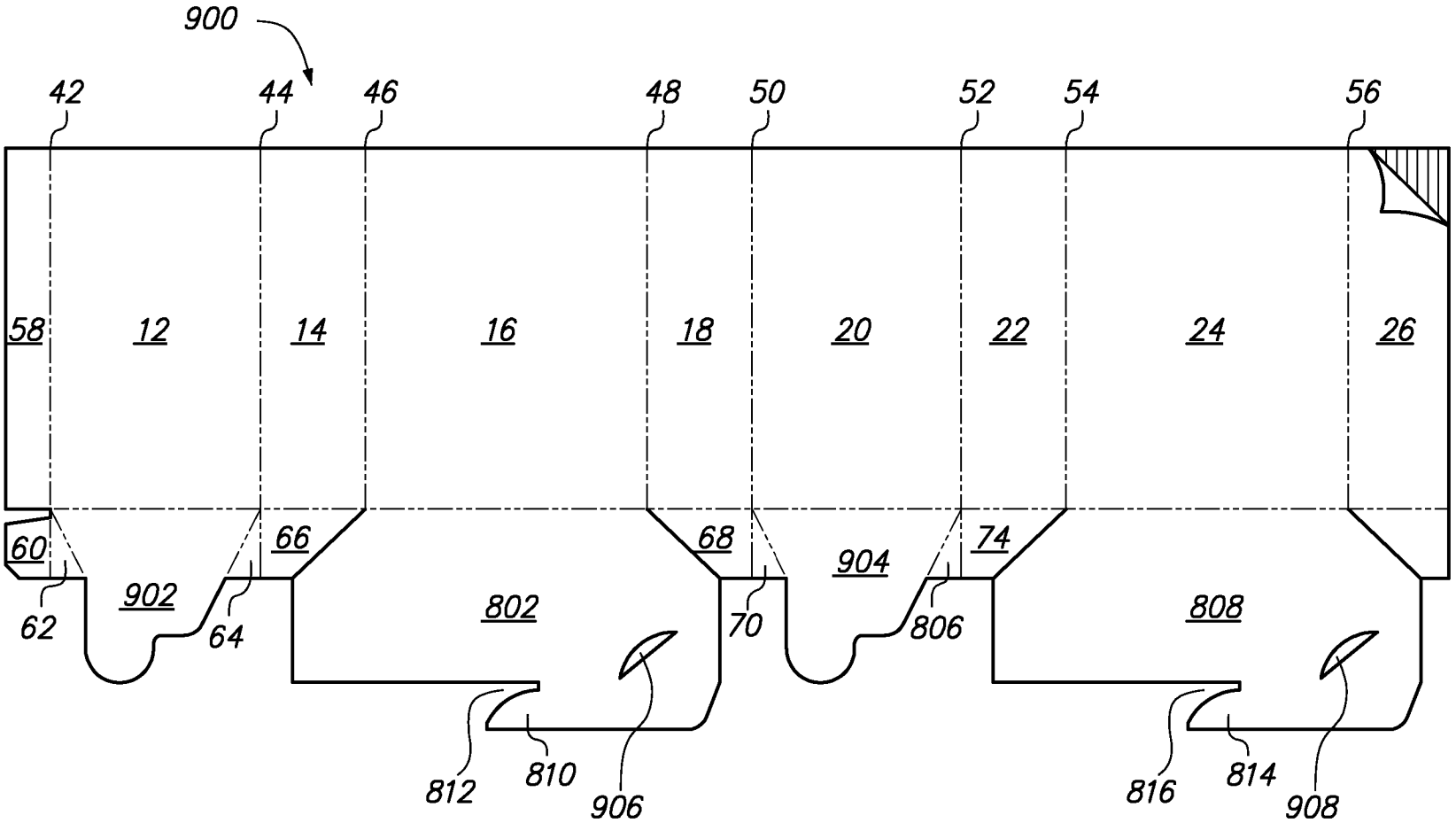
FIG. 70 is a flat plan view of the blank of the ninth embodiment of the present invention.
Figure 71:
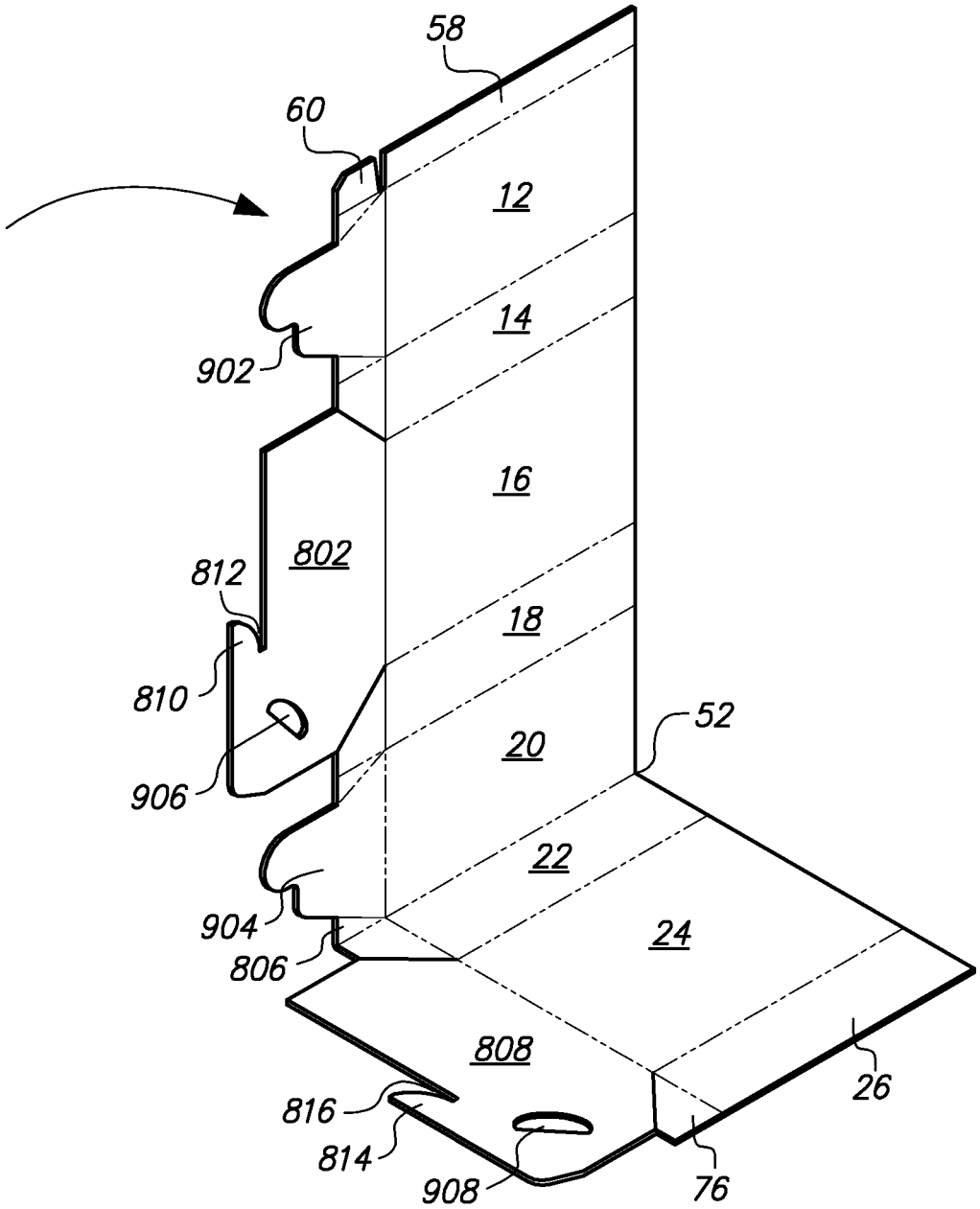
FIG. 71 is a perspective view of the blank of FIG. 70 partially folded along score line 52.
Figure 72:
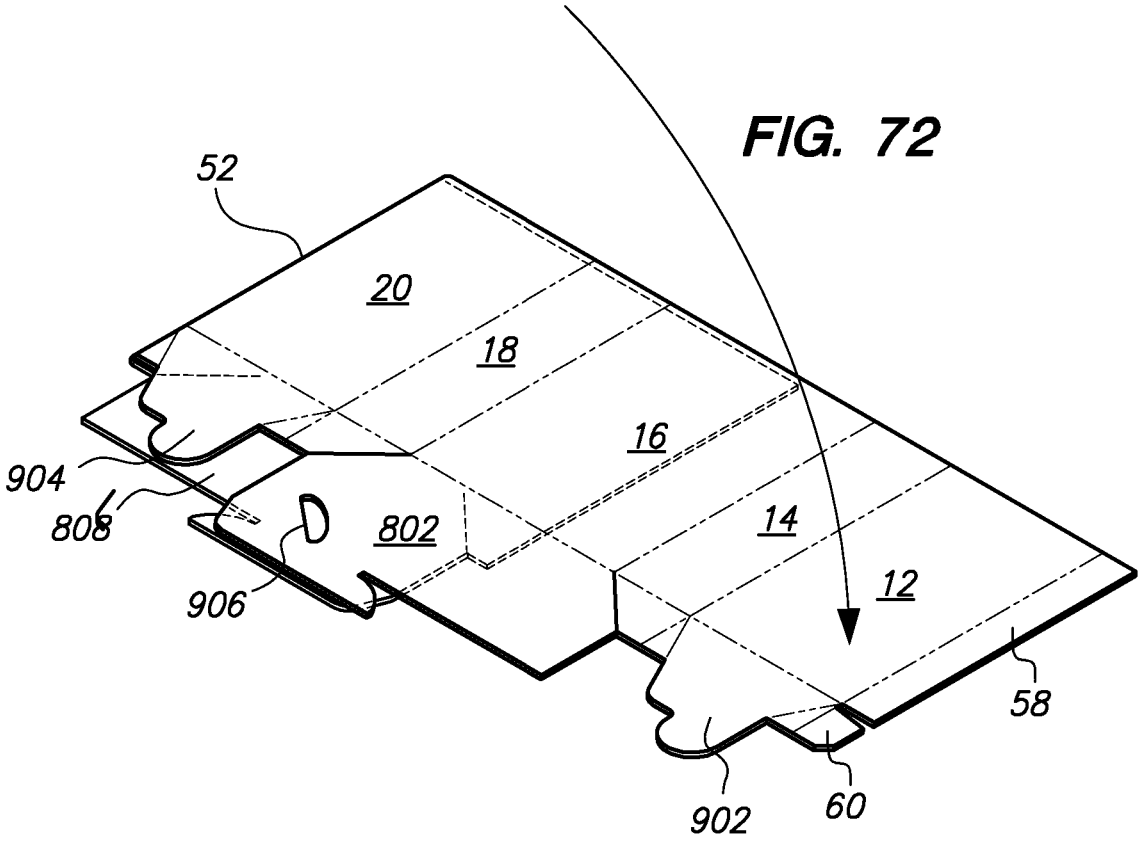
FIG. 72 is a perspective view of the blank of FIG. 70 completely folded along score line 52.
Figure 73:
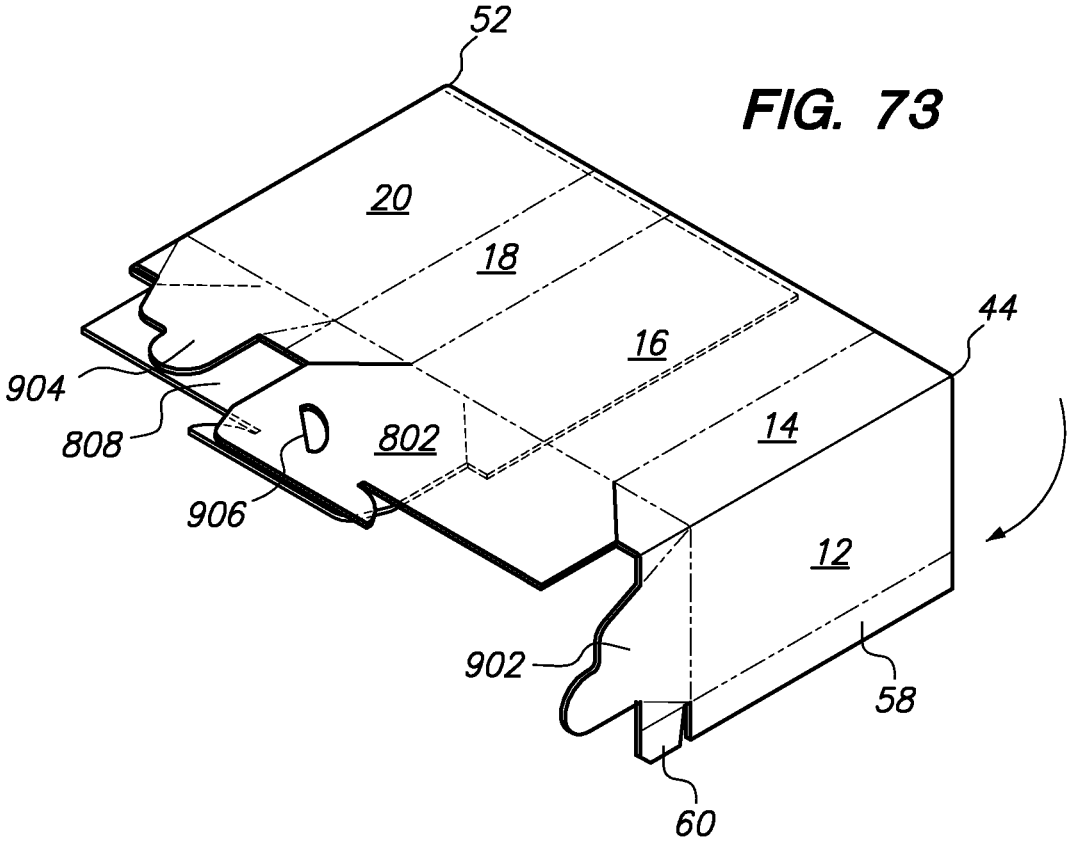
FIG. 73 is a perspective view of the blank of FIG. 72 partially folded along score line 44.
Figure 74:
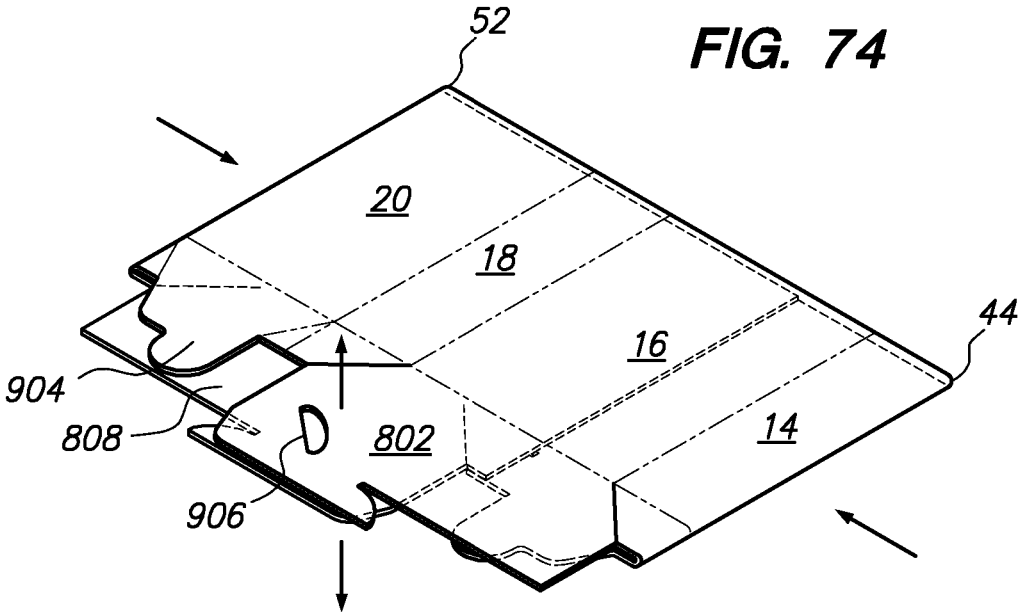
FIG. 74 is a perspective view of the blank of FIG. 72 completely folded along score line 44.
Figure 75:
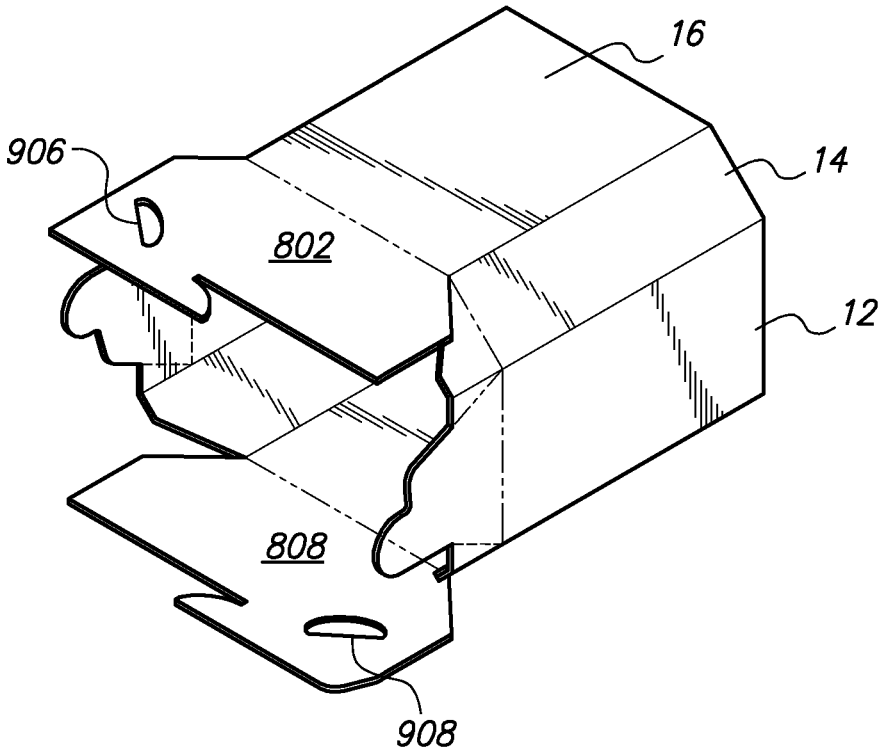
FIG. 75 is a perspective view of the pallet container constructed from the blank of FIG. 70 with the top of the container in the open position.
Figure 76:
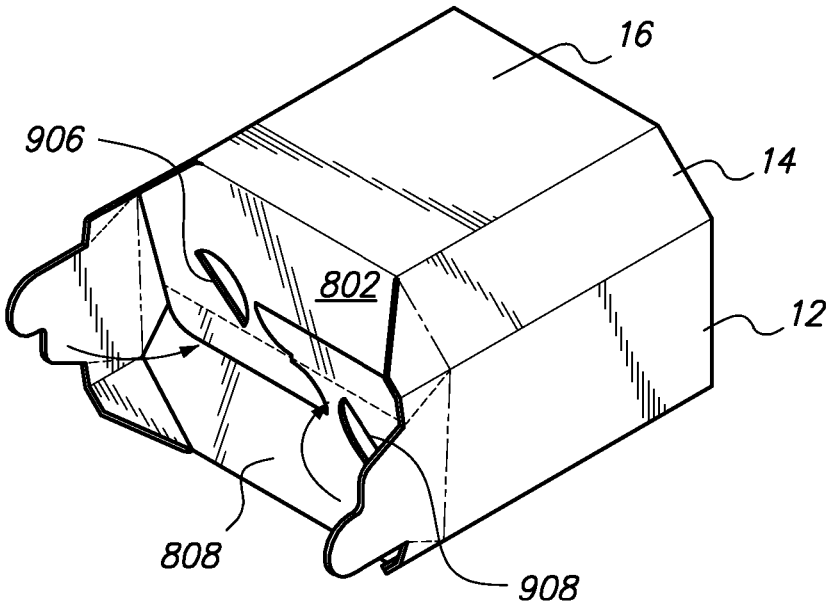
FIG. 76 is a perspective view of the bottom of the pallet container of FIG. 75 with bottom flap 802 joined to bottom flap 808.
Figure 77:
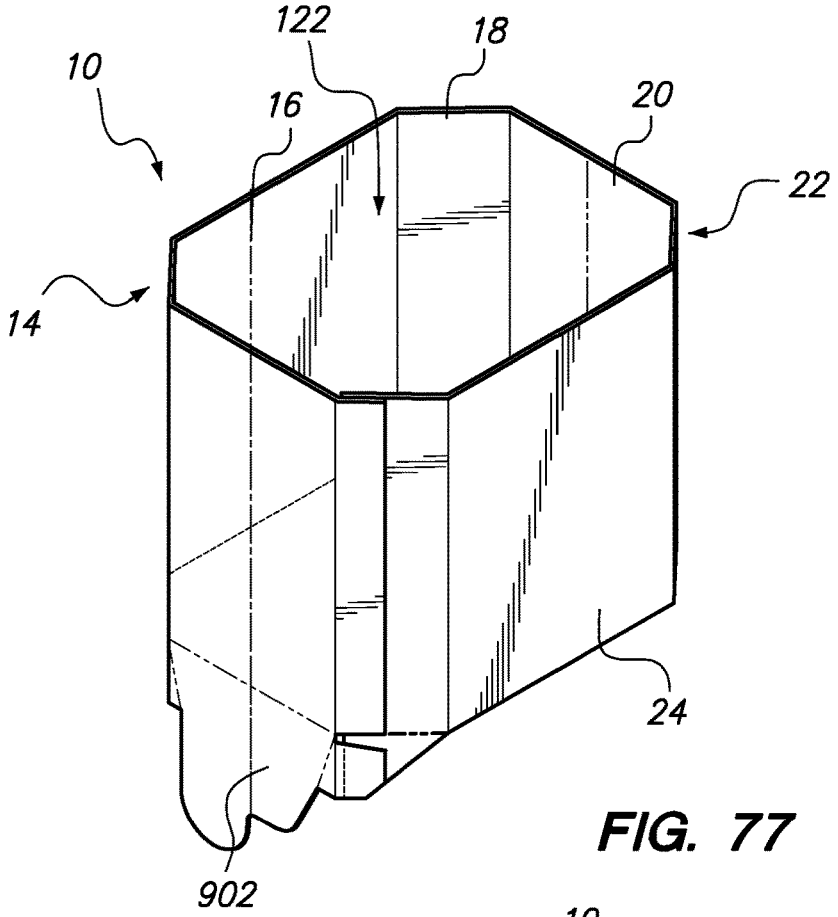
FIG. 77 is a perspective view of the top of the pallet container of FIG. 75 with leg flap 904 folded underneath the bottom piece of the pallet container.
Figure 78:
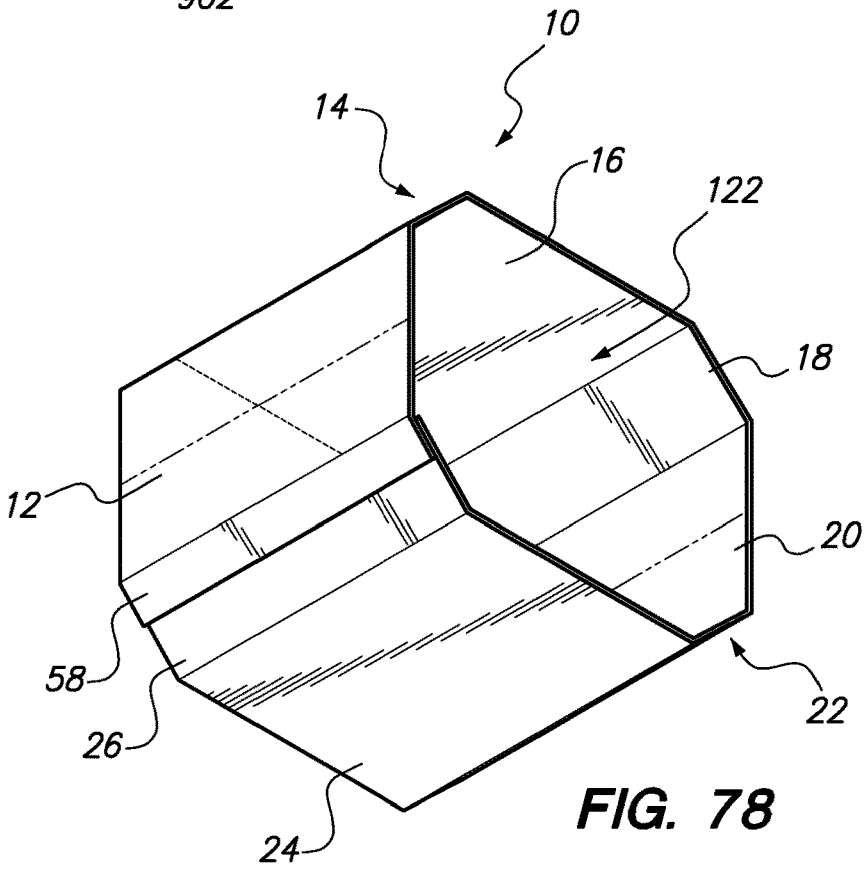
FIG. 78 is a perspective view of the top of the pallet container of FIG. 75.

As shown in FIG. 68, the bottom piece 28 of the container is formed by interlocking the first bottom flap 802 and the second bottom flap 808. The flaps 802, 808 are interlocked by hooking locking tab 810 into notch 816 and hooking locking tab 814 into notch 812. This causes locking tab 810 to rest on the top surface of second bottom flap 808 and locking tab 814 to rest on the top surface of first bottom flap 802.

In the version of this embodiment comprising score line 118 and score line 120, the first step of the deployment of the container 10 constructed from blank 800 is the same as previously described. However, in the absence of score line 118 and score line 120, the configuration of the container 10 constructed from blank 800 in the flat position is different from the previously described embodiments. Specifically, the container 10 is folded along score line 44 and score line 52 when in the flat position, instead of score lines 118, 120.

In the top opening step of the deployment process of the container, the user pushes score line 44 and score line 52 towards each other. This action transitions the container 10 into the open position. An opening 122 in the top end of the container 10 is created by the eight joined walls 12, 14, 16, 18, 20, 22, 24, 26.

The second step of the deployment process is the bottom closing process. Once the top of the container 10 has been opened, the container 10 preferably is turned upside down to secure the bottom piece 28 of the container 10 by interlocking the first bottom flap 802 and the second bottom flap 808. As explained above, the flaps 802, 808 are interlocked by hooking locking tab 810 into notch 816 and hooking locking tab 814 into notch 812. This causes locking tab 810 to rest on the top surface of second bottom flap 808 and locking tab 814 to rest on the top surface of first bottom flap 802.

Once the bottom piece 28 is assembled, pressure is exerted on the first leg flap 34 and the second leg flap 36. The pressure can be applied manually when the container 10 is upside down or by rocking the container 10 back-and-forth on first leg flap 34 and second leg flap 36 when the container 12 is in the upright position. This pressure causes the leg flaps 34, 36 fold under the bottom piece of the container 10 along score line 78. During the folding process of first leg flap 34, outside fold 76 (connected to glue flap 60) is forced to fold on top of first leg flap 34 along score lines 78, 42, and 80. Thus, inside fold 62 is folded between outside fold 76 and first leg flap 34. Similarly, outside fold 66 is forced to fold on top of first leg flap 34 along score lines 78, 44, and 82. Thus, inside fold 64 is folded between outside fold 66 and the first leg flap 34. During the folding process of second leg flap 36, outside fold 68 is forced to fold on top of second leg flap 36 along score lines 78, 50, and 84. Thus, inside fold 70 is folded between outside fold 68 and second leg flap 36. Similarly, outside fold 74 is forced to fold on top of second leg flap 36 along score lines 78, 52, and 86. Thus, inside fold 72 is folded between outside fold 74 and second leg flap 36. In application, the weight of the load inside the container 10 holds the first leg flap 34 and the second leg flap 36 parallel with bottom piece 28, and thus allows the flaps 34, 36 to serve as reinforcement to the bottom piece 28 of the container.

In ninth preferred embodiment, as shown in FIGS. 70-80, the container 10 is constructed from blank 900. The blank 900 has a first row 38 and a second row 40. The first row 38 is comprised of a glue flap 58, a first wall 12, a second wall 14, a third wall 16, a fourth wall 18, a fifth wall 20, a sixth wall 22, a seventh wall 24, and an eighth wall 26. The glue flap 58, first wall 12, second wall 14, third wall 16, fourth wall 18, fifth wall 20, sixth wall 22, seventh wall 24, and eighth wall 26 are all preferably rectangular in shape. The glue flap 58 is joined to the first wall 12 via a score line 42. Similarly, the first wall 12 is joined to the second wall 14 via score line 44, the second wall 14 to the third wall 16 via score line 46, the third wall 16 to the fourth wall 18 via score line 48, the fourth wall 18 to the fifth wall 20 via score line 50, the fifth wall 20 to the sixth wall 22 via score line 52, the sixth wall 22 to the seventh wall 24 via score line 54, and the seventh wall 24 to the eighth wall 26 via score line 56.

The first row 38 is joined to the second row 40 along score line 78. The second row 40 of blank 900 is comprised of a glue flap 60, an inside fold 62, a first leg flap 902, an inside fold 64, an outside fold 66, a first bottom flap 802, an outside fold 68, an inside fold 70, a second leg flap 904, an inside fold 72, an outside fold 74, a second bottom flap 808, and an outside fold 76.

The glue flap 60 is joined to the inside fold 62 along score line 42. First leg flap 902 is joined to inside fold 62 along score line 80 on one side and joined to inside fold 64 along score line 82 on the other side. Inside fold 64 is joined to outside fold 66 along score line 44. First bottom flap 804 abuts, but is not joined to, the outside fold 66 on one side and the outside fold 68 on the other side. The outside fold 68 is joined to the inside fold 70 along score line 50. The second leg flap 904 is joined to inside fold 70 along score line 84 on one side and to inside fold 72 along score line 86 on the other side. Inside fold 72 is joined to outside fold 74 along score line 52. Second bottom flap 808 abuts, but is not joined to, the outside fold 74 on one side and the outside fold 76 on the other side. Inside folds 62, 64, 70, 72 are triangular-shaped, preferably in the shape of a right triangle.

The top sides of first bottom flap 802 and second bottom flap 808 are along score line 78. The bottom side (free end) of the flap 802 consists of a notch 812 which creates a locking tab 810. The free end of flap 808 consists of a notch 816 which creates a locking tab 814. The surface of the first bottom flap 802 also has an opening 906, preferably in the shape of an oval, shaped to receive the free end of first leg flap 902. The surface of the second bottom also has an opening 908, preferably in the shape of an oval, shaped to receive the free end of second leg flap 904.

To construct the pallet container 10 from the blank 900, the eight walls are folded inward along the score lines 42, 44, 46, 48, 50, 52, 54, 56 of the first row 38. Glue flap 58, which is joined to first wall 12, is attached to eighth wall 26 to form the octagon opening 122 of the container 10. Glue flap 58 is preferably glued to the exterior surface of the eighth wall. Glue flap 60 of the second row 40 of the blank 100 is similarly attached to the outside fold 76. When glue flaps 58, 60 are attached to the eighth wall 26, score line 42 is aligned with side edge of the eighth wall 26.

The bottom piece 28 of the container is formed by interlocking the first bottom flap 802 and the second bottom flap 808. The flaps 802, 808 are interlocked by hooking locking tab 810 into notch 816 and hooking locking tab 814 into notch 812. This causes locking tab 810 to rest on the top surface of second bottom flap 808 and locking tab 814 to rest on the top surface of first bottom flap 802.

Figure 79:
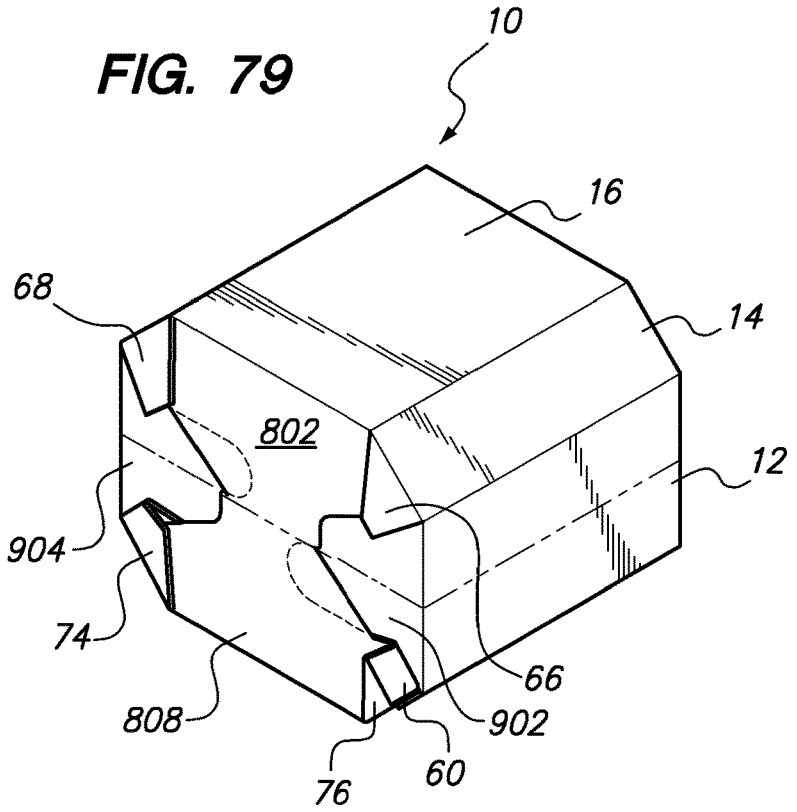
FIG. 79 is a perspective view of the bottom of the pallet container of FIG. 75 in the deployed position.
Figure 80:
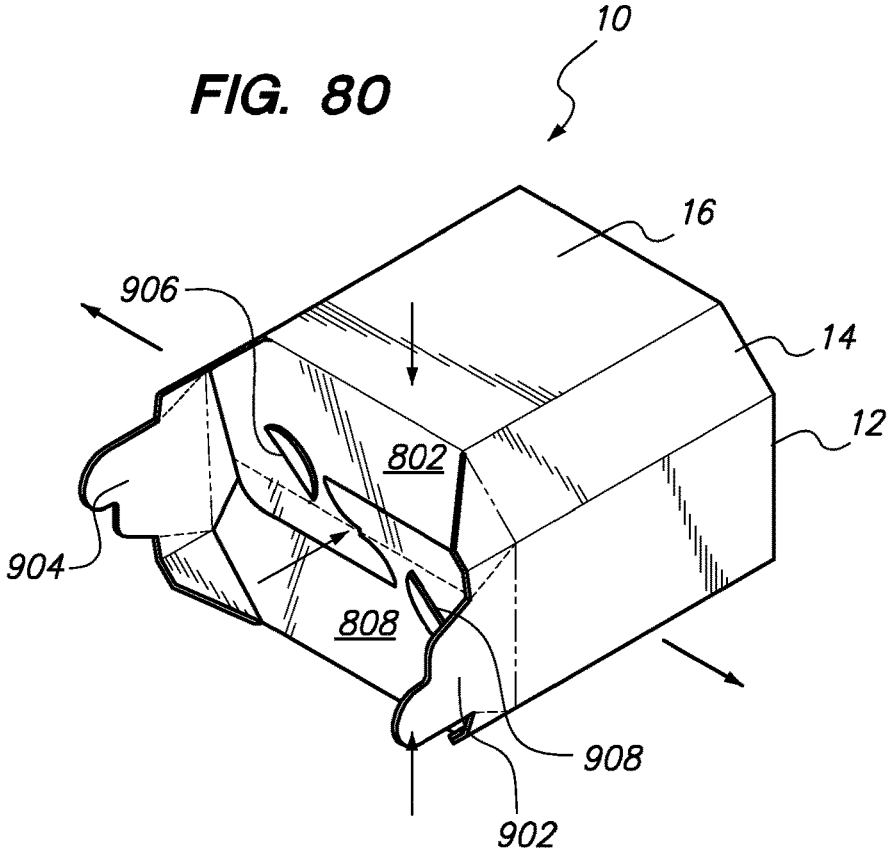
FIG. 80 is a perspective view of the bottom of the pallet container of FIG. 75 transitioning from the deployed position to the collapsed position.

As shown in FIG. 79, to further secure the bottom piece 28 of the container 10, the free end portion of first leg flap 902 is received through hole 906 in first bottom flap 802 and the free end portion of second leg flap 904 is received through hole 908 in second bottom flap 808. Once the free ends of the leg flaps 1002, 1004 are received by the holes 1006, 1008, the free ends are folded parallel to the interior surface of the bottom piece 28 to lock them into place.

With the absence of score line 118 and score line 120, the configuration of the container 10 constructed from blank 900 in the flat position is different from the first seven previously described embodiments. Specifically, the container 10 is folded along score line 44 and score line 52 when in the flat position.

In the top opening step of the deployment process of the container, the user pushes score line 44 and score line 52 towards each other. This action transitions the container 10 into the open position. An opening 122 in the top end of the container 10 is created by the eight joined walls 12, 14, 16, 18, 20, 22, 24, 26.

The second step of the deployment process is the bottom closing process. Once the top of the container 10 has been opened, the container 10 preferably is turned upside down to secure the bottom piece 28 of the container 10 by interlocking the first bottom flap 802 and the second bottom flap 808. As explained above, the flaps 802, 808 are interlocked by hooking locking tab 810 into notch 816 and hooking locking tab 814 into notch 812. This causes locking tab 810 to rest on the top surface of second bottom flap 808 and locking tab 814 to rest on the top surface of first bottom flap 802. To further secure the bottom piece of the container 10, the free end portion of first leg flap 1002 is received through hole 1006 in first bottom flap 802 and the free end portion of second leg flap 1004 is received through hole 1008 in second bottom flap 808. Once the free ends of the leg flaps 1002, 1004 are received by the holes 1006, 1008, the free ends are folded parallel to the interior surface of the bottom piece 28 to lock them into place.

Once the bottom piece 28 is assembled, pressure is exerted on the first leg flap 34 and the second leg flap 36. The pressure can be applied manually when the container 10 is upside down or by rocking the container 10 back-and-forth on first leg flap 34 and second leg flap 36 when the container 12 is in the upright position. This pressure causes the leg flaps 34, 36 fold under the bottom piece of the container 10 along score line 78. During the folding process of first leg flap 34, outside fold 76 (connected to glue flap 60) is forced to fold on top of first leg flap 34 along score lines 78, 42, and 80. Thus, inside fold 62 is folded between outside fold 76 and first leg flap 34. Similarly, outside fold 66 is forced to fold on top of first leg flap 34 along score lines 78, 44, and 82. Thus, inside fold 64 is folded between outside fold 66 and the first leg flap 34. During the folding process of second leg flap 36, outside fold 68 is forced to fold on top of second leg flap 36 along score lines 78, 50, and 84. Thus, inside fold 70 is folded between outside fold 68 and second leg flap 36. Similarly, outside fold 74 is forced to fold on top of second leg flap 36 along score lines 78, 52, and 86. Thus, inside fold 72 is folded between outside fold 74 and second leg flap 36. In application, the weight of the load inside the container 10 holds the first leg flap 34 and the second leg flap 36 parallel with bottom piece 28, and thus allows the flaps 34, 36 to serve as reinforcement to the bottom piece 28 of the container.

In tenth preferred embodiment, as shown in FIGS. 81-92, the container 10 is constructed from blank 1000. The blank 1000 has a first row 38 and a second row 40. The first row 38 is comprised of a glue flap 58, a first wall 12, a second wall 14, a third wall 16, a fourth wall 18, a fifth wall 20, a sixth wall 22, a seventh wall 24, and an eighth wall 26. The glue flap 58, first wall 12, second wall 14, third wall 16, fourth wall 18, fifth wall 20, sixth wall 22, seventh wall 24, and eighth wall 26 are all preferably rectangular in shape. The glue flap 58 is joined to the first wall 12 via a score line 42. Similarly, the first wall 12 is joined to the second wall 14 via score line 44, the second wall 14 to the third wall 16 via score line 46, the third wall 16 to the fourth wall 18 via score line 48, the fourth wall 18 to the fifth wall 20 via score line 50, the fifth wall 20 to the sixth wall 22 via score line 52, the sixth wall 22 to the seventh wall 24 via score line 54, and the seventh wall 24 to the eighth wall 26 via score line 56.

Top flaps are joined to each side wall. Flap 1002 is joined to first wall 12, flap 1004 is joined to second wall 14, flap 1006 is joined to third wall 16, flap 1008 is joined to fourth wall 18, flap 1010 is joined to fifth wall 20, flap 1012 is joined to sixth wall 22, flap 1014 is joined to seventh wall 24, and flap 1016 is joined to eighth wall 26.

Figure 81:
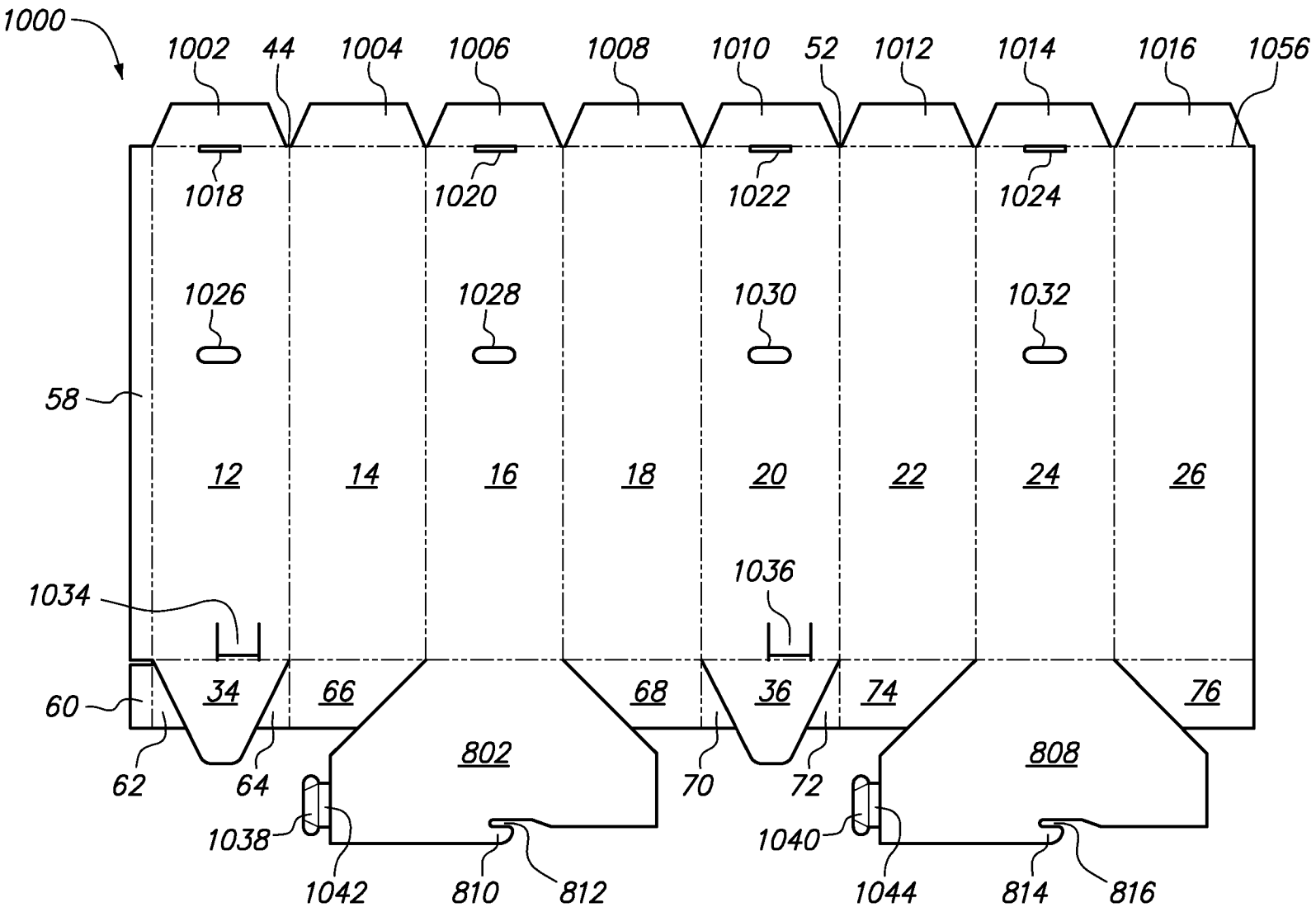
FIG. 81 is a flat plan view of the blank of the tenth preferred embodiment.
Figure 82:
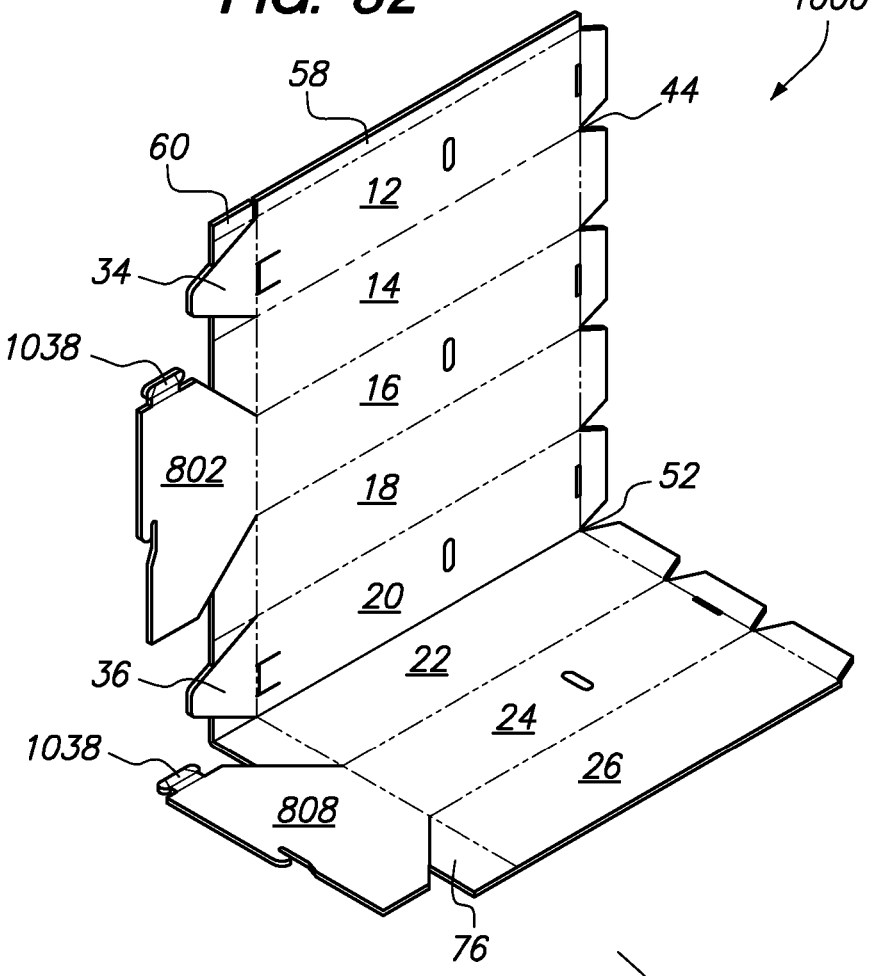
FIG. 82 is a perspective view of the blank of FIG. 81 partially folded along score line 52.
Figure 83:
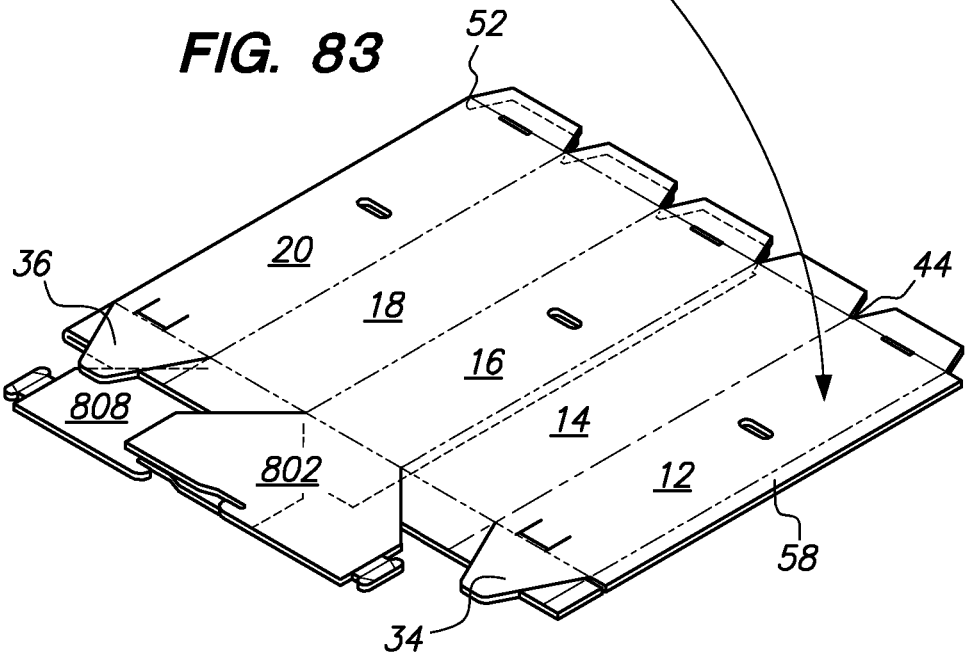
FIG. 83 is a perspective view of the blank of FIG. 81 completely folded along score line 52.
Figure 84:
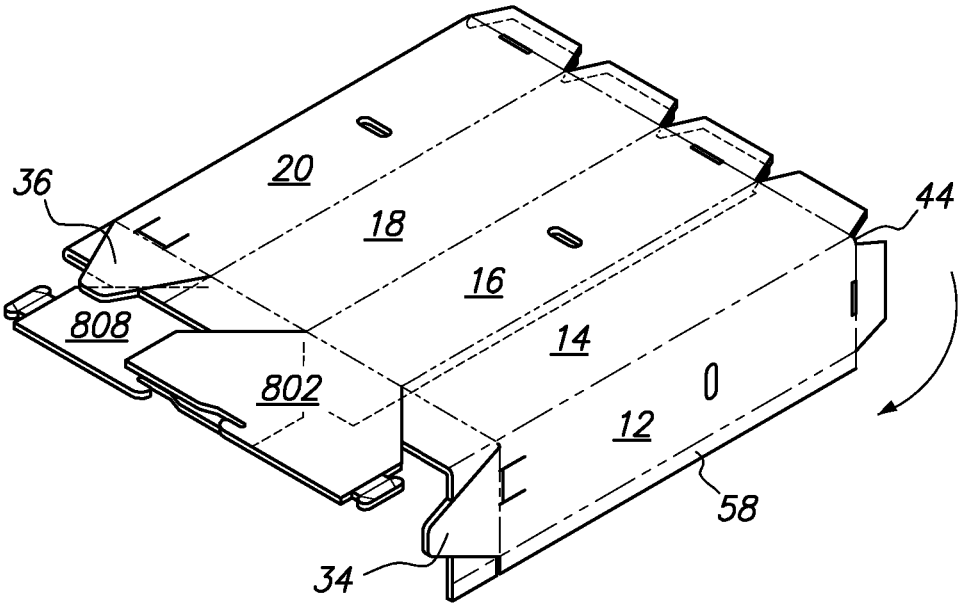
FIG. 84 is a perspective view of the blank of FIG. 83 partially folded along score line 44.
Figure 85:
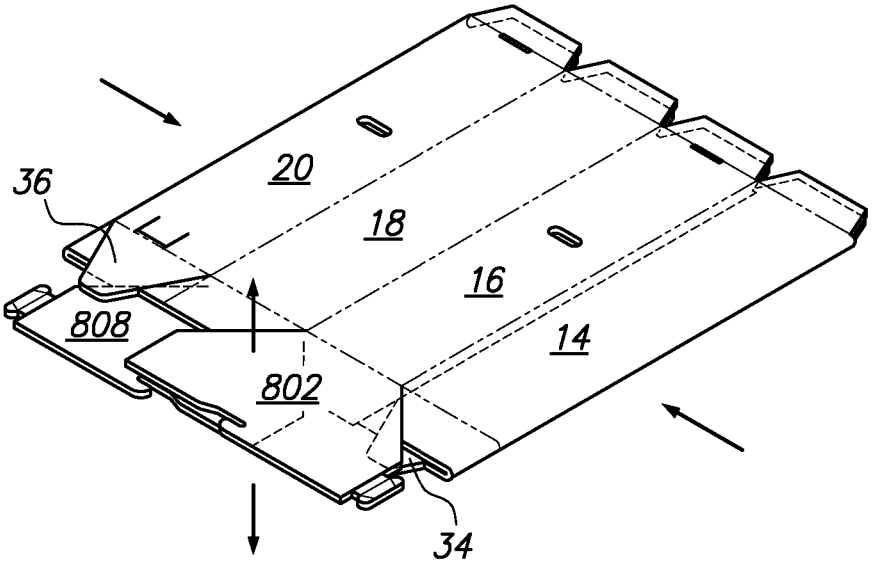
FIG. 85 is a perspective view of the blank of FIG. 83 completely folded along score line 44.

As shown in FIG. 81, cut into first wall 12 is flap 1034 which is preferably square or rectangular in shape. The flap 1034 is preferably cut along the bottom side and left and right sides of the flap 1034, leaving only the top side of the flap 1034 attached to first panel 12. Similarly, flap 1036 is cut into fifth wall 20 which is preferably square or rectangular in shape. The flap 1034 is preferably cut along the bottom side and left and right sides of the flap 1036, leaving only the top side of the flap 1034 attached to the fifth panel 20.

The first row 38 is joined to the second row 40 along score line 78. The second row 40 of blank 1000 is comprised of a glue flap 60, an inside fold 62, a first leg flap 34, an inside fold 64, an outside fold 66, a first bottom flap 802, an outside fold 68, an inside fold 70, a second leg flap 36, an inside fold 72, an outside fold 74, a second bottom flap 808, and an outside fold 76.

The glue flap 60 is joined to the inside fold 62 along score line 42. First leg flap 34 is joined to inside fold 62 along score line 80 on one side and joined to inside fold 64 along score line 82 on the other side. Inside fold 64 is joined to outside fold 66 along score line 44. First bottom flap 802 abuts, but is not joined to, the outside fold 66 on one side and the outside fold 68 on the other side. The outside fold 68 is joined to the inside fold 70 along score line 50. The second leg flap 36 is joined to inside fold 70 along score line 84 on one side and to inside fold 72 along score line 86 on the other side. Inside fold 72 is joined to outside fold 74 along score line 52. Second bottom flap 808 abuts, but is not joined to, the outside fold 74 on one side and the outside fold 76 on the other side. Inside folds 62, 64, 70, 72 are triangular-shaped, preferably in the shape of a right triangle.

The top sides of first bottom flap 802 and second bottom flap 808 are along score line 78. The bottom side (free end) of the flap 802 consists of a notch 812 which creates a locking tab 810. The free end of flap 808 consists of a notch 816 which creates a locking tab 814. Attached to one side of flap 802 along score line 1042 is a locking piece 1038. Similarly, attached to one side of flap 808 along score line 1044 is a locking piece 1040.

To construct the pallet container 10 from the blank 1000, the eight walls are folded inward along the score lines 42, 44, 46, 48, 50, 52, 54, 56 of the first row 38. Glue flap 58, which is joined to first wall 12, is attached to eighth wall 26 to form the octagon opening 122 of the container 10. Glue flap 58 is preferably glued to the exterior surface of the eighth wall. Glue flap 60 of the second row 40 of the blank 100 is similarly attached to the outside fold 76. When glue flaps 58, 60 are attached to the eighth wall 26, score line 42 is aligned with side edge of the eighth wall 26.

The bottom piece 28 of the container is formed by interlocking the first bottom flap 802 and the second bottom flap 808. The flaps 802, 808 are interlocked by hooking locking tab 810 into notch 816 and hooking locking tab 814 into notch 812. This causes locking tab 810 to rest on the top surface of second bottom flap 808 and locking tab 814 to rest on the top surface of first bottom flap 802.

In the top opening step of the deployment process of the container, the user pushes score line 44 and score line 52 towards each other. This action transitions the container 10 into the open position. An opening 122 in the top end of the container 10 is created by the eight joined walls 12, 14, 16, 18, 20, 22, 24, 26.

Figure 86:
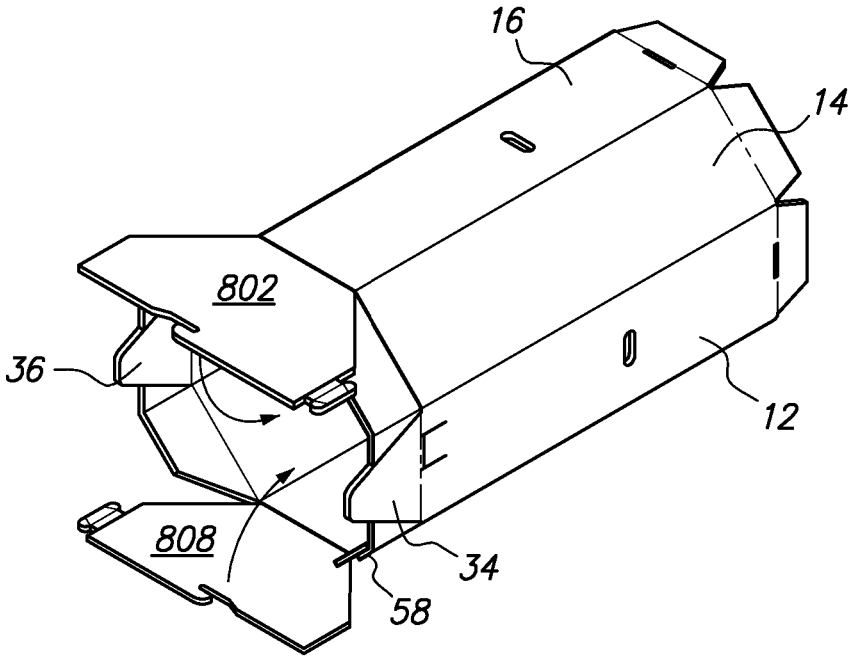
FIG. 86 is a perspective view of the pallet container constructed from the blank of FIG. 81 with the top of the container in the open position.
Figure 87:
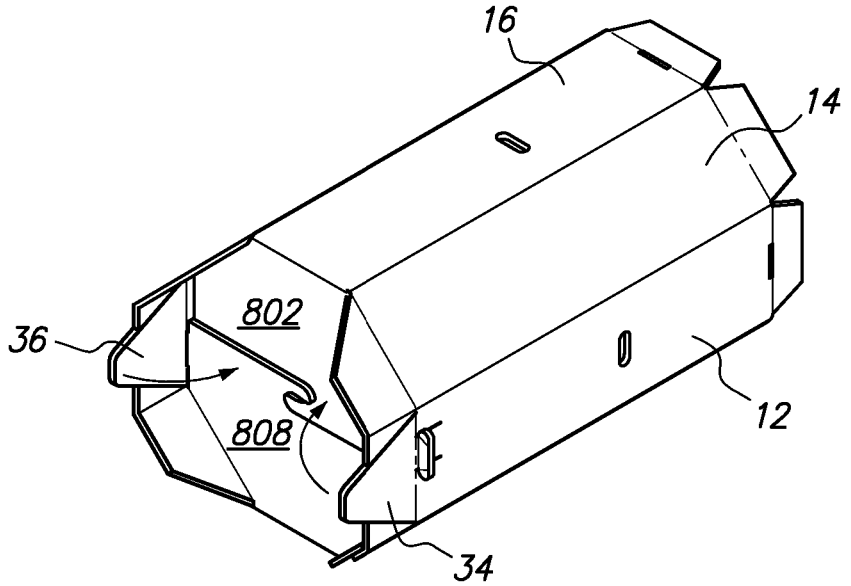
FIG. 87 is a perspective view of the pallet container of FIG. 86 with bottom flap 802 joined to bottom flap 808.
Figure 88:
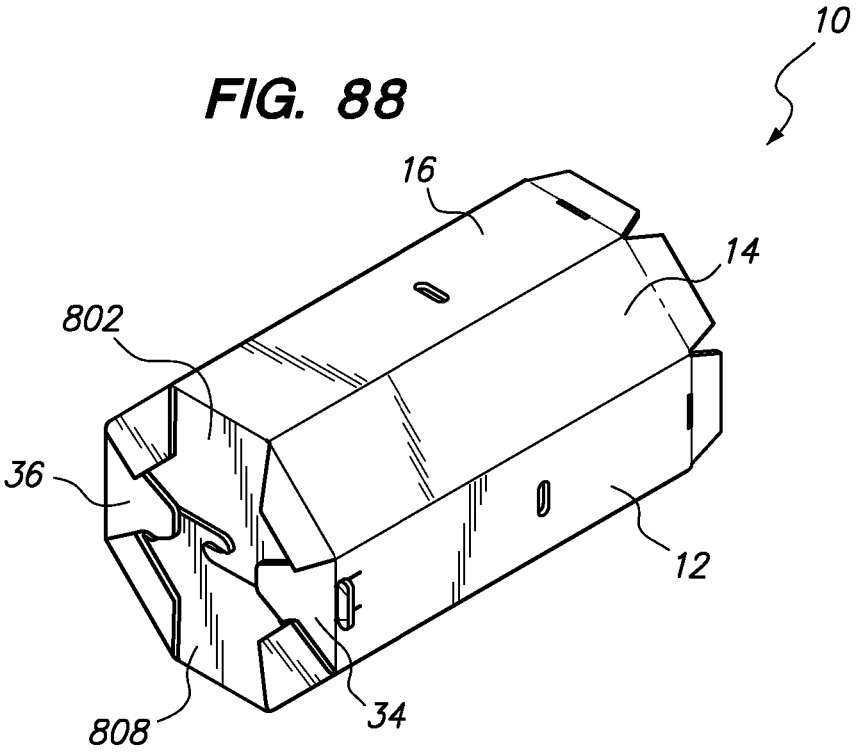
FIG. 88 is a perspective view of the bottom of the pallet container of FIG. 86 in the deployed position.
Figure 89:
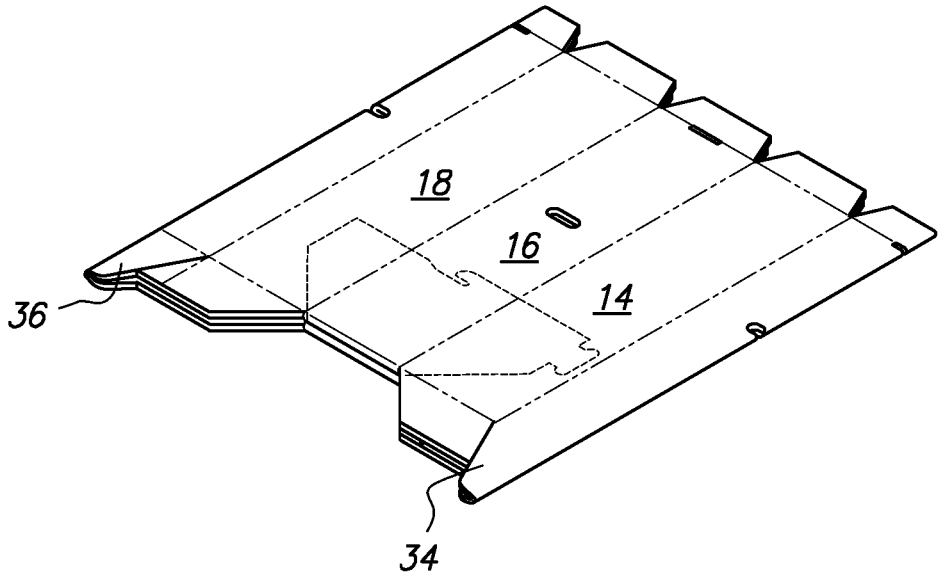
FIG. 89 is a perspective view of the pallet container of FIG. 86 in the collapsed position.

The second step of the deployment process is the bottom closing process. Once the top of the container 10 has been opened, the container 10 preferably is turned upside down to secure the bottom piece 28 of the container 10 by interlocking the first bottom flap 802 and the second bottom flap 808. As explained above, the flaps 802, 808 are interlocked by hooking locking tab 810 into notch 816 and hooking locking tab 814 into notch 812. This causes locking tab 810 to rest on the top surface of second bottom flap 808 and locking tab 814 to rest on the top surface of first bottom flap 802. As shown in FIGS. 86-88, to further secure the bottom piece 28, locking piece 1038 is received by flap 1034. Locking piece 1038 is then folded downward along score line 1042 thereby locking first bottom flap 802 to first wall 12. Similarly, locking piece 1040 is received by flap 1036. Locking piece 1040 is then folded downward along score line 1044 thereby locking second bottom flap 808 to fifth wall 20.

Once the bottom piece 28 is assembled, pressure is exerted on the first leg flap 34 and the second leg flap 36. The pressure can be applied manually when the container 10 is upside down or by rocking the container 10 back-and-forth on first leg flap 34 and second leg flap 36 when the container 12 is in the upright position. This pressure causes the leg flaps 34, 36 fold under the bottom piece of the container 10 along score line 78. During the folding process of first leg flap 34, outside fold 76 (connected to glue flap 60) is forced to fold on top of first leg flap 34 along score lines 78, 42, and 80. Thus, inside fold 62 is folded between outside fold 76 and first leg flap 34. Similarly, outside fold 66 is forced to fold on top of first leg flap 34 along score lines 78, 44, and 82. Thus, inside fold 64 is folded between outside fold 66 and the first leg flap 34. During the folding process of second leg flap 36, outside fold 68 is forced to fold on top of second leg flap 36 along score lines 78, 50, and 84. Thus, inside fold 70 is folded between outside fold 68 and second leg flap 36. Similarly, outside fold 74 is forced to fold on top of second leg flap 36 along score lines 78, 52, and 86. Thus, inside fold 72 is folded between outside fold 74 and second leg flap 36. In application, the weight of the load inside the container 10 holds the first leg flap 34 and the second leg flap 36 parallel with bottom piece 28, and thus allows the flaps 34, 36 to serve as reinforcement to the bottom piece 28 of the container.

As shown in FIG. 81, first wall 12, third wall 16, fifth wall 20, and seventh wall 24 also comprise handles 1026, 1028, 1030, 1032. The handles 1026, 1028, 1030, 1032 are preferably oval shaped and may be used to grasp the pallet container 10 to physically remove it from the pallet or otherwise move the pallet container 10 once off the pallet.

Figure 90:
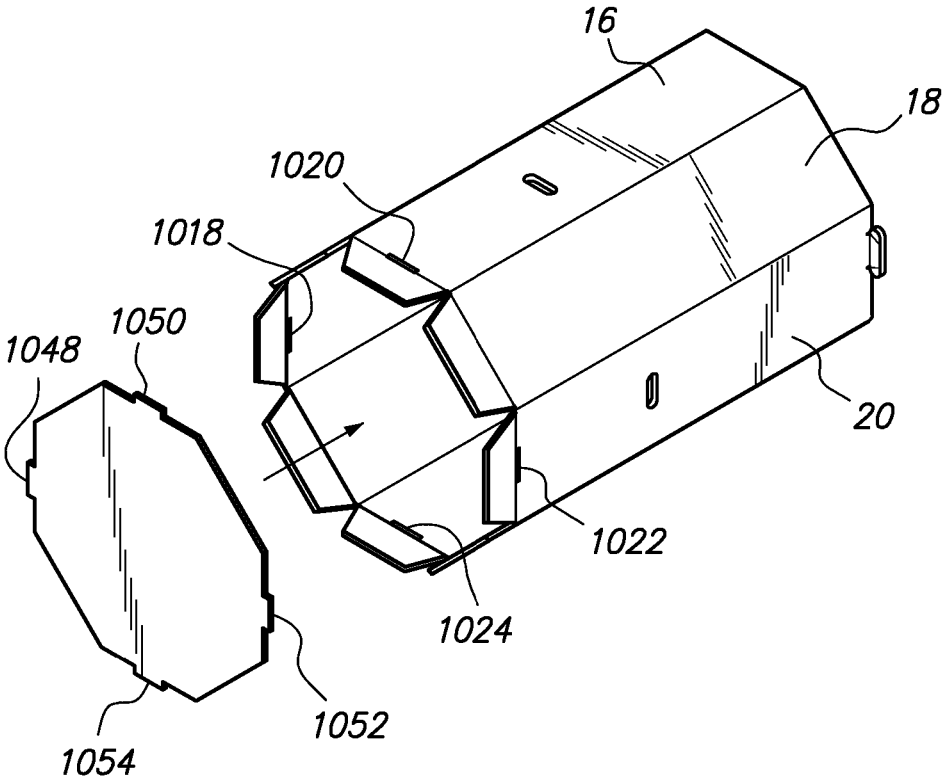
FIG. 90 is a perspective view of the pallet container of FIG. 86 with the top of the container in the open position with the cap being inserted.
Figure 91:
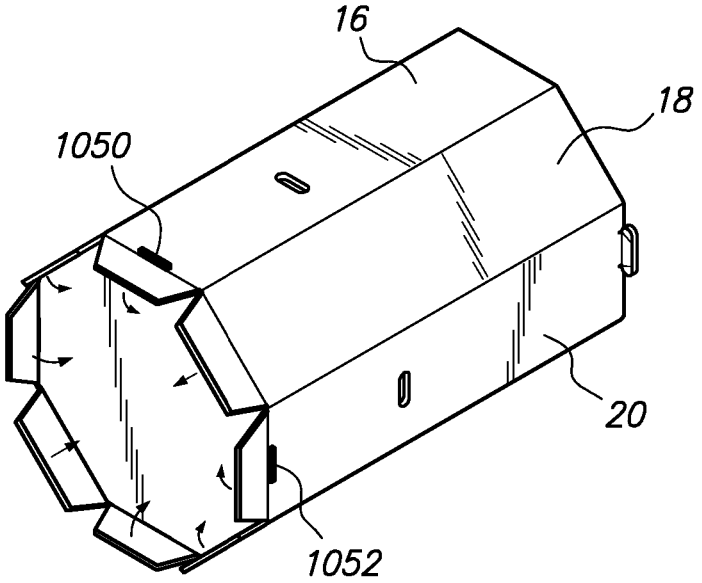
FIG. 91 is a perspective view of the pallet container of FIG. 86 with cap inserted into the top of the container.

First wall 12, third wall 16, fifth wall 20, and seventh wall 24 also comprise slots 1018, 1020, 1022, 1024. As shown in FIG. 81, the slots 1018, 1020, 1022, 1024 are positioned along the top edge of first wall 12, third wall 16, fifth wall 20, and seventh wall 24 and are shaped to receive the locking tabs 1048, 1050, 1052, 1054 of cap 1046. As shown in FIG. 90, the cap 1046 is preferably in the shape of an octagon. The locking tabs 1048, 1050, 1052, 1054 are joined to the first side, third side, fifth side and seventh side of the cap 1046. As shown in FIG. 91, the locking tabs 1048, 1050, 1052, 1054 of cap 1046 are received by slots 1018, 1020, 1022, 1024 which allows the cap 1046 to attach to the pallet container 10 and close the opening 122 of the pallet container 10. The cap 1046 serves to protect the contents of the pallet container 10.

Figure 92:
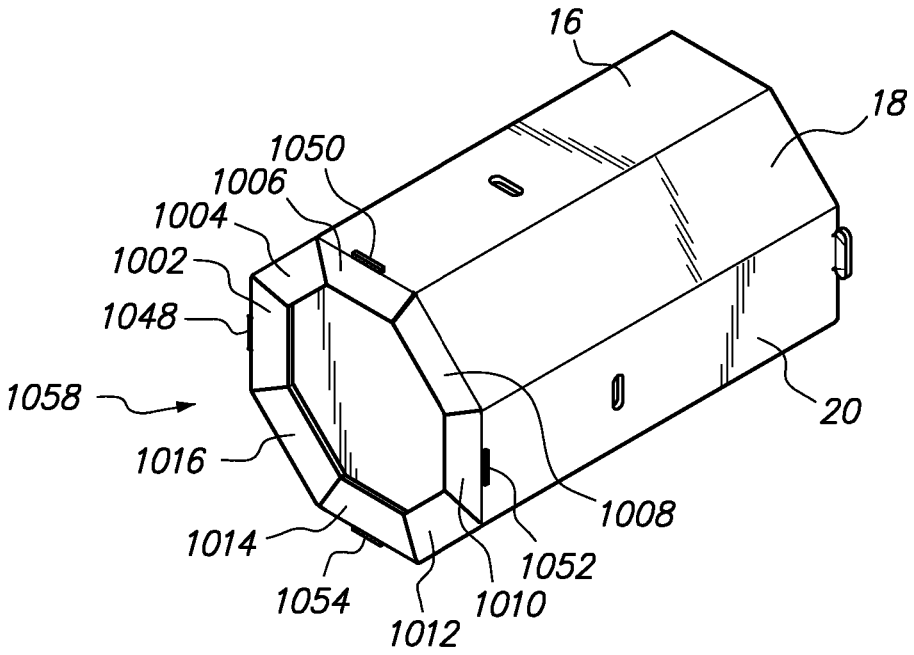
FIG. 92 is a perspective view of the pallet container of FIG. 91 with the flaps 1002, 1004, 1006, 1008, 1010, 1012, 1014, 1016 folded along score line 1056 forming rim 1058.
Figure 93:
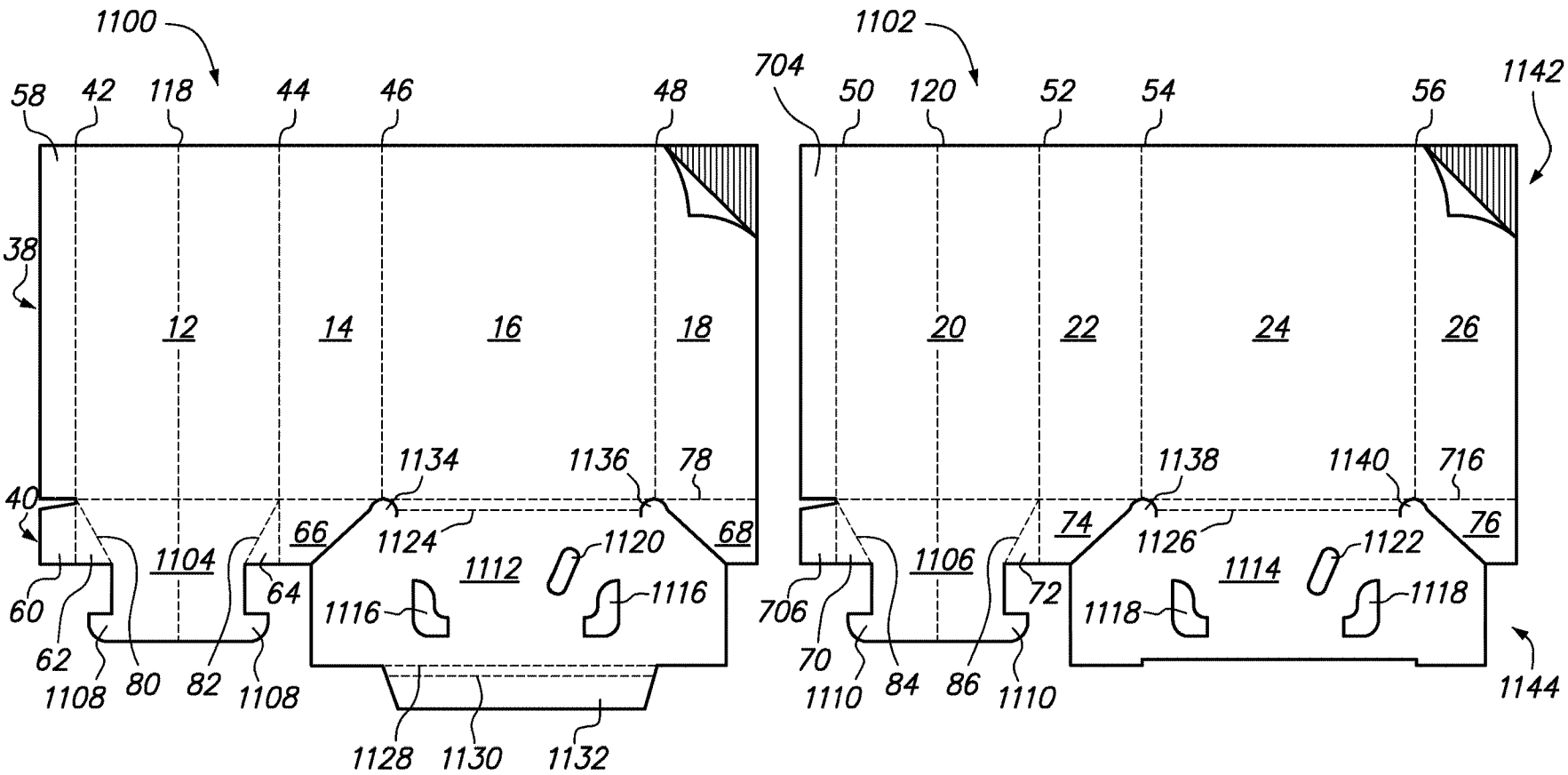
FIG. 93 is a flat plan view of the blanks of the eleventh preferred embodiment of the present invention.
Figure 94:
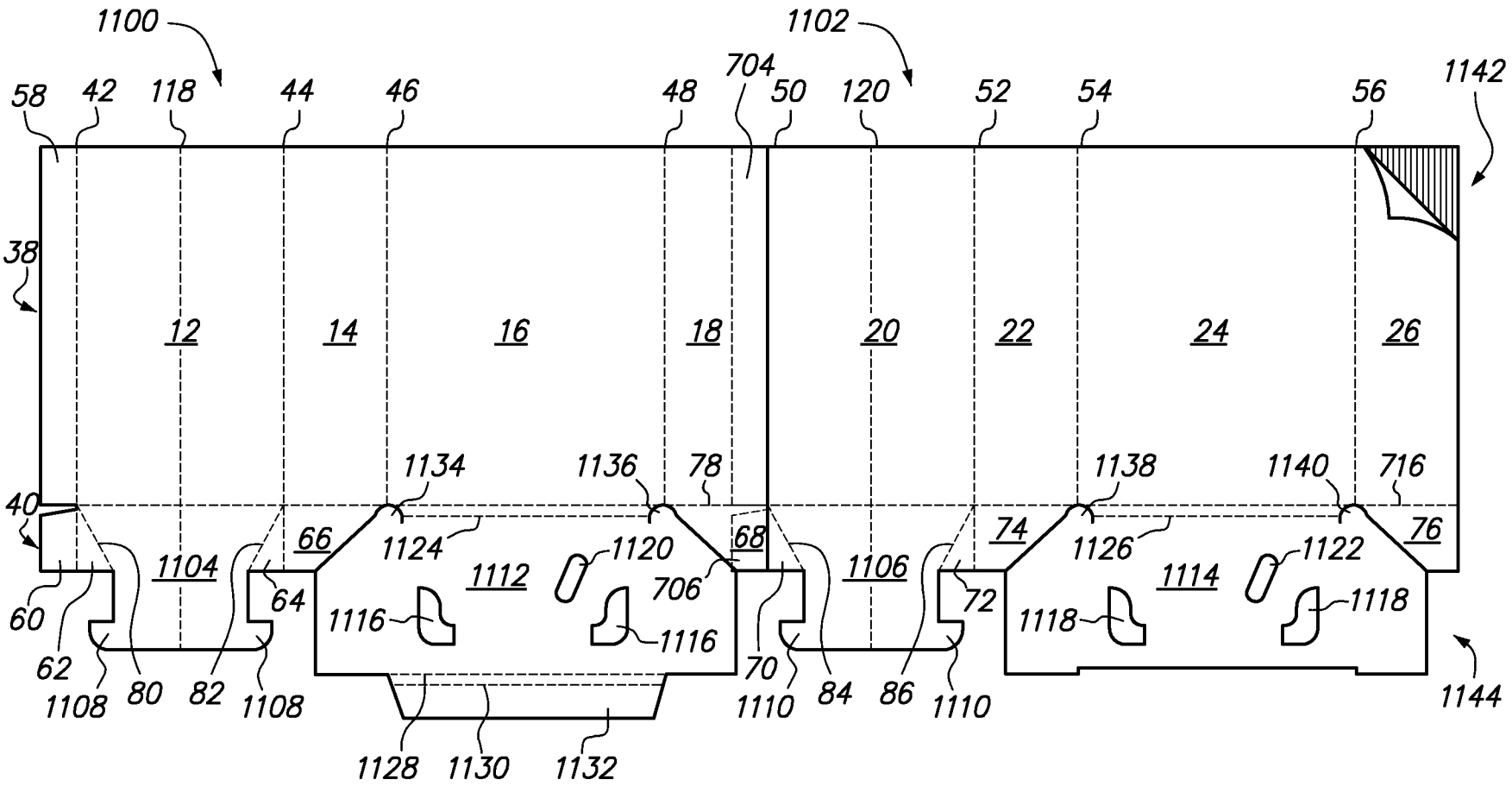
FIG. 94 is a flat plan view of blank 1100 joined to blank 1102.
Figure 95:
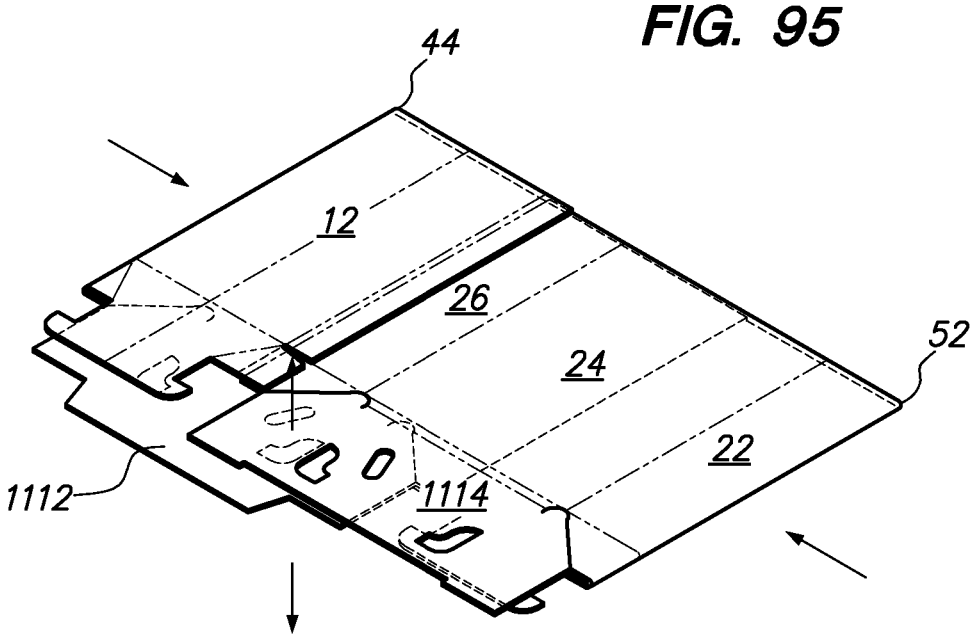
FIG. 95 is a perspective view of the joined blanks of FIG. 94 completed folded along score line 44.
Figure 96:
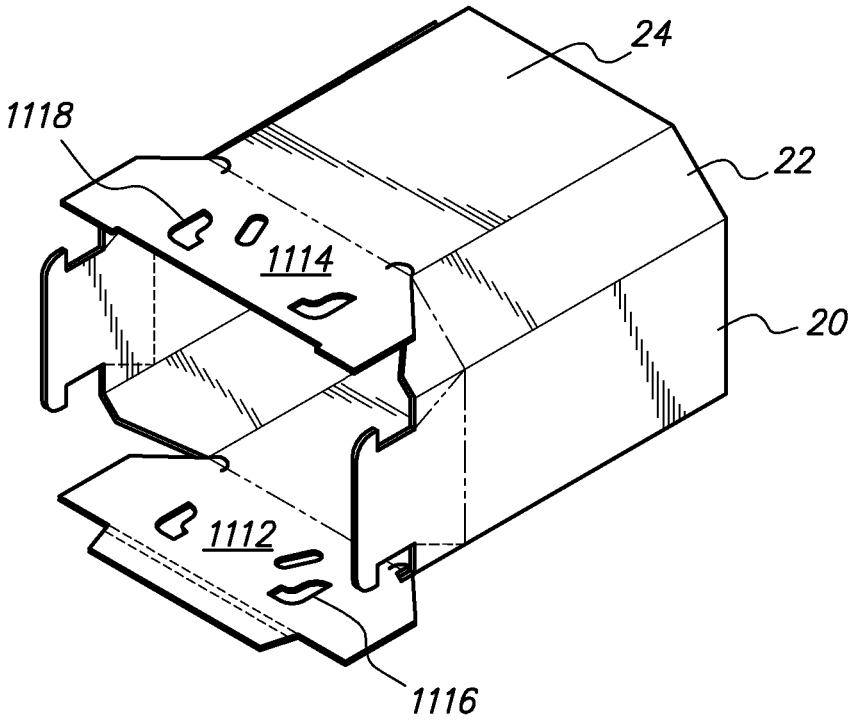
FIG. 96 is a perspective view of the pallet contain constructed from the blanks of FIG. 93.
Figure 97:
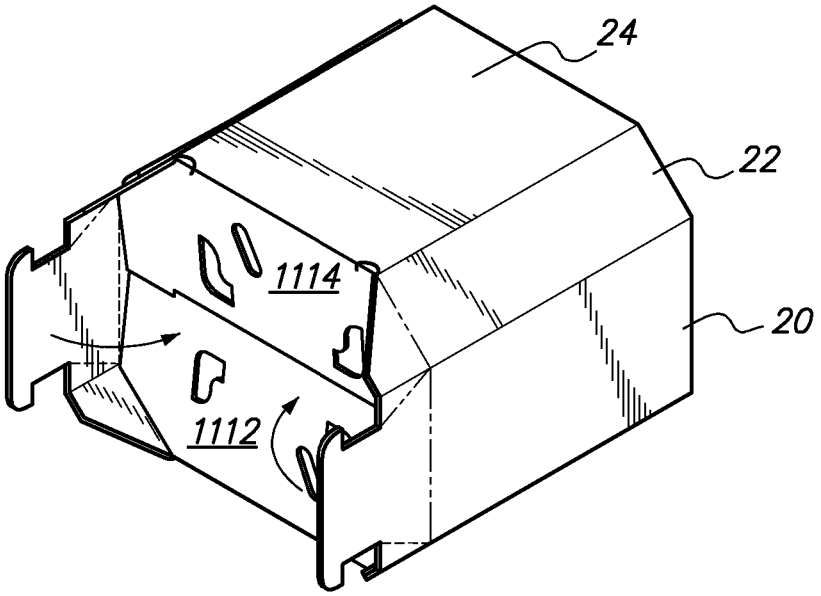
FIG. 97 is a perspective view of the bottom of the pallet container of FIG. 96 with bottom flap 1112 joined to bottom flap 1114.
Figure 98:
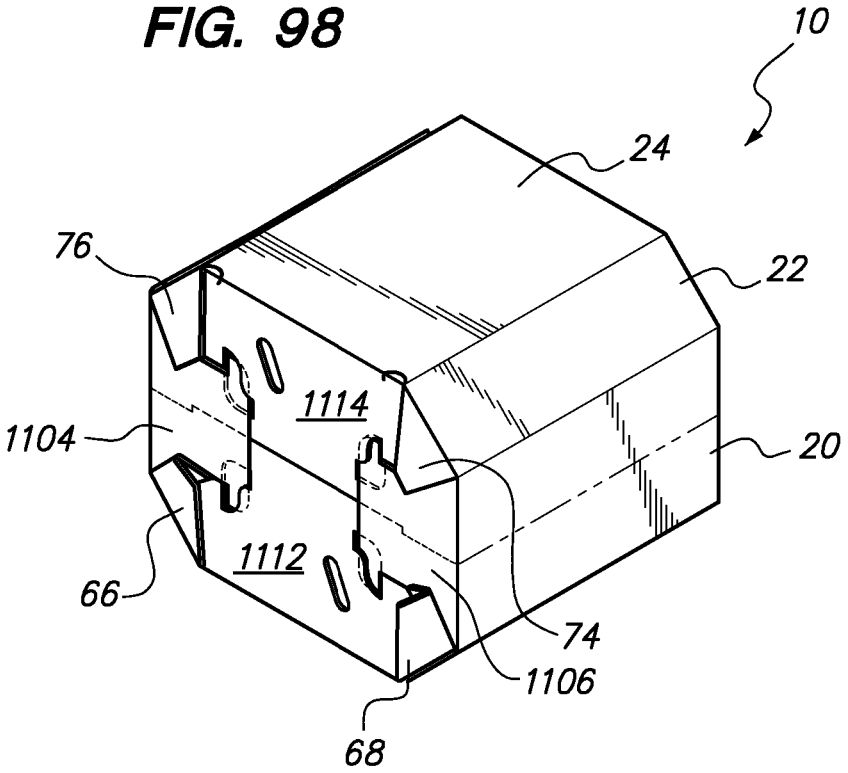
FIG. 98 is a perspective view of the bottom of the pallet container of FIG. 96 in the deployed position.

Once the cap 1046 has been inserted into the pallet container 10, flaps 1002, 1004, 1006, 1008, 1010, 1012, 1014, 1016 are folded downward along score line 1056 as shown in FIG. 92. The angled sides of the flaps 1002, 1004, 1006, 1008, 1010, 1012, 1014, 1016 abut one another when folded down as shown in FIG. 92. The flaps 1002, 1004, 1006, 1008, 1010, 1012, 1014, 1016 can be glued or otherwise joined to one another. When the flaps 1002, 1004, 1006, 1008, 1010, 1012, 1014, 1016 are joined to one another, they form a rim 1058 around the top of the pallet container 10. The rim 1058 further secures the cap 1046 into place.

In the eleventh preferred embodiment, as shown in FIGS. 93-99, the container 10 is constructed from blank 1100 and blank 1102. Blank 1100 has a first row 38 and a second row 40. The first row 38 is comprised of a glue flap 58, a first wall 12, a second wall 14, a third wall 16, and a fourth wall 18. The glue flap 58, first wall 12, second wall 14, third wall 16, and fourth wall 18 are all preferably rectangular in shape. The glue flap 58 is joined to the first wall 12 via a score line 42. Similarly, the first wall 12 is joined to the second wall 14 via score line 44, the second wall 14 to the third wall 16 via score line 46, and the third wall 16 to the fourth wall 18 via score line 48.

Blank 1102 has a first row 1142 and a second row 1144. The first row 1142 is comprised of glue flap 704, a fifth wall 20, a sixth wall 22, a seventh wall 24, and an eighth wall 26. Glue flap 704, fifth wall 20, sixth wall 22, seventh wall 24, and eighth wall 26 are all preferably rectangular in shape. The glue flap is preferably joined to the fifth wall 20 via score line 50, the fifth wall 20 to the sixth wall 22 via score line 52, the sixth wall 22 to the seventh wall 24 via score line 54, and the seventh wall 24 to the eighth wall 26 via score line 56.

The first row 38 of blank 1100 is joined to the second row 40 along score line 78. The second row 40 of blank 1100 is comprised of a glue flap 60, an inside fold 62, a first leg flap 1104, an inside fold 64, an outside fold 66, a first bottom flap 1112, and an outside fold 68. The first row 1142 of blank 1102 is joined to the second row 1144 along score line 716. The second row of blank 1102 is comprised of glue flap 706, an inside fold 70, a second leg flap 1106, an inside fold 72, an outside fold 74, a second bottom flap 1114, and an outside fold 76.

The glue flap 60 of blank 1100 is joined to the inside fold 62 along score line 42. First leg flap 1104 is joined to inside fold 62 along score line 80 on one side and joined to inside fold 64 along score line 82 on the other side. Inside fold 64 is joined to outside fold 66 along score line 44. First bottom flap 1112 abuts, but is not joined to, the outside fold 66 on one side and the outside fold 68 on the other side. The glue flap 706 of blank 1102 is joined to the inside fold 70 along score line 50. The second leg flap 1106 is joined to inside fold 70 along score line 84 on one side and to inside fold 72 along score line 86 on the other side. Inside fold 72 is joined to outside fold 74 along score line 52. Second bottom flap 1114 abuts, but is not joined to, the outside fold 74 on one side and the outside fold 76 on the other side. The inside folds 62, 64, 70, 72 are triangular-shaped, preferably in the shape of a right triangle.

The first bottom flap 1112 and second bottom flap 1114 are substantially in the shape of pentagon. The top side of flap 1112 is along double score lines 78, 1124. The top side of flap 1114 is along double score lines 716, 1126. The bottom side (free end) of the flaps 1112, 1114 is parallel to the top side. Joined to the bottom side of flap 1112 is glue flap 1132. The flap 1112 is separated from glue flap 1132 by two score lines 1128, 1130. The double score lines are used to prevent the corrugated material from splitting or fracturing when the blanks are folded. The top corners of the first bottom flap 1112 include rounded sections 1134, 1136 positioned between the double score lines 78, 1124. Similarly, the top corners of the second bottom flap 1114 include rounded sections 1138, 1140 positioned between the double score lines 716, 1126. These rounded sections prevent tearing of the bottom flaps 1112, 1114 when the blanks 1100, 1102 are folded along score lines 46, 48, 54, 56.

The free end of flap 1104 includes two hooked portions 1108 positioned opposite one another. The free end of flap 1106 includes two hooked portions 1110 positioned opposite one another. The surface of the first bottom flap 1112 has two openings 1116 shaped to receive one hooked end 1108 of flap 1104 and one hooked end 1110 of flap 1106. The surface of the second bottom flap 1114 also has two openings 1118 shaped to receive one hooked end 1108 of flap 1104 and one hooked end 1110 of flap 1106. The bottom flaps 1112, 1114 each also include an oval opening 1120, 1122. The openings serve as hand holes for use while assembling the container 10 formed from blanks 1100, 1102.

To construct the pallet container 10 from blanks 1100, 1102, glue flap 1132 is attached to second bottom flap 1114. To construct the top piece of the container 10, glue flap 58 of blank 1100 is attached to eighth wall 26 of blank 1102. Glue flap 60 is also attached to outside fold 76. In addition, glue flap 704 of blank 1102 is attached to fourth wall 18. Glue flap 706 is also attached to outside fold 68. Once the eight walls are folded inward along the score lines 42, 44, 46, 48, 50, 52, 54, 56, the octagon 122 opening of the container 10 is formed.

The deployment process of the container 10 constructed from blanks 1100, 1102 is the same as previously described. Once the container 10 is deployed, to further secure the bottom piece 28 of the container 10, one hooked end 1108 of first leg flap 1104 is received and secured through opening 1116 in first bottom flap 1112 and the other hooked end 1108 is received and secured through opening 1118 in second bottom flap 1114. One hooked end 1110 of the second leg flap 1106 is received and secured through the second opening 1116 in the first bottom flap 1112 and the other hooked end 1110 is received and secured through the second opening 1118 in second bottom flap 1114. Using the hooked ends 1108, 1110 to further secure the bottom piece 28 of the container 10 is optional. In other words, the container 10 is fully functional without locking the hooked ends 1108, 1110. The hand holes 1120, 1122 may assist the assembler in locking the hooked ends 1108, 1110 in the receiving slots 1116, 1118. To collapse the container 10 formed from blanks 1100, 1102, the hooked ends 1108, 1110 must be removed from the openings 1116, 1118 and the container 10 may be collapsed as previously described.

Although illustrative embodiments of the invention have been described in detail, it is to be understood that the present invention is not limited to those precise embodiments, and that various changes and modifications can be effected therein by one skilled in the art without departing from the scope and spirit of the invention as defined by the claims.

The present invention has been described with reference to certain preferred and alternative embodiments that are intended to be exemplary only and not limiting to the full scope of the present invention as set forth in the appended claims.

What is claimed is:

1. A pallet container comprising:

(a) eight side walls, wherein said side walls are joined to one another;

(b) a first leg flap;

(c) a first inside fold and a second inside fold, wherein said first inside fold is joined between said first leg flap and a first outside fold and said second inside fold is joined between said first leg flap and a second outside fold;

(d) a second leg flap;

(e) a third inside fold and a fourth inside fold, wherein said third inside fold is joined between said second leg flap and a third outside fold and said fourth inside fold is joined between said second leg flap and a fourth outside fold;

(f) a first bottom flap, wherein a free end of said first bottom flap includes a first notch which creates a first locking tab; and (g) a second bottom flap, wherein a free end of said second bottom flap includes a second notch which creates a second locking tab, (h) a first glue flap joined to said first inside fold, said first glue flap is configured to join said first inside fold with said first outside fold, wherein a length of a longest shared edge of said first notch and said first locking tab is less than a length of a longest edge associated with said first notch.

2. The pallet container of claim 1, further comprising a bottom piece, said bottom piece formed at least from said first bottom flap coupled directly to said second bottom flap when the pallet container is in a closed position.

3. The pallet container of claim 1, wherein said pallet container has an open position and a closed position.

4. The pallet container of claim 2, wherein said first bottom flap is coupled to said second bottom flap by hooking said first locking tab into said second notch and hooking said second locking tab into said first notch.

5. The pallet container of claim 3, wherein said first leg flap and said second leg flap are folded parallel to said bottom piece when said pallet container is in the open position.

6. The pallet container of claim 3, wherein said first inside fold is folded between said first leg flap and said first outside fold and said second inside fold is folded between said first leg flap and said second outside fold when said pallet container is in the open position.

7. The pallet container of claim 3, wherein said third inside fold is folded between said second leg flap and said third outside fold and said fourth inside fold is folded between said second leg flap and said fourth outside fold when said pallet container is in the open position.

* * * * *